US011193507B2

(12) United States Patent
Vacca et al.

(10) Patent No.: US 11,193,507 B2
(45) **Date of Patent: *Dec. 7, 2021**

(54) MINIATURE HIGH PRESSURE PUMP AND ELECTRICAL HYDRAULIC ACTUATION SYSTEM

(71) Applicant: Purdue Research Foundation, West Lafayette, IN (US)

(72) Inventors: Andrea Vacca, Lafayette, IN (US); Gabriele Altare, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 135 days.

This patent is subject to a terminal disclaimer.

(21) Appl. No.: 16/199,824

(22) Filed: Nov. 26, 2018

(65) Prior Publication Data

US 2019/0242410 A1 Aug. 8, 2019

Related U.S. Application Data

(63) Continuation of application No. 14/912,758, filed as application No. PCT/US2014/051734 on Aug. 19, 2014, now Pat. No. 10,138,908.

(Continued)

(51) Int. Cl.
*F04C 2/18* (2006.01)
*F04C 14/00* (2006.01)

(Continued)

(52) U.S. Cl.
CPC ..... *F15B 7/006* (2013.01); *F01C 21/02* (2013.01); *F04C 2/18* (2013.01); *F04C 14/00* (2013.01);

(Continued)

(58) Field of Classification Search
CPC ..... F15B 7/006; F15B 15/18; F01C 21/02; F04C 2/18; F04C 14/00; F04C 14/04;

(Continued)

(56) References Cited

U.S. PATENT DOCUMENTS 1,590,226 A 6/1926 Boisset
2,148,268 A 2/1939 Kerr (Continued)

FOREIGN PATENT DOCUMENTS

EP 2154372 2/2010
GB 2044856 10/1980

(Continued)

OTHER PUBLICATIONS

U.S. Appl. No. 14/912,758, Office Action, 11 pages dated Mar. 26, 2018.

(Continued)

*Primary Examiner* — Deming Wan
(74) *Attorney, Agent, or Firm* — John V. Daniluck; Gerald W. Roberts; Dentons Bingham Greenebaum LLP

(57) ABSTRACT

Methods and apparatus pertaining to positive displacement pumps, and further to hydraulic actuation systems. In some embodiments the pumps are gear pumps with bi-directional operation. In some embodiments the actuation system includes a motor-driven, reversible operation gear pump providing fluid under pressure to a rod and cylinder.

3 Claims, 54 Drawing Sheets

| ITEM NO. | PART NUMBER | DESCRIPTION | QTY1 |
|---|---|---|---|
| 21 | HSG-00010 | PUMP HOUSING | 1 |
| 22 | GR-00009 | DRIVE GEAR | 1 |
| 23 | GR-00010 | DRIVEN GEAR | 1 |
| 24 | SPC-00009-V002 | PUMP BOTTOM COVER | 1 |
| 25 | SPC-00010-V002 | PUMP TOP COVER | 1 |
| 26 | SPC-00010-V002 | BEARING BLOCK | 2 |
| 27 | SL-00003-V002 | SEAL | 2 |
| 28 | BRG-00006 | BALL CHECK VALVE | 2 |
| 29 | SPR-00002 | SPRING CHECK VALVE | 2 |

Related U.S. Application Data

(60) Provisional application No. 61/867,462, filed on Aug. 19, 2013.

(51) Int. Cl.

| | |
|---|---|
| ***F04C 14/04*** | (2006.01) |
| ***F04C 15/00*** | (2006.01) |
| ***F04C 15/06*** | (2006.01) |
| ***F15B 7/00*** | (2006.01) |
| ***F15B 15/18*** | (2006.01) |
| ***F01C 21/02*** | (2006.01) |

(52) U.S. Cl.
CPC ..... *F04C 14/04* (2013.01); *F04C 15/008* (2013.01); *F04C 15/0026* (2013.01); *F04C 15/0034* (2013.01); *F04C 15/0042* (2013.01); *F04C 15/06* (2013.01); *F04C 15/064* (2013.01); *F15B 15/18* (2013.01); *F04C 15/066* (2013.01); *F04C 2240/56* (2013.01)

(58) Field of Classification Search
CPC .. F04C 15/0026; F04C 15/0034; F04C 15/06; F04C 15/064; F04C 15/0019
See application file for complete search history.

(56) References Cited

U.S. PATENT DOCUMENTS

| | | | | |
|---|---|---|---|---|
| 2,368,659 | A | 2/1945 | Heineck et al. | |
| 2,437,791 | A | 3/1948 | Roth et al. | |
| 2,467,508 | A | 4/1949 | Trautman | |
| 2,467,509 | A | 4/1949 | Trautman | |
| 2,657,533 | A | 11/1953 | Schanzlin et al. | |
| 2,927,429 | A | 3/1960 | Carlson | |
| 3,263,425 | A | 8/1966 | Rohde | |
| 3,272,086 | A | 9/1966 | Soeters | |
| 3,301,192 | A | 1/1967 | Morrell | |
| 3,578,887 | A | 5/1971 | Turolla | |
| 3,593,522 | A | 7/1971 | Angert | |
| 3,709,055 | A * | 1/1973 | Grove | F16H 55/08 74/462 |
| 3,797,245 | A | 3/1974 | Hein | |
| 3,877,347 | A | 4/1975 | Sheesley et al. | |
| 3,895,890 | A * | 7/1975 | Laumont | F04C 15/0026 418/132 |
| 4,160,630 | A | 7/1979 | Wynn | |
| 4,281,974 | A * | 8/1981 | Teruyama | F04C 15/0026 418/132 |
| 4,830,592 | A | 5/1989 | Weidhaas | |
| 5,279,119 | A | 1/1994 | Shelhart et al. | |
| 6,390,793 | B1 | 5/2002 | Sweet et al. | |
| 6,519,939 | B1 | 2/2003 | Duff | |
| 6,543,223 | B2 | 4/2003 | Muschong et al. | |
| 6,979,185 | B2 | 12/2005 | Kaempe | |
| 6,991,442 | B2 | 1/2006 | Meguro | |
| 6,997,210 | B2 | 2/2006 | Horn et al. | |
| 7,051,526 | B2 | 5/2006 | Geiger | |
| 7,155,910 | B2 | 1/2007 | Last | |
| 7,281,372 | B2 | 10/2007 | Sakai et al. | |
| 7,488,162 | B2 | 2/2009 | Jordan | |
| 7,972,126 | B2 | 7/2011 | Jordan | |
| 8,161,742 | B2 | 4/2012 | Sweeney et al. | |
| 8,448,432 | B2 | 5/2013 | Bresie | |
| 8,894,385 | B2 | 11/2014 | Goss et al. | |
| 2003/0223896 | A1 * | 12/2003 | Gilbert | F04C 13/008 418/9 |
| 2004/0163386 | A1 | 8/2004 | Kopp et al. | |
| 2006/0168955 | A1 | 8/2006 | Longfield et al. | |
| 2008/0022672 | A1 | 1/2008 | He | |
| 2010/0193714 | A1 | 8/2010 | Hankinson et al. | |
| 2011/0107756 | A1 | 5/2011 | Kondo et al. | |
| 2011/0289912 | A1 | 12/2011 | Olson et al. | |
| 2012/0067035 | A1 | 3/2012 | Sweeney et al. | |
| 2013/0067898 | A1 | 3/2013 | Onishi et al. | |
| 2013/0068885 | A1 | 3/2013 | Onomichi et al. | |
| 2015/0135701 | A1 | 5/2015 | Zammuto | |

FOREIGN PATENT DOCUMENTS

| | | |
|---|---|---|
| JP | S55060680 | 5/1980 |
| JP | H10281081 | 10/1998 |
| KR | 102013066176 | 6/2013 |

OTHER PUBLICATIONS

U.S. Appl. No. 14/912,758, Applicant Response to Office Action, 19 pages dated Apr. 3, 2018.

U.S. Appl. No. 14/912,758, Notice of Allowance, 7 pages dated Jul. 13, 2018.

Irving, J., Smith, S.,: "Electro Hydrostatic Actuators for Control of Undersen Vehicles," Joint Undersen Warfare Technology Fall Conference, Croton, CT, 27 pgs Sep. 14, 2006.

Supplementary Partial EP Search Report, 5 pages dated Mar. 29, 2017.

Takahashi, et al., "Development of Prototype Electr-Hydrostatic Actuator for Landing Gear Extension and Retraction System," JFPS ISBN 4-931070-07X, 2008 27 pgs. Jan. 1, 2008.

Parker Hannifin, "Compact EHA Electro-Hydraulic Actuators for High Power Denistry Application," Catalog HY22-3101D3aa; 2011, 8 pgs. Jan. 1, 2011.

* cited by examiner

| ITEM NO. | PART NUMBER | DESCRIPTION | QTY1 |
|---|---|---|---|
| 21 | HSG-00010 | PUMP HOUSING | 1 |
| 22 | GR-00009 | DRIVE GEAR | 1 |
| 23 | GR-00010 | DRIVEN GEAR | 1 |
| 24 | SPC-00009-V002 | PUMP BOTTOM COVER | 1 |
| 25 | SPC-00010-V002 | PUMP TOP COVER | 1 |
| 26 | SPC-00013-V002 | BEARING BLOCK | 2 |
| 27 | SL-00003-V002 | SEAL | 2 |
| 28 | BRG-00006 | BALL CHECK VALVE | 2 |
| 29 | SPR-00002 | SPRING CHECK VALVE | 2 |

SECTION I-I
SCALE 1.5 : 1

SECTION H-H
SCALE 1.5 : 1

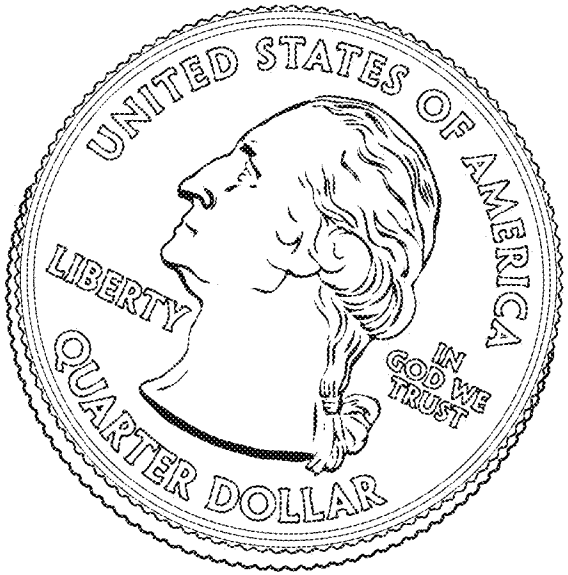
FIG. 46A
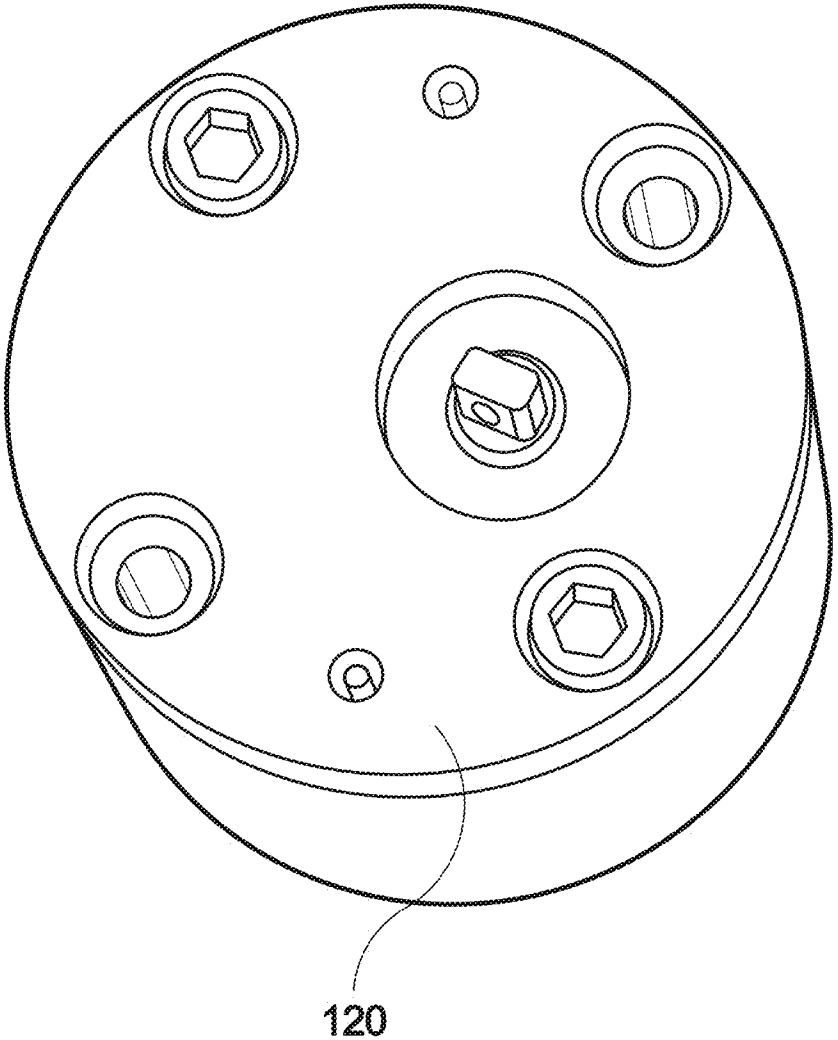

Retraction, aiding load

Extension, aiding load

Retraction, resistant load

Extension, resistant load

MINIATURE HIGH PRESSURE PUMP AND ELECTRICAL HYDRAULIC ACTUATION SYSTEM

CROSS REFERENCE TO RELATED APPLICATIONS

This application is a continuation of U.S. patent application Ser. No. 14/912,758, filed Feb. 18, 2016, now issued as U.S. Pat. No. 10,138,908; which is a 371 application of international patent application Serial No. PCT/US2014/051734, filed Aug. 19, 2014, which claims the benefit of priority to U.S. Provisional Patent Application Ser. No. 61/867,462, filed Aug. 19, 2013, all of which are incorporated herein by reference.

FIELD OF THE INVENTION

Various embodiments of the present invention pertain to positive displacement pumps, and in particular to a gear pump useful in an actuation system.

BACKGROUND OF THE INVENTION

There is interest in many field of application to move from a pure Hydraulic Actuation System (HAS) to an Electro Mechanical Actuation System (EMAS). Examples are present both in aeronautics, where the concept of a "More Electric Aircraft" is becoming more and more important, and in ground/undersea vehicles. In the aeronautic field this trend is justified by the potential reduction of weight compared to a HAS and by the versatility offered by the electric approach. However, EMAS do not reach the same power density levels of hydraulic systems. The energy efficiency of EMAS can also be limited by the screw mechanism, i.e. self-locking screw, when the application requires position hold (like in aircraft seats). Moreover, EMAS suffer of a common issue that is the jamming, in addition to wear in the incorporated gears as well as in the screw mechanism, which can lead to backslash. In EMAS, a gearbox is necessary in order to lower the actuating torque thus permitting the use of small electric motors. This gearbox can negatively affect the overall volume and weight of the system. Furthermore, the high reduction ratio can have detrimental effect on the dynamic behavior of the system since, the inertia will be over-perceived from the motor. For these reasons, in particular for the jamming issue, for flight controls so far the EMAs are used only for backup purpose; also, they should be equipped in such a way to be easily decoupled by the other actuator during jamming.

The EHA solution can be seen as a more convenient way to transit to the "More Electric Aircraft". The use of compact EHAs can permit to combine the power to weight advantage of hydraulic systems with the ease of control and wiring advantages of the electric systems. This concept has been well received in the aerospace field, and several solutions for EHA are currently available in the market.

The pump is an element in any hydraulic system, as concerns energy efficiency, noise emissions, life and reliability. In EHA systems, the pump design can be fixed displacement, being the flow controlled by the electric motor speed with a design suitable for miniaturization and permitting higher shaft speed. From this regard, external gear pumps offer high potential, considering manufacture cost and simplicity.

Various embodiments of the inventions described herein present novel and unobvious ways to improve electro-hydraulic actuation systems, and also positive displacement pumps.

SUMMARY OF THE INVENTION

Various embodiments presented herein present an innovative design solution for a compact Electro-Hydraulic Actuator (EHA). Although the current trend in many mobile applications is towards Electro Mechanical Solutions (EMAS) instead of Hydraulic Actuation systems (HAS), the use of HEAs could represent the best technological compromise. In fact, EHA can combine the power to weight ratio advantage of hydraulic technology with the versatility and ease of control of electric technology. Compared to EMAS, which are often equipped with low efficiency load holding mechanisms, EHAs can also offer superior energy efficiency.

One element of a compact EHA system according to one embodiment of the present invention is a miniaturized bi-directional gear pump. The pump design is conceived for performance in terms of efficiency, noise emissions and durability. Some embodiments include a pressure compensation system to minimize power losses associated with the internal lubricating gaps. The pump is used to control a differential cylinder in a layout that includes built-in valves to allow control of the actuator according to a power-on-demand strategy. Applications of the proposed EHA include aircrafts, cargo and vehicle doors, hatches and landing gears. Although what has been shown and described is a bi-directional pump useful in an actuation system, it is understood that yet other embodiments of the present invention pertain to gear pumps that are not bi-directional, but which incorporate one or more of the features and aspects shown herein.

Described herein is the numerical approach used to formulate the new design for gear pump used in the reference EHA. An optimization procedure based on the use of a detailed simulation model for pressure compensated external gear unit was formulated. Based on the optimal design provided by the optimization procedure, a prototype was realized and tested. Experimental results confirmed the potentials of the proposed design procedure.

It will be appreciated that the various apparatus and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions. Further, some of the figures shown herein may have been created from scaled drawings or from photographs that are scalable. It is understood that such dimensions, or the relative scaling within a figure, are by way of example, and not to be construed as limiting.

FIG. 46A is a line drawing of a photograph showing an overall view of a pump.

ELEMENT NUMBERING

Figure 1A:
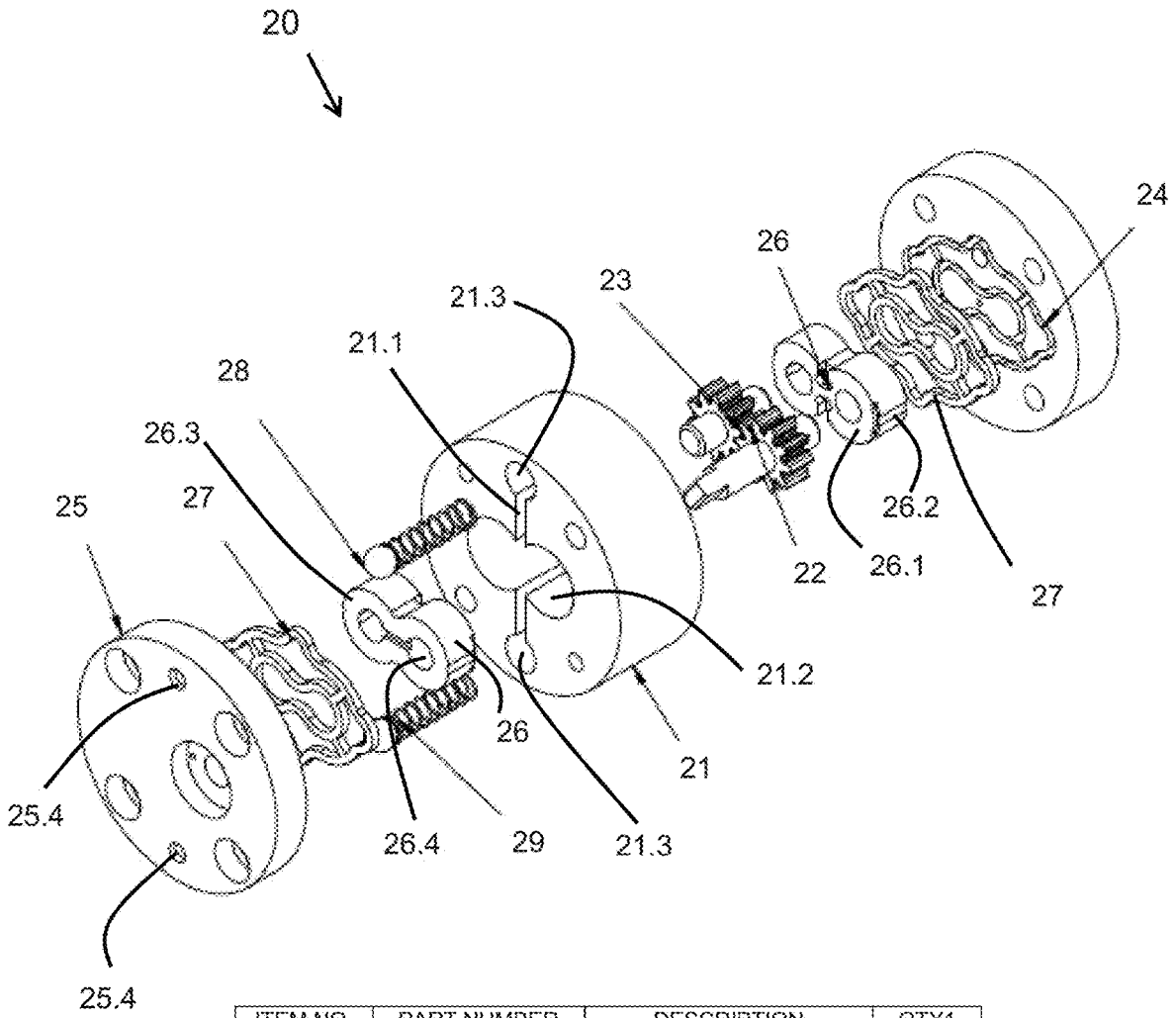
FIG. 1A is an exploded, perspective line view of a pump according to one embodiment of the present invention.
Figure 1B:
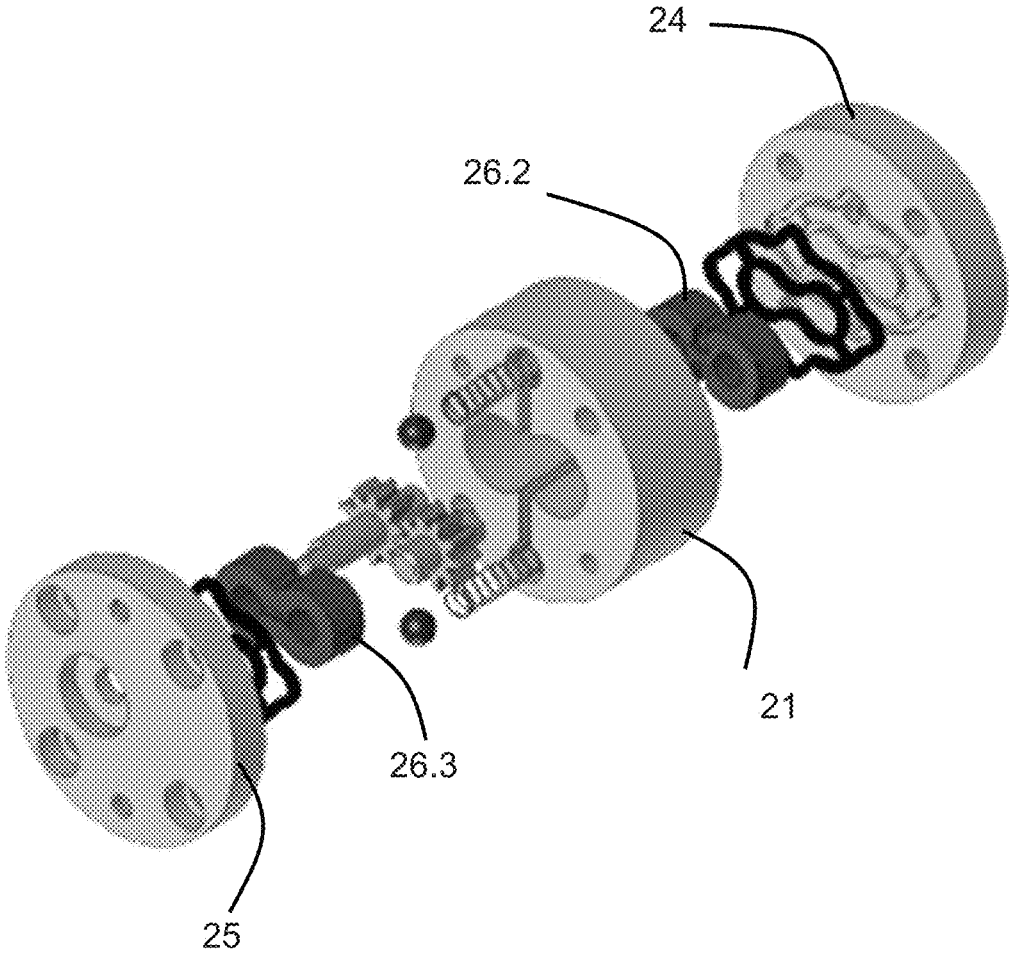
FIG. 1B is an exploded, perspective solid view of the pump of FIG. 1A

The following is a list of element numbers and at least one noun used to describe that element. It is understood that none of the embodiments disclosed herein are limited to these nouns, and these element numbers can further include other words that would be understood by a person of ordinary skill reading and reviewing this disclosure in its entirety

| | |
|---|---|
| 20 | pump |
| 21 | pump housing; casing |
| .1 | flow channel |
| .2 | gear chamber |
| .3 | valve chamber |
| 22 | drive gear |
| .1 | shaft |
| .2 | motor coupling feature |
| 23 | driven gear |
| .1 | shaft |
| 24 | pump bottom cover |
| .1 | inner face |
| .2 | seal groove |
| .3 | fastener hole |
| .4 | delivery or suction |
| .5 | lubrication flow orifice |
| 25 | pump top cover; cover plate |
| .1 | end face |
| .2 | seal groove |
| .3 | fastener hole |
| .4 | delivery or suction; port |
| .5 | lubrication flow orifice |
| .6 | sealing pocket |
| 26 | bearing block; bush |
| .1 | gear face |
| .2 | axial duct; connection Z |

-continued

| | |
|---|---|
| .3 | cover face |
| .4 | plain bearing |
| .5 | input and output channels; delivery/suction groove |
| .6 | lateral flow channel |
| .7 | angular sector channel; peripheral channel; high speed groove |
| .8 | bearing lube channels |
| 27 | seal; gasket |
| 28 | ball check valve |
| 29 | spring check valve |
| 80 | electrohydraulic actuation system |
| 81 | pump 20 |
| 82 | cylinder |
| 83 | electric motor; EM |
| 84 | check valve; CV2 |
| 85 | shuttle valve |
| 86 | relief valve |
| 87 | discharge valve; DV |
| 88 | counterbalance valve; VRA |
| 89 | manual safety valve; CVRA |
| 90 | reservoir; accumulator |
| 91 | pressure transducer |
| 92 | manual safety valve |
| 93 | counterbalance valve |
| 94 | check valve; CV1 |
| 95 | pressure transducer |
| 96 | position transducer |
| 98 | ECU |
| 99 | Software |

ELEMENT NOMENCLATURE

| Acronyms | |
|---|---|
| CVi | $i^{th}$ Control Volume |
| EHA | Electro-Hydraulic Actuator |
| EMAS | Electro Mechanical Actuation System |
| HAS | Hydraulic Actuation System |
| HSG | High Speed Grooves |
| TSV | Tooth Space Volume |
| **Symbols** | |
| b | gap width |
| f | total force acting on the gears or the casing |
| d | width of the gear |
| h | gap height |
| L | gap length |
| $p_i$ | pressure in the $i^{th}$ TSV |
| $R_0$ | Gear external radius |
| $R_b$ | Pitch radius |
| u | all velocity |
| $V_b$ | velocity of the casing |
| $V_t$ | velocity of gear rotation (assuming a stationary casing as the reference) |
| w | deformation vector |
| $\alpha$ | discharge coefficient |
| $\mu$ | viscosity of the fluid |
| $\lambda$ | Lame coefficient |
| $\rho$ | density of the fluid |
| $\vartheta$ | Lame coefficient |
| $\Omega$ | equivalent orifice area |

DESCRIPTION OF THE PREFERRED EMBODIMENT

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. At least one embodiment of the present invention will be described and shown, and this application may show and/or describe other embodiments of the present invention. It is understood that any reference to "the invention" is a reference to an embodiment of a family of inventions, with no single embodiment including an apparatus, process, or composition that should be included in all embodiments, unless otherwise stated. Further, although there may be discussion with regards to "advantages" provided by some embodiments of the present invention, it is understood that yet other embodiments may not include those same advantages, or may include yet different advantages. Any advantages described herein are not to be construed as limiting to any of the claims. The usage of words indicating preference, such as "preferably," refers to features and aspects that are present in at least one embodiment, but which are optional for some embodiments.

The use of an N-series prefix for an element number (NXX.XX) refers to an element that is the same as the non-prefixed element (XX.XX), except as shown and described. As an example, an element 1020.1 would be the same as element 20.1, except for those different features of element 1020.1 shown and described. Further, common elements and common features of related elements may be drawn in the same manner in different figures, and/or use the same symbology in different figures. As such, it is not necessary to describe the features of 1020.1 and 20.1 that are the same, since these common features are apparent to a person of ordinary skill in the related field of technology. Further, it is understood that the features 1020.1 and 20.1 may be backward compatible, such that a feature (NXX.XX) may include features compatible with other various embodiments (MXX.XX), as would be understood by those of ordinary skill in the art. This description convention also applies to the use of prime (′), double prime (″), and triple prime (‴) suffixed element numbers. Therefore, it is not necessary to describe the features of 20.1, 20.1′, 20.1″, and 20.1‴ that are the same, since these common features are apparent to persons of ordinary skill in the related field of technology.

Although various specific quantities (spatial dimensions, temperatures, pressures, times, force, resistance, current, voltage, concentrations, wavelengths, frequencies, heat transfer coefficients, dimensionless parameters, etc.) may be stated herein, such specific quantities are presented as examples only, and further, unless otherwise explicitly noted, are approximate values, and should be considered as if the word "about" prefaced each quantity. Further, with discussion pertaining to a specific composition of matter, that description is by example only, and does not limit the applicability of other species of that composition, nor does it limit the applicability of other compositions unrelated to the cited composition.

What will be shown and described herein, along with various embodiments of the present invention, is discussion of one or more tests that were performed. It is understood that such examples are by way of example only, and are not to be construed as being limitations on any embodiment of the present invention. Further, it is understood that embodiments of the present invention are not necessarily limited to or described by the mathematical analysis presented herein.

Various references may be made to one or more processes, algorithms, operational methods, or logic, accompanied by a diagram showing such organized in a particular sequence. It is understood that the order of such a sequence is by example only, and is not intended to be limiting on any embodiment of the invention.

Various references may be made to one or more methods of manufacturing. It is understood that these are by way of example only, and various embodiments of the invention can be fabricated in a wide variety of ways, such as by casting, sintering, welding, forging electrodischarge machining, or milling, as examples. Further, various other embodiment may be fabricated by any of the various additive manufacturing methods, some of which are referred to 3-D printing.

Various embodiments of the present invention pertain to a design solution for external gear pumps useful in miniaturized applications. One embodiment pertains to an EHA system to be used for the motion of the first class aircraft seats. However, it is appreciated that the pump features and system features described herein can be used in a variety of applications. Various embodiments can be used to power other EHA systems in mobile or aerospace applications, such as where the performance of the pump, in terms of durability, energy efficiency and noise emissions are key factors. The work presented includes reference to a numerical optimization procedure developed to formulate the best design for the pump. The procedure is based on the numerical tool HYGESim (HYdraulic GEar machines Simulator), developed to evaluate specific objective functions representative of internal pressure peak, cavitation, volumetric efficiency and fluid borne noise.

Pressure compensation principles are used to stabilize the axes of rotation for both gears (radial compensation) and to reduce the leakages and shear losses at the lateral sides of the gears (axial compensation). These mechanisms are obtained in one embodiment with the introduction of lateral bushes with a sealing system. The optimization procedure was also adapted to perform tolerance sensitivity analyses of different parameters of the grooves machined in the lateral bushes of the unit. It is understood that the various components and features described herein can be produced by a wide variety of manufacturing methods, including machining, casting, and additive manufacturing.

The 0.13 $cm^3$/rev pump described as one embodiment in this work was realized and a prototype was tested to verify the numerical predictions as concerns the steady state performance of the pump. The results in one embodiment show a good agreement between measured data and numerical predictions, showing how the proposed procedure can be used to design miniaturized pumps for EHA systems.

Described herein is an approach to simulate an electro-hydraulic system and design an external spur gear pump used as a flow generator. A simulation tool was utilized to simulate the pump operation. In designing the pump, the simulation model was integrated in a design methodology specifically conceived for the optimization of gear machines. The optimization procedure consider the multi-objective problem of optimizing volumetric efficiency, delivery flow ripple, internal pressure peaks and localized cavitation. Constraints which define the feasible design space of the problem were also taken into consideration so that the gears and the grooves can be physically manufactured and provide smooth operation.

In one embodiment a specific teeth design is provided for a 0.13 cc/rev displacement pump. The design includes high speed grooves or channel X26.7, which provide a better pressurization, along with a new sealing design that allows a better seal. Lubrication has been taken into account by inserting grooves into the bushing bearing, a channel at the bushing back side and holes into the cover plates. FIGS. 1-13 present various views of a pump according to one embodiment of the present invention.

FIG. 1A shows an exploded view of a pump 20 according to one embodiment of the present invention. In one embodiment, pump 20 includes a pair of spur gears 22 and 23 in intermeshing relationship. Gear 22 is driven by an electric motor (not shown), and applies a driving torque to driven gear 23. This gear pair coacts with the other components to provide a positive displacement pump. The gear pair is axially located within the interior chambers 21.2 of housing 21. Pump 20 is adapted and configured to be driven in either direction. Therefore, it will be noted that there is symmetry in several components and features of pump 20.

A fluid is provided from a reservoir (best seen in FIG. 9) to gears 22 and 23 by way of either of a pair of one-way valves, or check valves. Each one-way valve includes a ball 28 that is biased by a spring 29 so as to force the corresponding ball 28 into a sealing pocket 25.6 of top cover 25. The one-way valves are generally housed within either of a pair of valve chambers 21.3 that extend generally through the axial length of housing 21. As will be seen in drawings to follow, rotation of the gear pair in one direction draws in fluid through a port 25.4 from one of the one-way valves into the corresponding valve chamber 21.3 and then to a flow channel 21.1 that delivers the fluid to the inlet of the gear pair. The other of the one-way valves is provided with pressurized fluid in its corresponding valve chamber 21.3, which drives the ball 28 into sealing engagement with a feed orifice 25.4 of cover plate 25.

Arranged on either side of the gear pair is a pair of substantially identical bearing blocks 26. Each bearing block 26 includes a pair of generally parallel, opposing faces. Each bearing block includes a gear face 26.1 that generally faces the gear pair 22 and 23. The opposite face of each bearing block includes a cover face 26.3 that is in generally abutting and sealing engagement with a seal 27 received within a corresponding seal groove of the corresponding cover plate. Bearing blocks 26 each include a substantially cylindrical passageway 26.4 that coacts with a shaft extending from a corresponding gear to form the plain bearing. The cover face 26.3 of each bearing block includes a lateral flow channel 26.6 that provides fluid communication between plain bearing channels 26.4.

The gear face 26.1 of each bearing block includes a pair of substantially identical input or output channels 26.5. As noted earlier with regards to the one-way valves, one channel 26.5 acts as an input to the gear pair and the other channel 26.5 acts as an output channel for gear rotation in one direction, with the input and output functions being switched if the gears rotate in the other direction.

Channels 26.5 provide the function of decreasing peak pressures, reducing cavitation, and also reducing the noise of the pump. In some embodiments, a relatively small quantity of fluid is sucked and delivered by means of these channels. Fluid is pushed away from the teeth during the meshing process. When the teeth create a trapped volume, the channels 26.5 allow the trapped volume to discharge the high pressure fluid, and further to suck in fluid at a low pressure.

Further, each bearing block 26 includes a pair of axial ducts 26.2 that extend in an axial direction on opposing lateral ends of each bearing block between the gear and cover faces. Preferably, axial channel 26.2 includes an angular sector channel 26.7 for receiving pumped fluid. The function of this channel 26.2 is to pressurize the fluid on the opposite side of the bush 26. Channels 26.2 and 26.7 coact to improve the radial balance of the gears to permit a proper motion toward the low pressure port and achieve a proper sealing, through minimal radial gap at tooth tip (in the order of 1 μm) of the tooth space volumes (TSV) of the gears. These channels further assist in pressurizing the tooth space volume (TSV) before they reach the high pressure port. The axial duct 26.2 of bearing block 26 transfers pressure from the tooth-space volume to the cover face 26.3.

Figure 2:
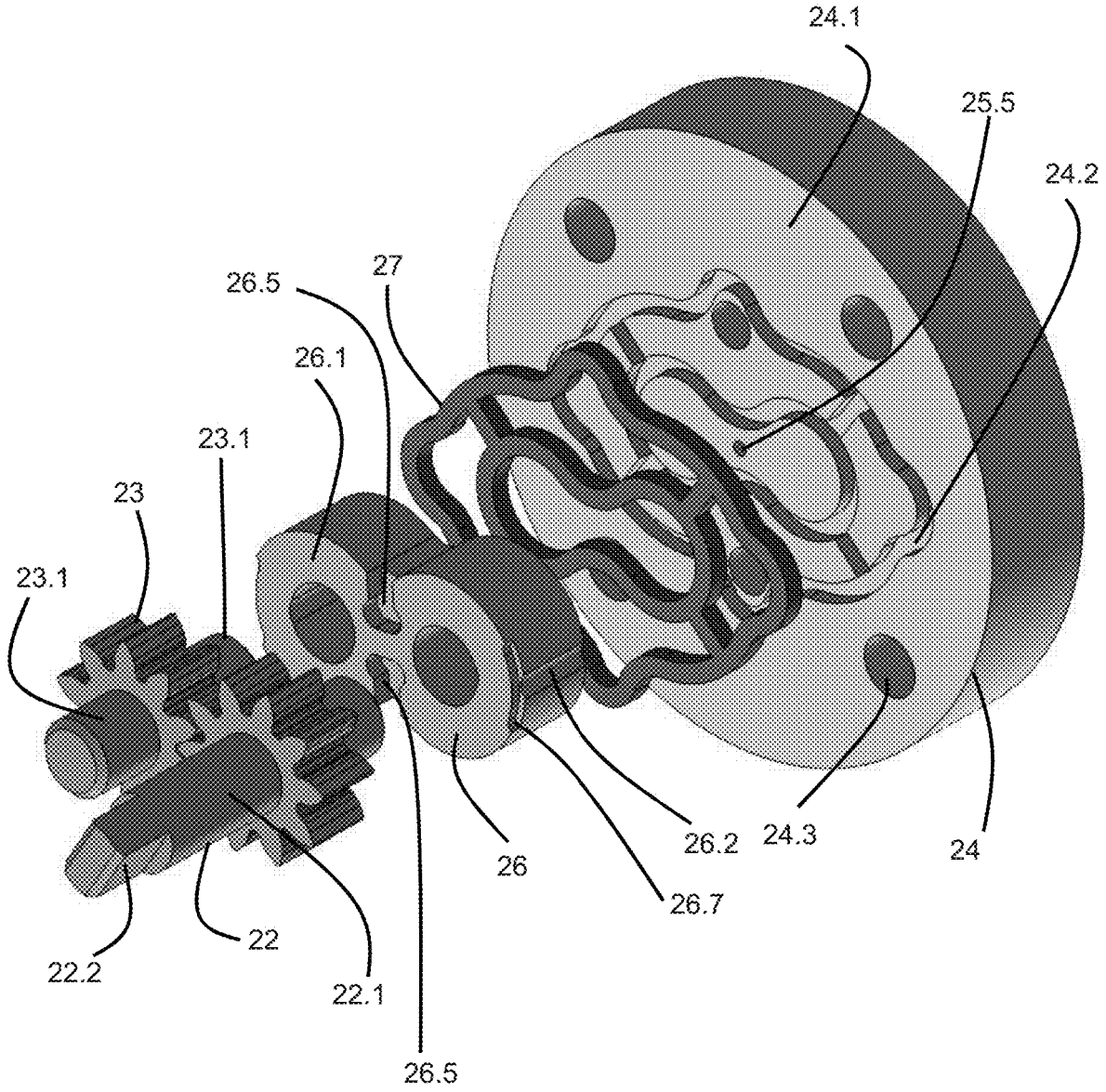
FIG. 2 is an exploded, solid surface CAD representation of a portion of the pump of FIG. 1A.
Figure 3A:
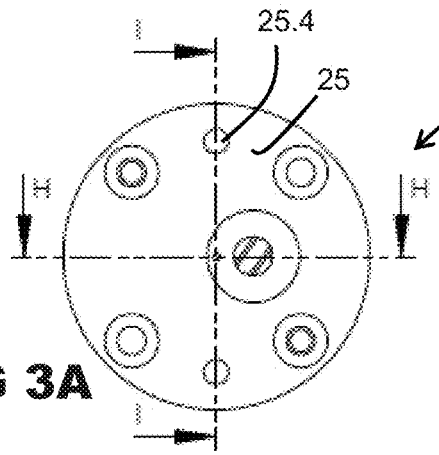
FIG. 3A is an end view of the pump of FIG. 1A.
Figure 3B:
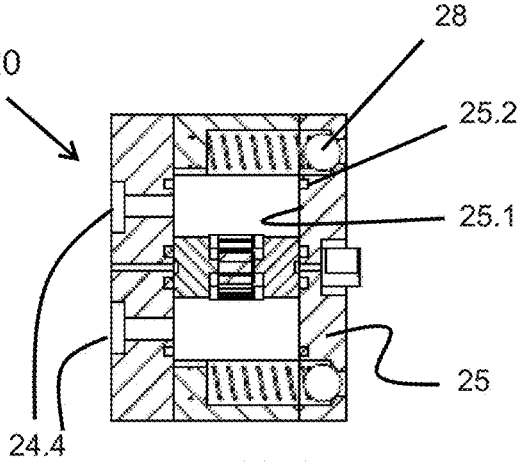
FIGS. 3B and 3C are cross sectional views of the pump of FIG. 1A.
Figure 3C:
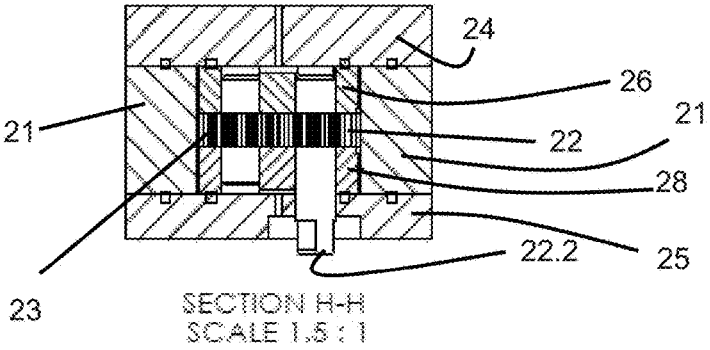

Pump 20 further includes a pair of substantially identical elastomeric seals 27 that discourage flow between various portions of the interface between a bearing block and the corresponding cover. Referring to FIG. 2, it can be seen that a seal 27 is received within a pocket 24.2 on an interior face 24.1 of end cover 24. A similar seal 27 is received within a corresponding groove 25.2 on the interior end face 25.1 of the opposite cover 25.

Seals 27 provide various hydraulically interconnected regions within pump 20. Referring to FIG. 4C, seal 27 subdivides the interface between a bearing block and an end cover into five distinct areas. Area E includes fluid at a low pressure. This volume of the interface is interconnected by means of lubrication flow orifice 24.5 or 25.5 to a reservoir. When the gears rotate in one direction, volumes A, B, and D contain higher pressure fluid, and area C contains lower pressure fluid. When the pump flows in the opposite direction, this correspondence switches, such that lower pressure fluid is contained within volume A, and higher pressure fluid in volumes C, B, and D. Therefore, volume B and D generally contain a higher pressure fluid.

Figure 4A:
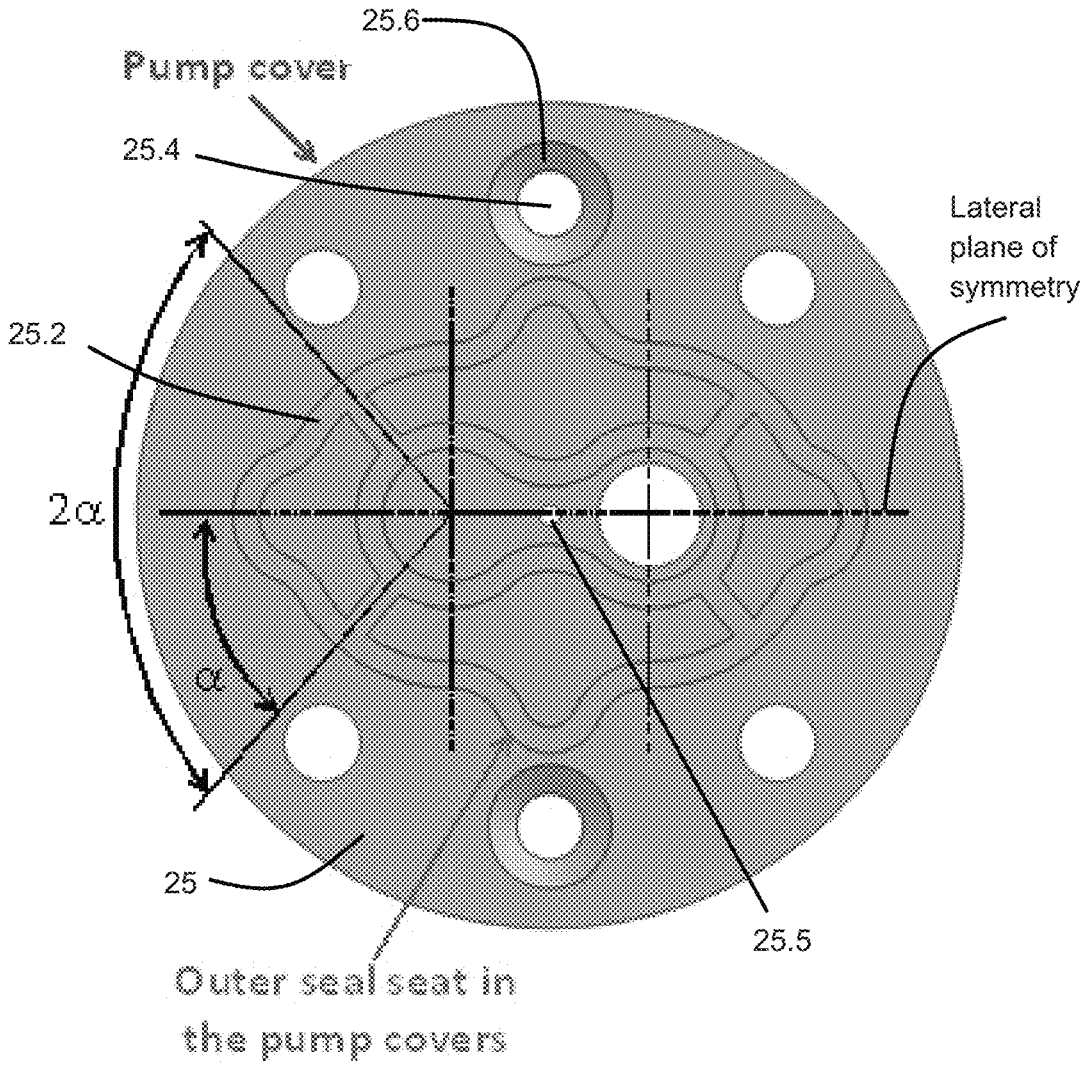
FIG. 4A is an end view of an interface of a pump cover according to one embodiment of the present invention, with a corresponding seal seat.
Figure 4B:
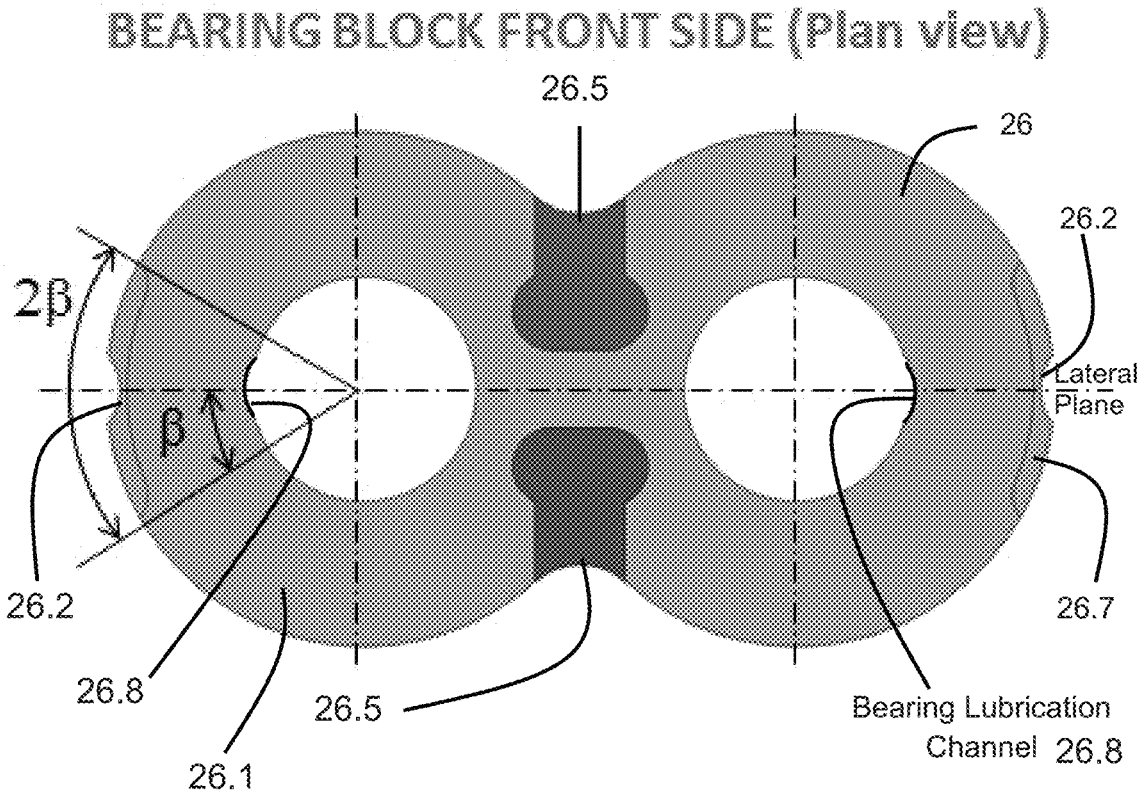
FIG. 4B is an elevational view of the surface of a bearing block from the front side according to one embodiment of the present invention, and showing lubricating channels and high speed grooves.
Figure 4C:
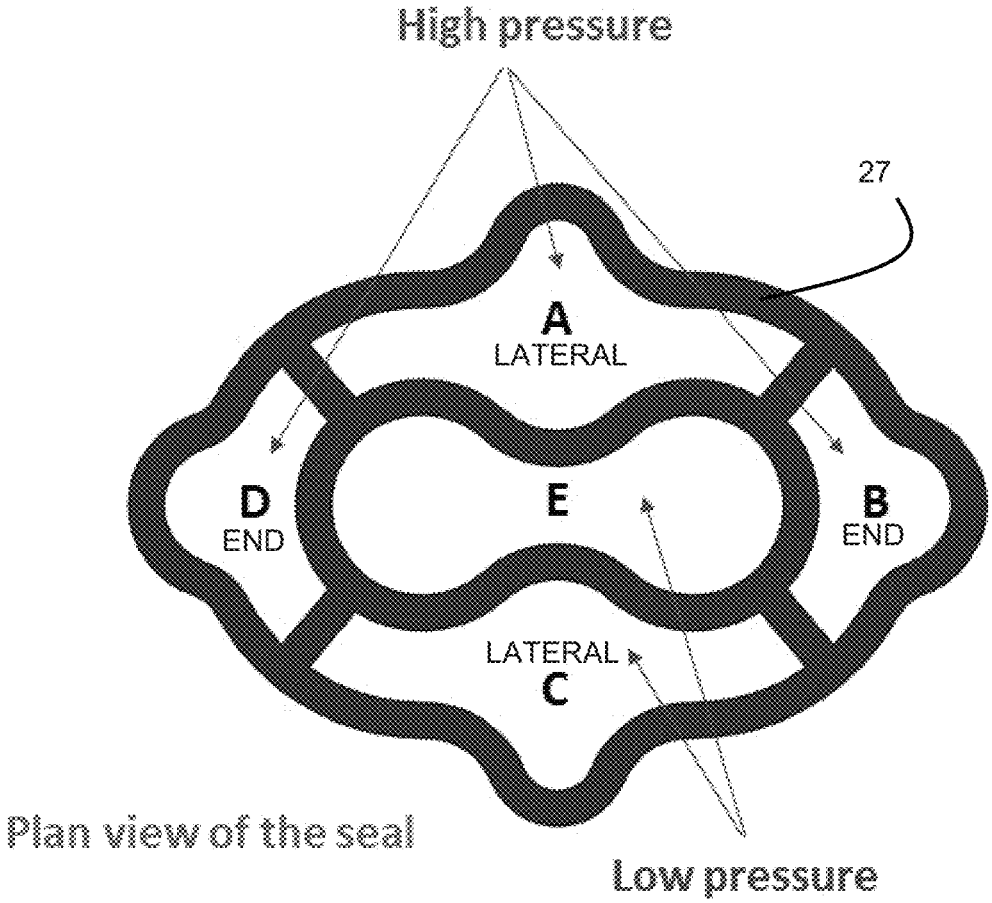
FIG. 4C an elevational view of a seal according to one embodiment of the present invention.
Figure 4F:
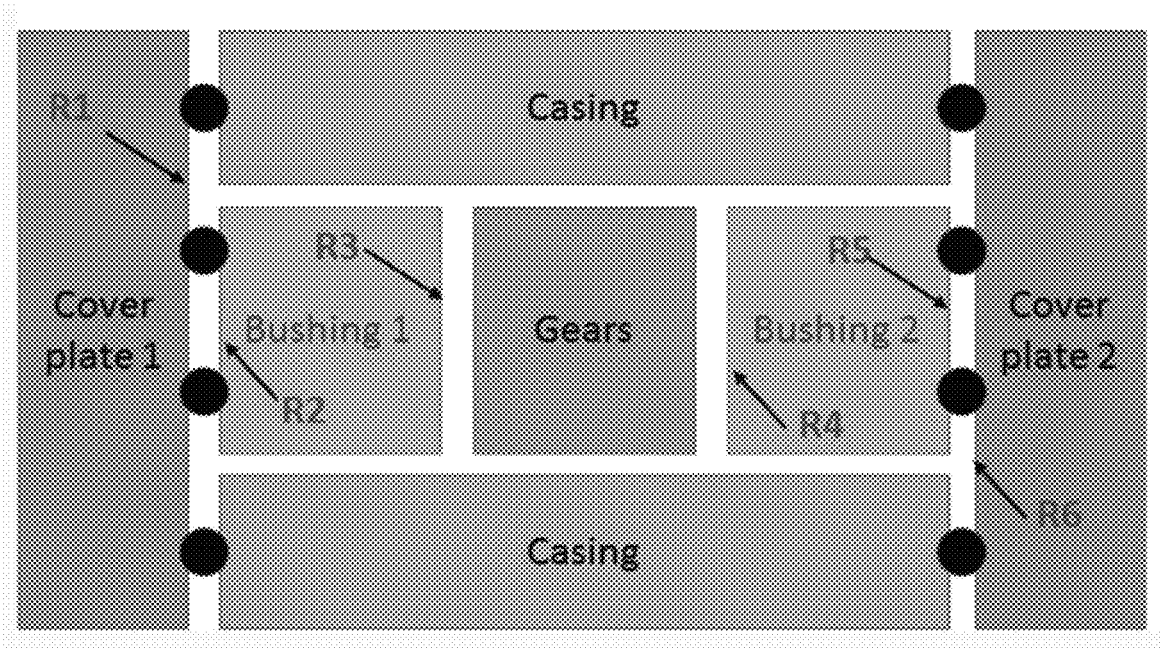
FIG. 4F is a schematic representation of the interfaces between various components of the pump of FIG. 4E
Figure 4D:
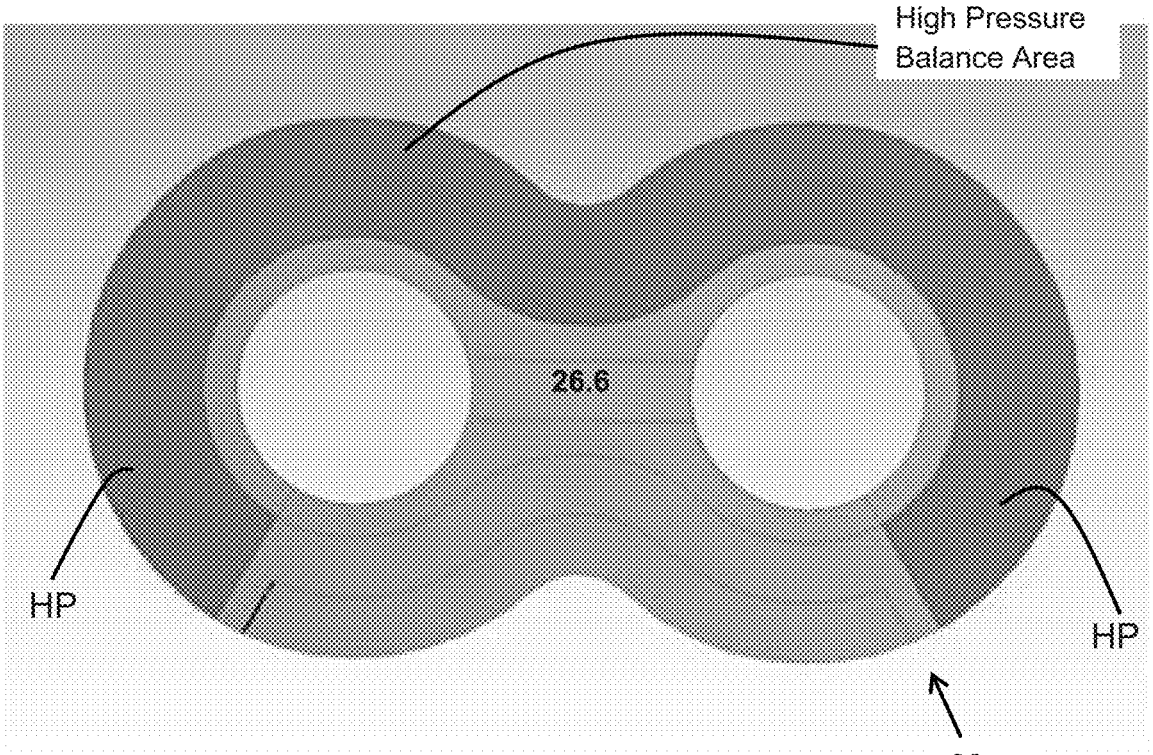
FIG. 4D is a view of one face of a bearing block according to one embodiment of the present invention, with the high pressure balancing area shown wrapping around the top, in two opposing end regions D and B and one lateral region A, with low pressure being predominant in the other lateral region C and also generally in the central region E.
Figure 4E:
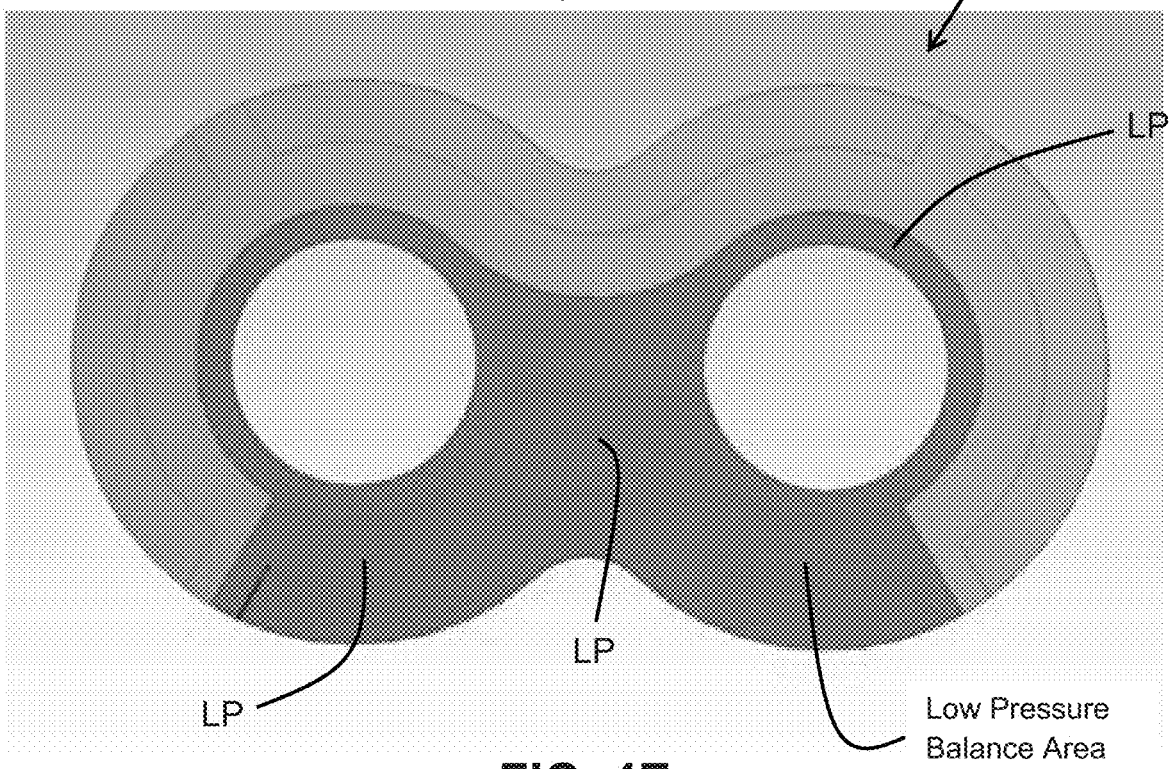
FIG. 4E is an elevational view of the same face of the bearing block of FIG. 4D with the low pressure balance area shown along the bottom of block, and generally between the two bearing journals.
Figure 5:
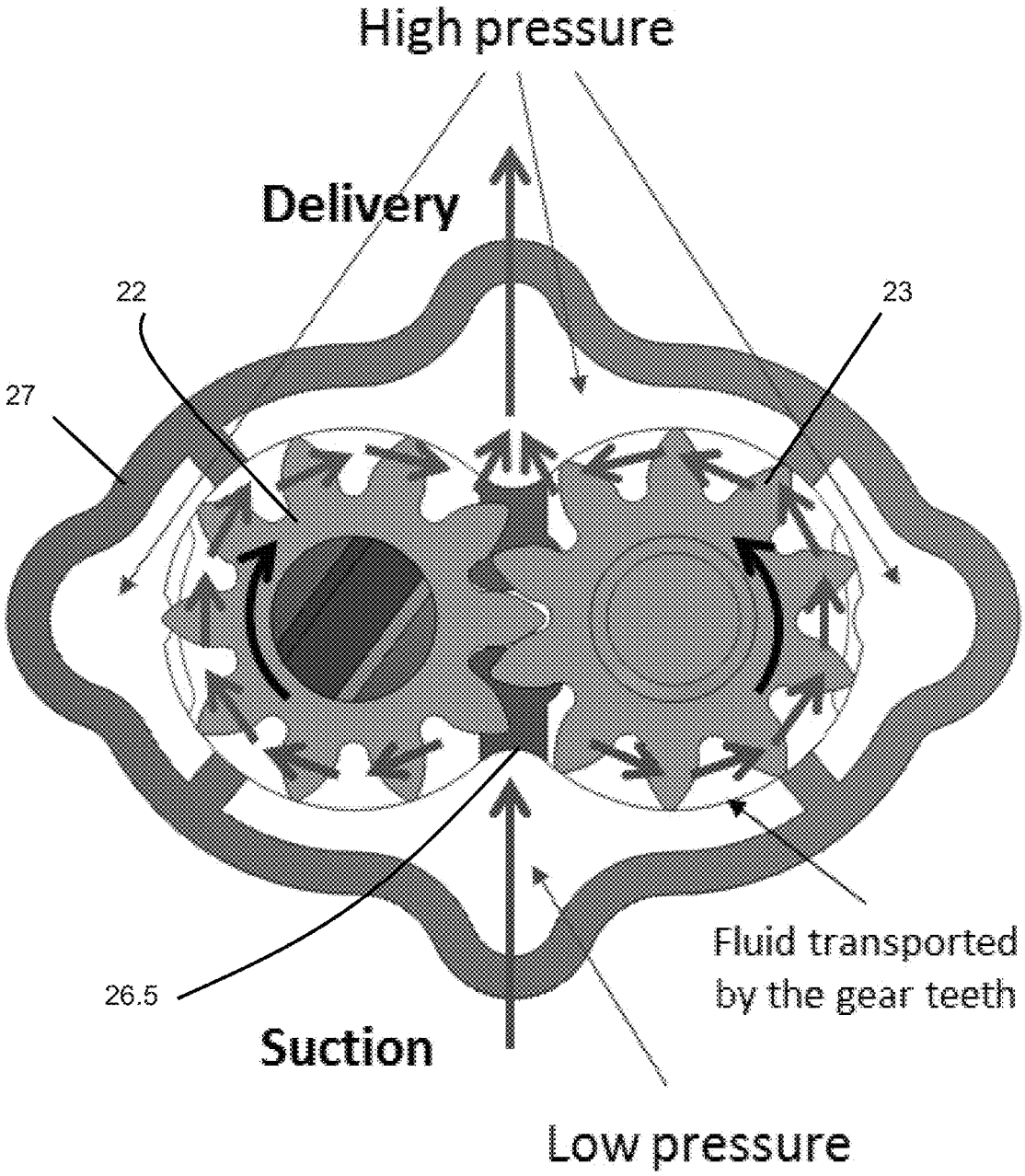
FIG. 5 is a schematic representation of a portion of the pump of FIG. 1A during operation.
Figure 6:
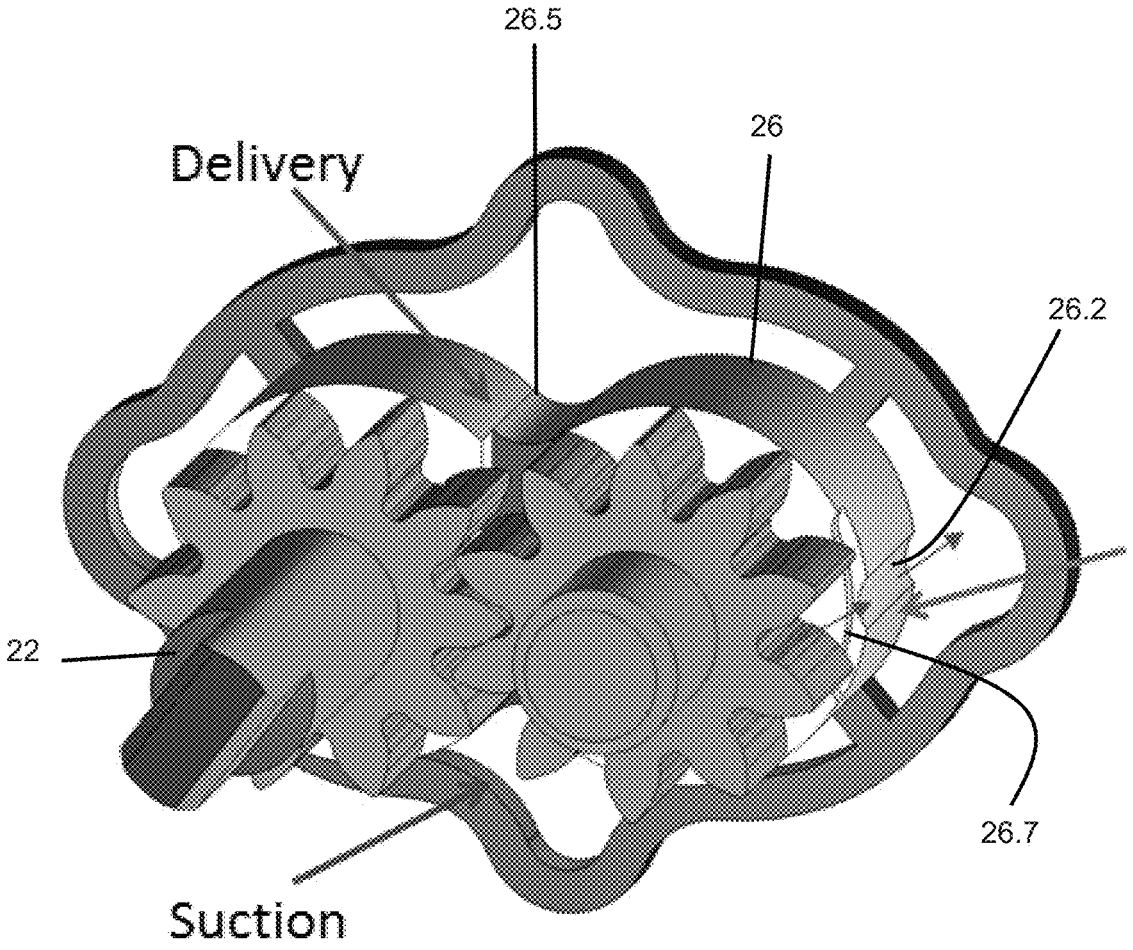
FIG. 6 is a perspective view of a portion of the pump of FIG. 1A, and showing the same components as the view of FIG. 5.
Figure 7:
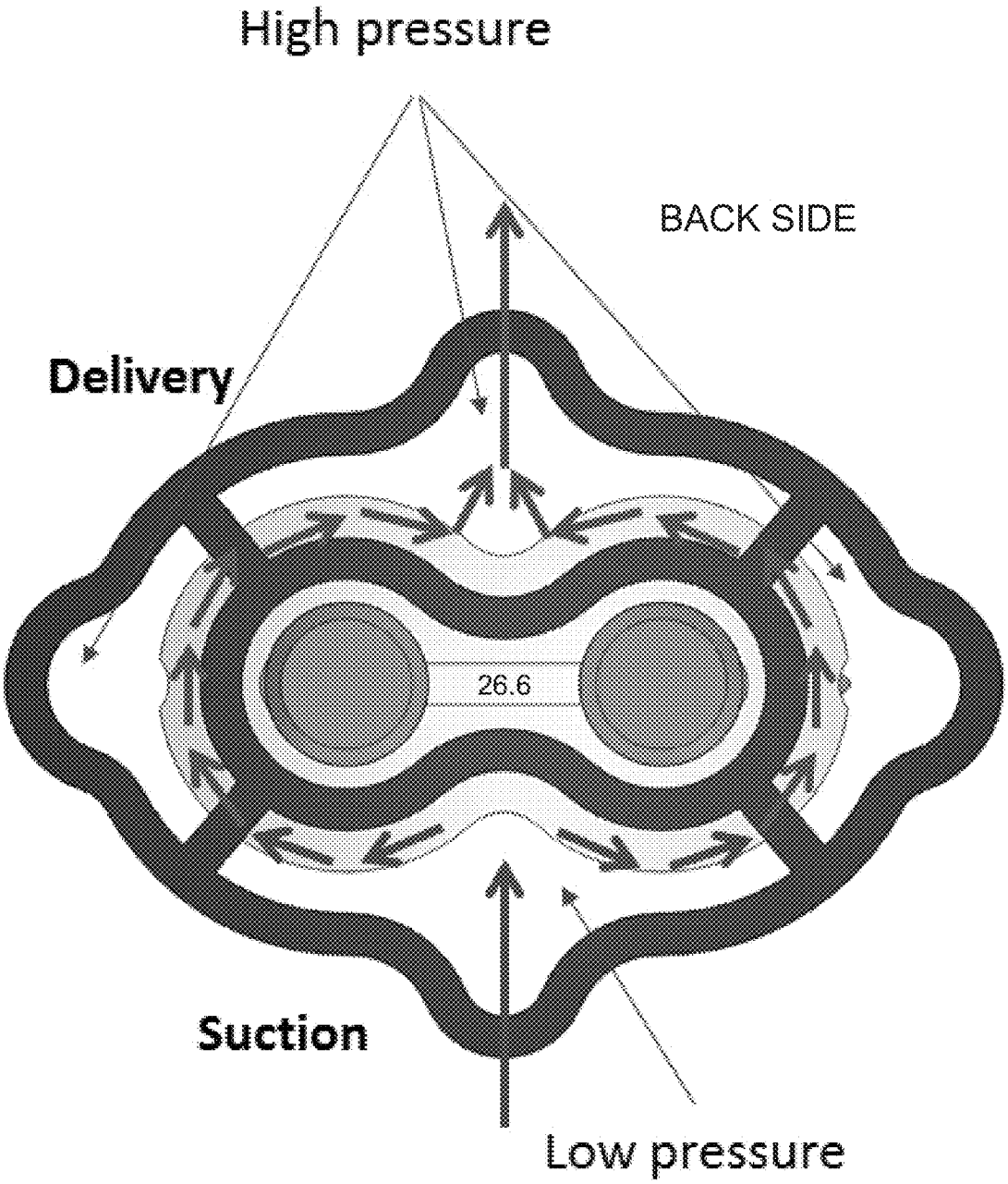
FIG. 7 is a view of the portion of the pump of FIG. 5 as viewed from the opposite side, showing fluid being moved by the gears on the front face of the bearing block.
Figure 8:
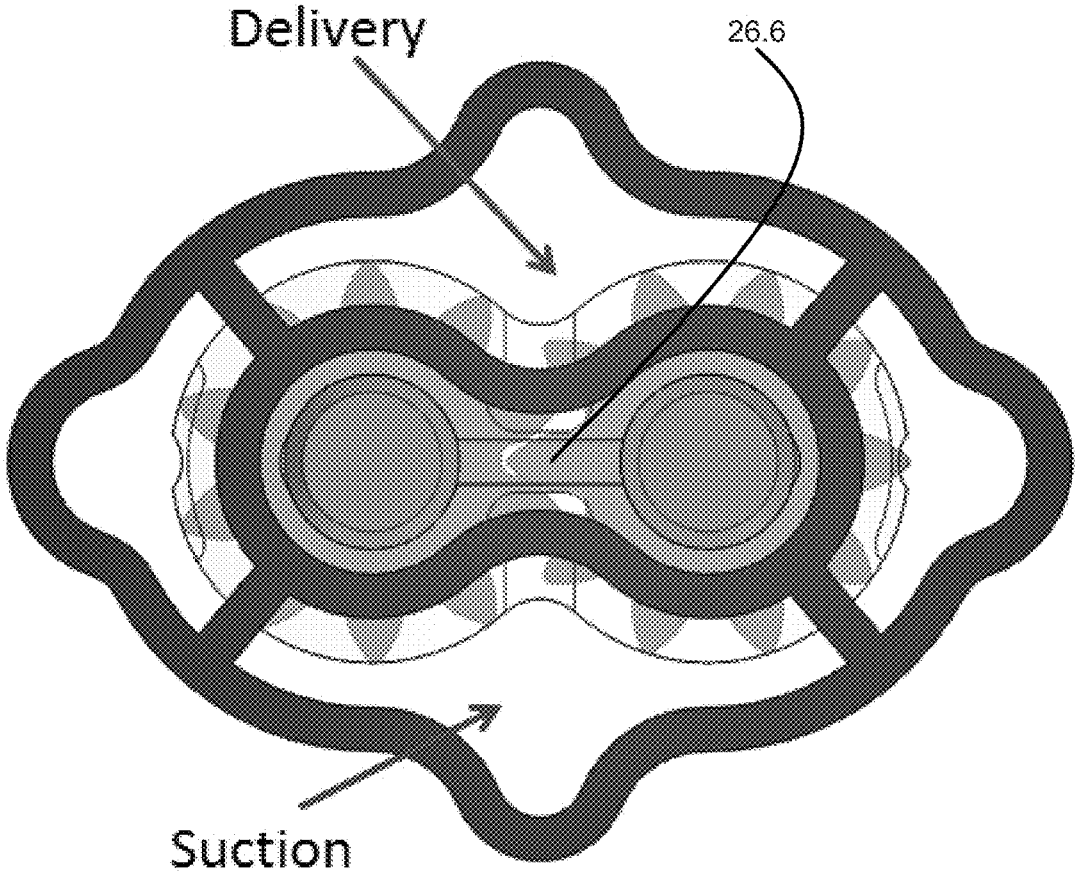
FIG. 8 is a view of the pump of FIG. 6, in end view, and with the bearing block shown as transparent.
Figure 9:
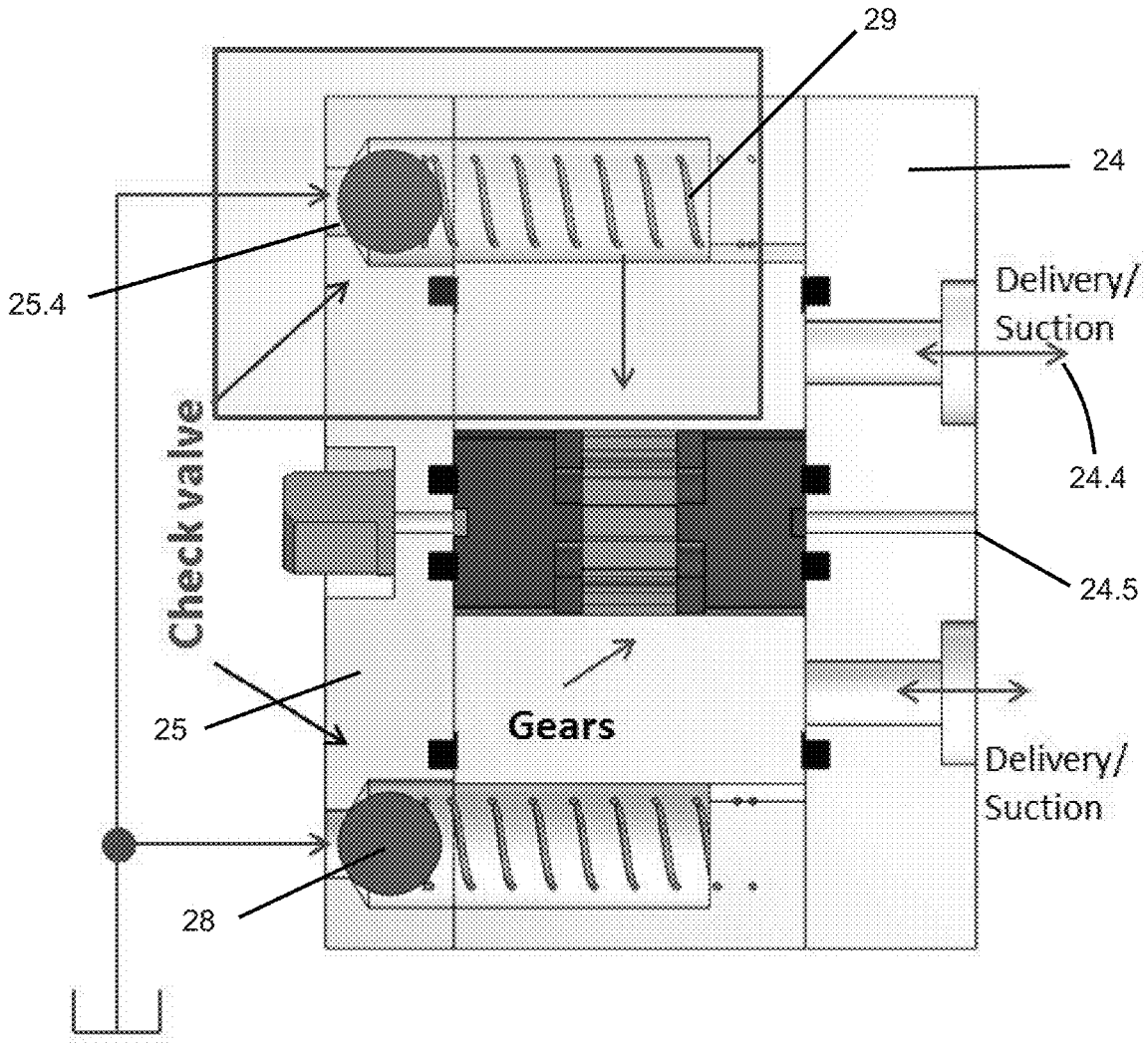
FIG. 9 is a cutaway side view representation of the pump of FIG. 1A, showing the intake of fluid from the reservoir for the rotation of the pump in one direction.
Figure 10:
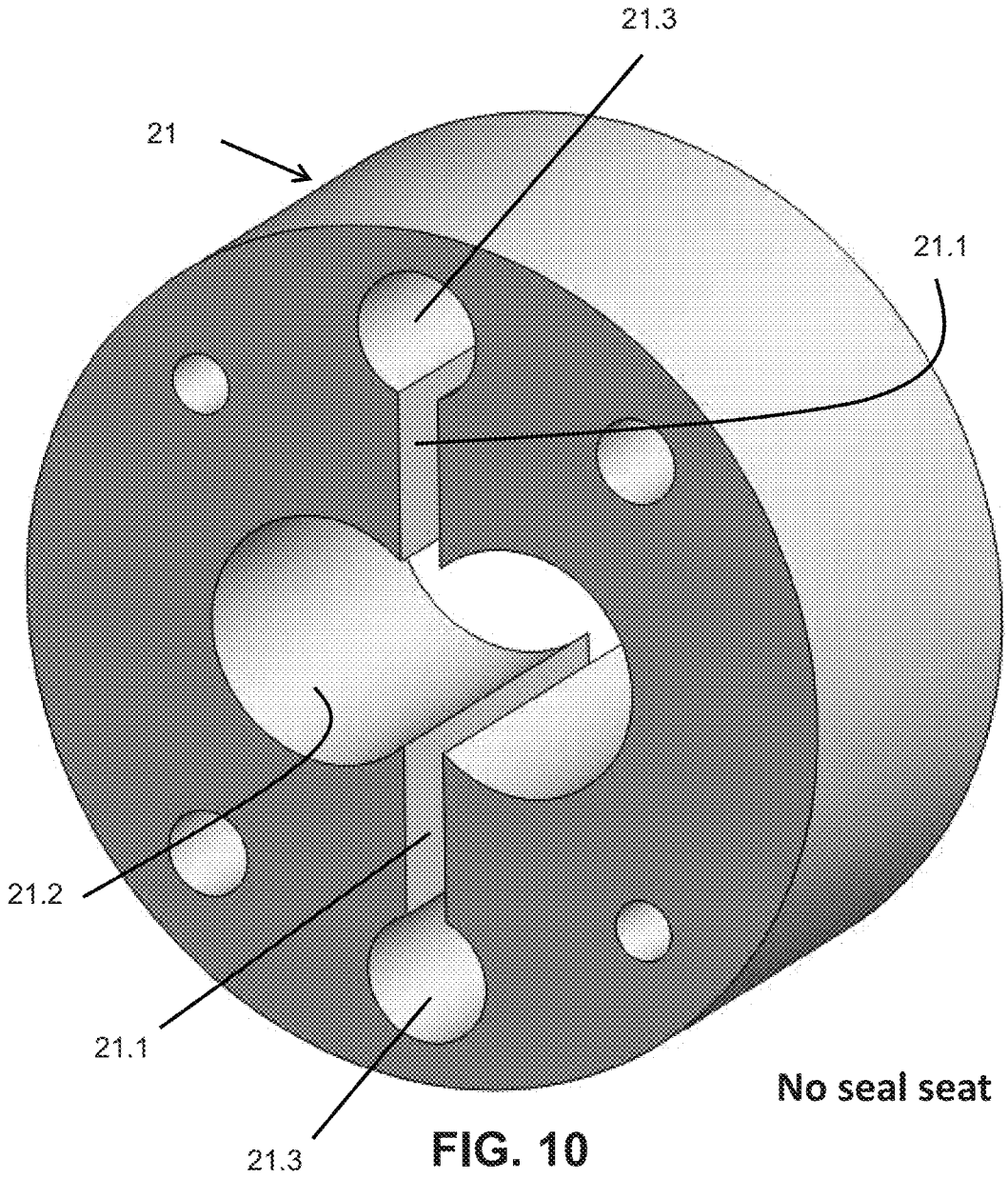
FIG. 10 is a perspective view of a portion of the pump of FIG. 1A.
Figure 11:
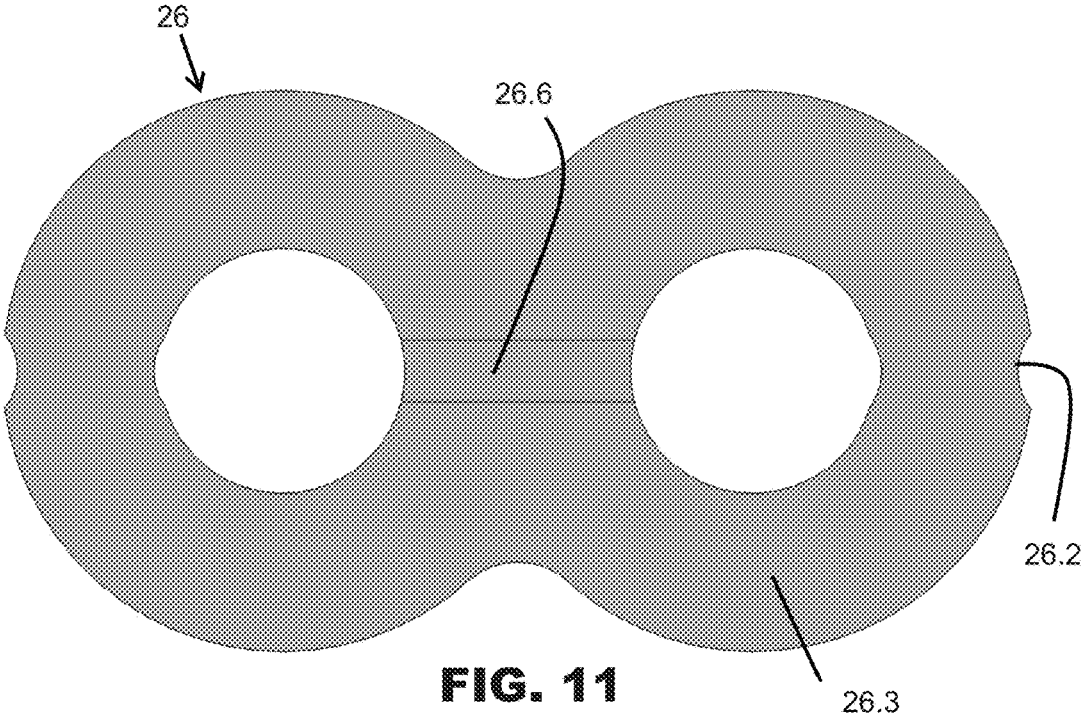
FIG. 11 is an end view of the bearing block of FIG. 1A, from the back side, and including a back lubricating channel.
Figure 12:
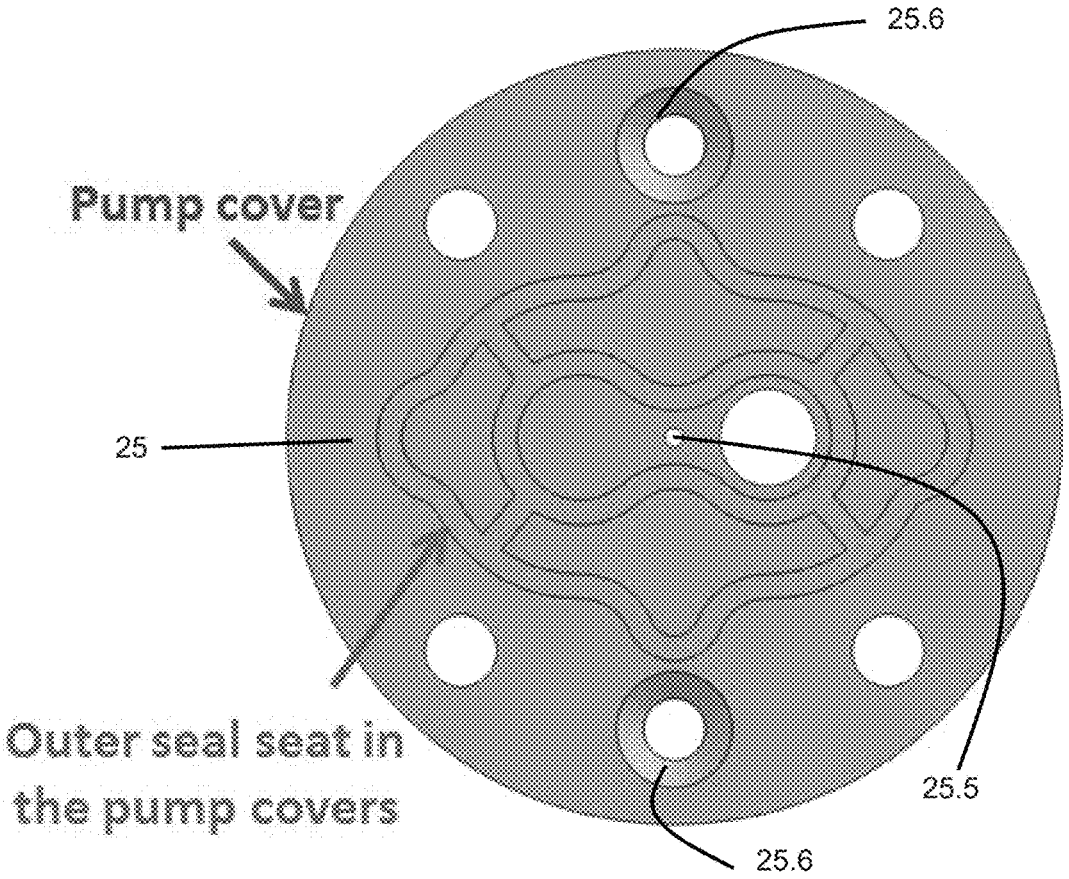
FIG. 12 is an end view of a pump cover of the pump of FIG. 1A.

These different areas serve the purpose of balancing the bearing block, as shown graphically in FIGS. 4D and 4E. Areas are designed in such a way as to create on the bearing block backside the same resultant force that acts on the bearing block front side. This force balance mechanism preferably occurs with no contact or excessive gap heights (the gap being the distance between the bearing block gear face and the corresponding end face of the gears). Since pump 20 is reversible, seal 27 is substantially symmetric about vertical and lateral axes.

In various embodiments of the present invention, the seal 27 is contained within a seal groove located on the pump cover. Various embodiments do not include a seal groove located on the bearing block, and preferably not on either face of the housing 21. By so locating the seal and the corresponding seal groove, it is possible to provide a plain finish surface on the bearing block, which in turn facilitates the miniaturization of the pump. FIGS. 5-8 depict various aspects of the internal operation of pump 20.

Referring to FIGS. 4A and 4B, it can be seen that in one embodiment the sealed higher pressure volumes displaced laterally outward from the gear shafts can be considered as defining an angle alpha, such that one leg of the angle is coincident with an internal leg of seal 27, and the other leg of the angle is coincident with a lateral plane of symmetry that intersects both rotational axes. In various embodiments of the present invention, the preferred range for the angle alpha is from about 20 degrees to about 90 degrees. A more preferable range of this angle is from about 40 degrees to about 80 degrees, and yet a more preferred range for this angle is about 50 degrees to about 75 degrees. Generally, a larger angle leads to improved volumetric efficiency, but with increased mechanical loses. In one embodiment, a preferred range for the angle alpha is about 60 degrees plus or minus 5 degrees.

Bearing block 26 further includes within it an angular sector channel 26.7 having an angular extent of twice the angle Beta, as shown in FIG. 4B. For those embodiments in which the pump is reversible in operation, the angular sector 26.7 is preferably symmetrically arranged about a lateral line of symmetry that intersects both rotational centerlines. The angular extent of sector 26.7 depends on the nature of the sealing between the casing and the gear tip teeth. In some embodiments, Beta extends from about 35 degrees to 55 degrees, and more preferably from about 40 degrees to 50 degrees. Further, it can be seen that the bearing block 26 is substantially symmetrical about a vertical plane.

Figure 55:
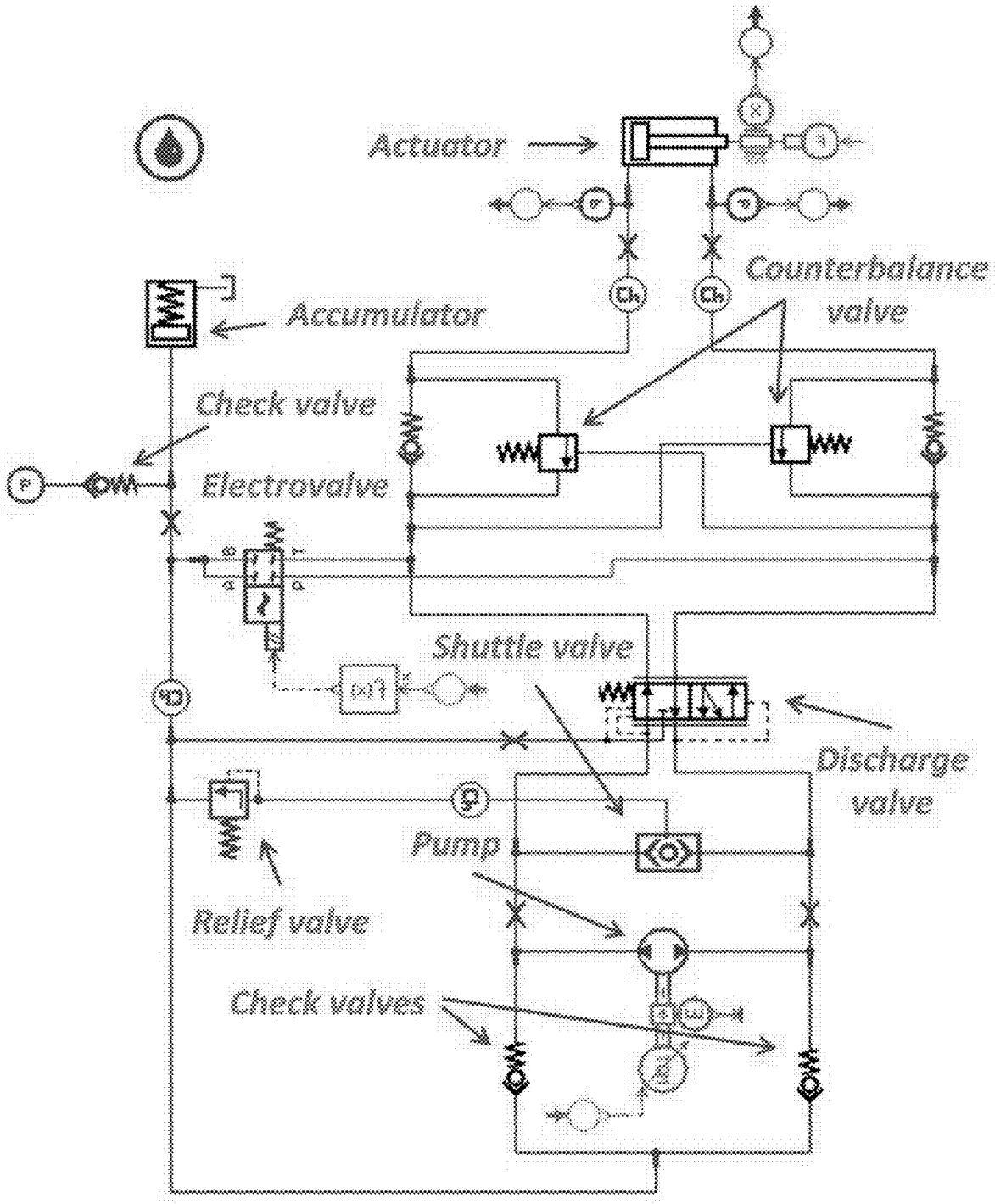
FIG. 55 shows an AMESim model of a system according to another embodiment of the present invention.
Figure 56A:
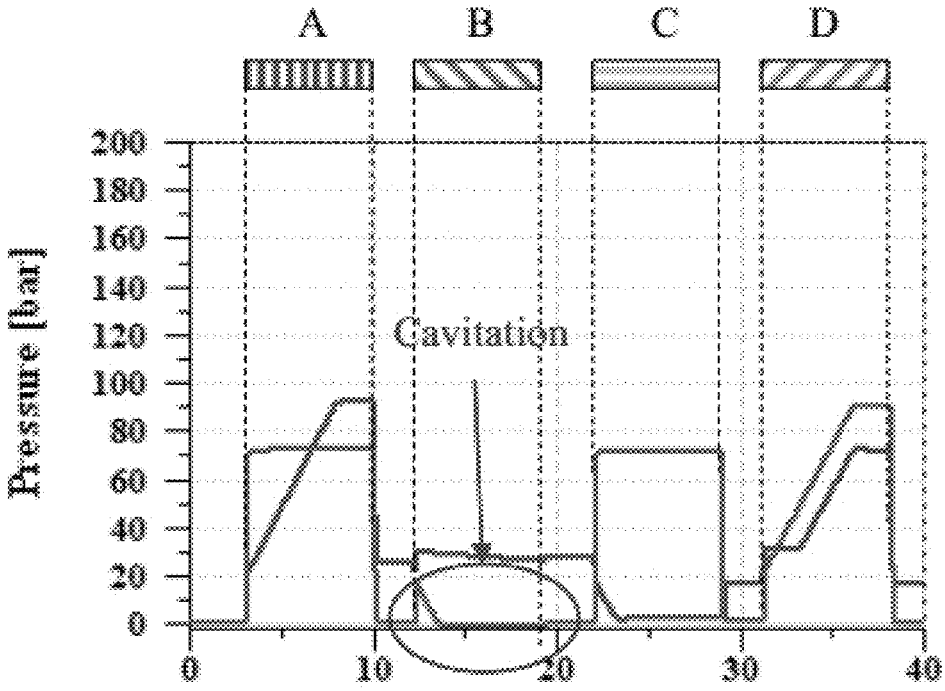
FIG. 56A and FIG. 56B show a bore chamber pressure and actuator speed comparison with (red line) and without (green) counterbalance valve resulting from analysis of actuation systems according to various embodiments of the present invention.
Figure 56B:
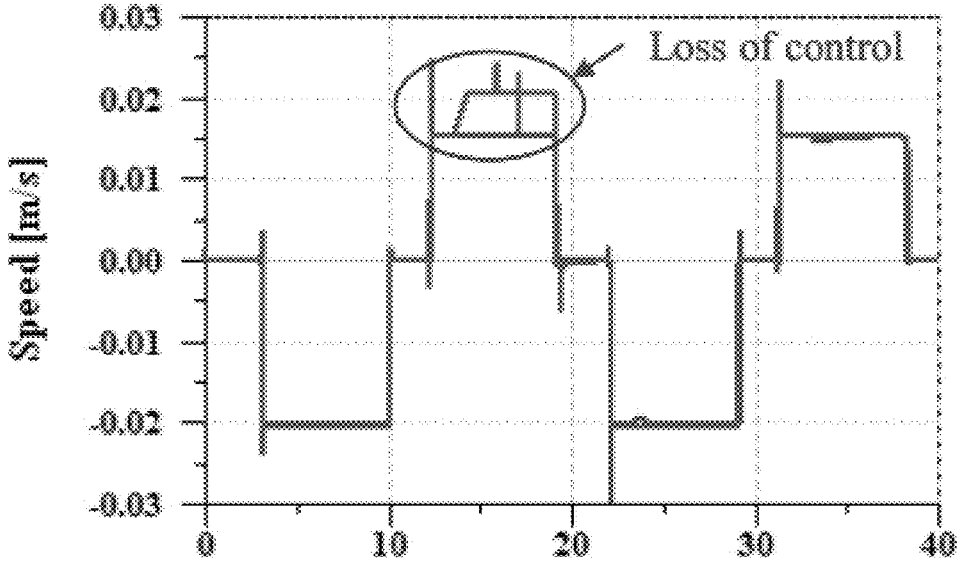
Figure 57:
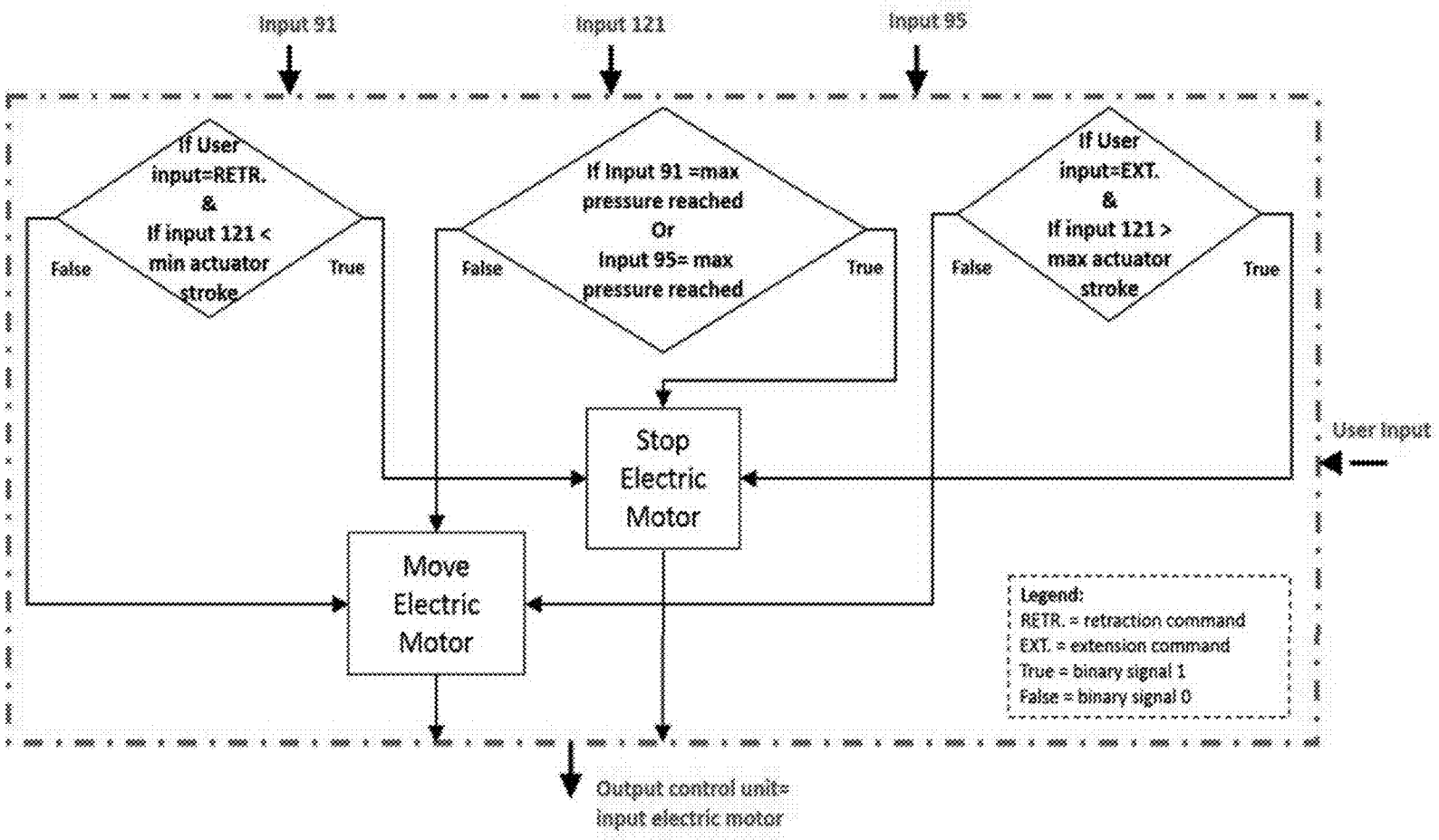
FIG. 57 is a block diagram of the control algorithms implemented in the control unit.
Figure 58:
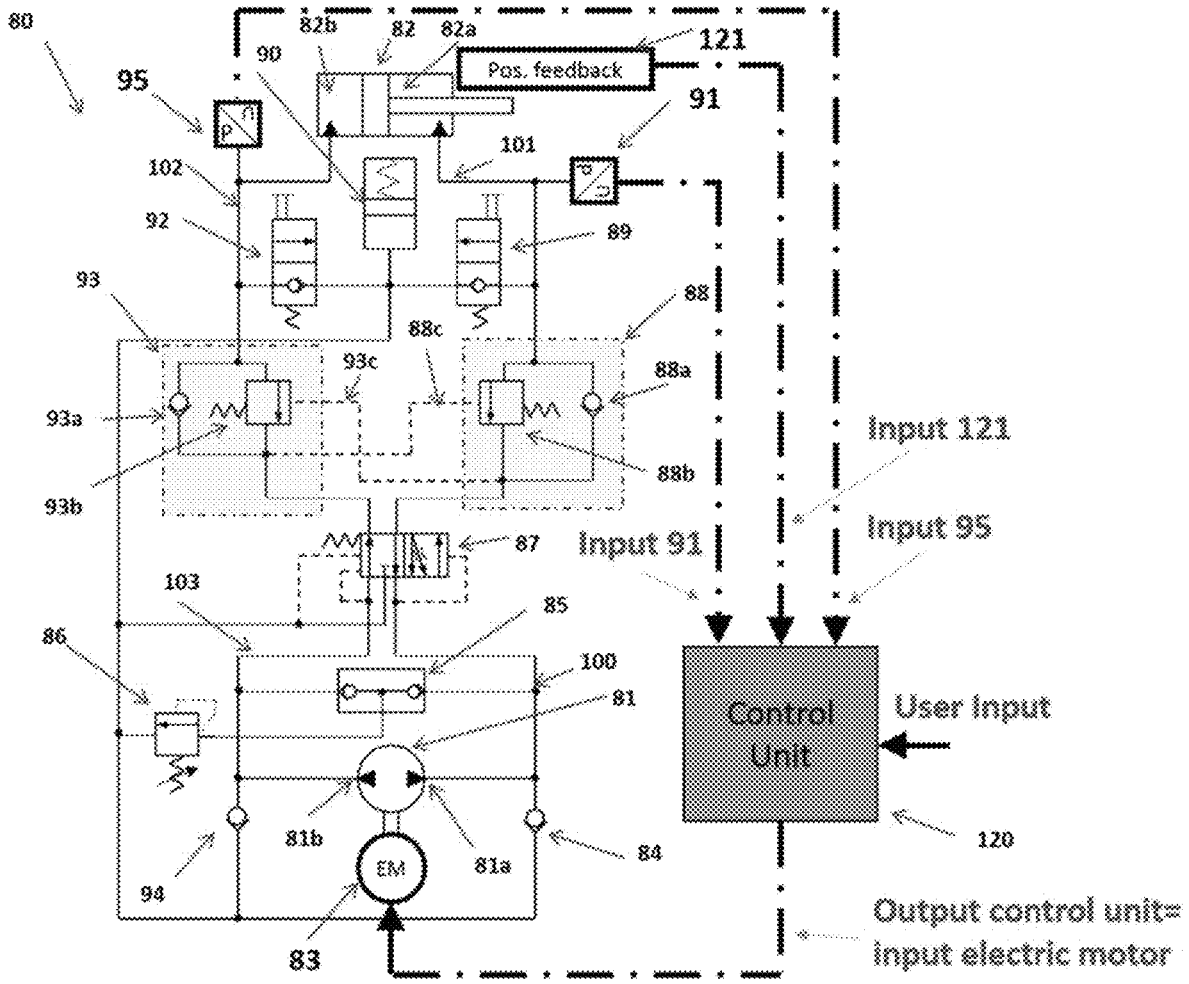
FIG. 58 is an image of the circuit highlighting the control elements.

For some embodiments, a pump model was created utilizing a discrete parameter approach, which permits the analysis of the flow under a characterization of the shape of the teeth profiles, of the recesses 26.5 and 26.7 and of the axial (gear sides) and radial (between tooth tip and housing) gaps. The axial gaps, at gear lateral side, are analyzed by means of a computational fluid dynamic model (CFD) which includes the fluid structure interaction to evaluate the effects of material deformation. The pump model permits the study of the machine, also when it is used in a generic circuit. FIG. 14A shows the circuit used for the numerical study of the pump performance in terms of energy efficiency and noise emission. The pump model in FIG. 14A is represented in detail in FIG. 51, in which the internal connection within the pump are represented (the model is implemented in the commercial software AMESim, using the hydraulic library, the black icon represent C++ models built by the inventors). FIG. 55 shows the simulation model used to characterize the complete system of the EHA actuator of FIG. 13A. This allows a prediction of the flow resulting from the interaction between different systems with a single machine, as well as with machines of different design.

Figure 14A:
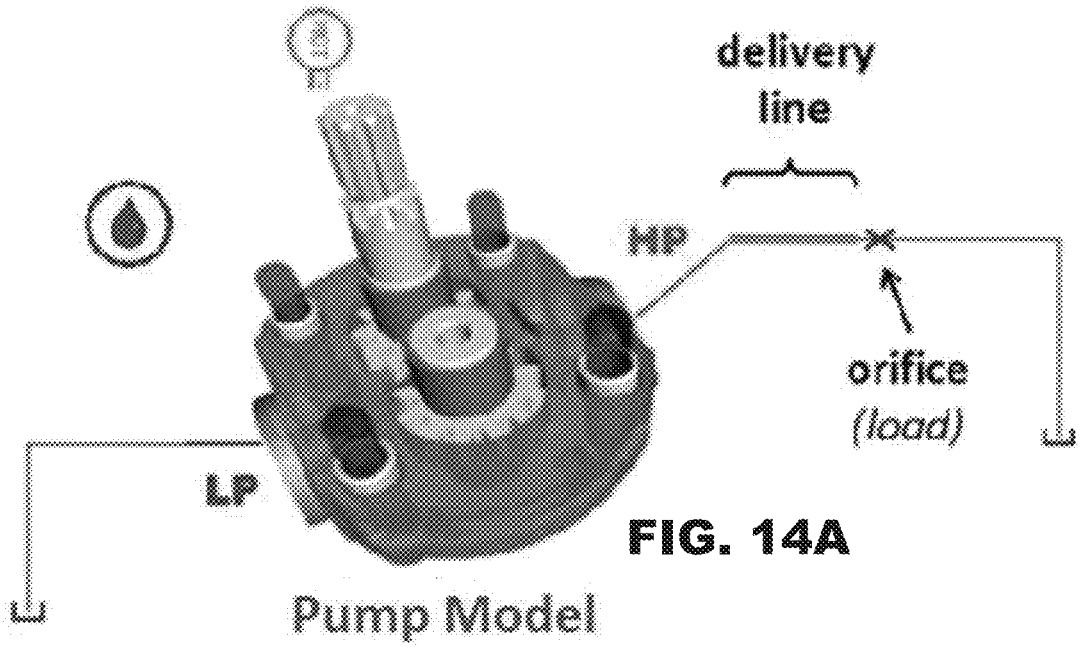
FIG. 14A shows a circuit used for the numerical study of pump performance.
Figure 14B:
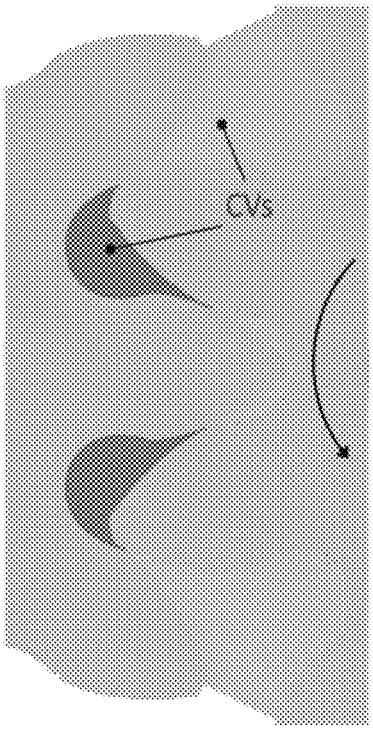
FIG. 14B shows the control volume (CV) for each tooth space.

According to lumped parameter modeling approach, the pump is subdivided in a number of control volumes in which fluid properties are assumed uniform and only time dependent. As shown in FIG. 14B, the model considers a control volume (CV) for each tooth space volume of both gears. Under the hypothesis of same number of teeth on the drive and the slave gears, FIG. 14C, highlights how, as the shaft rotates, the generic tooth space volume V1,*i* of driver gear always meshes with the corresponding V2,*i* of the driven gear. In this way the model is able to characterize the operation of the entire gear pump. The model takes into account the different connections between the TSV and the surroundings as well as the changing of net volume in the meshing zone. The pressure inside the CV as a function of fluid properties, geometric volume variation and the net mass transfer with the adjacent CVs can be given by the equation, $$\frac{dp_i}{dt} = \frac{1}{V_i}\frac{dp}{d\rho}\bigg|_{p=p_i} \cdot \left[\sum \dot{m}_{in,i} - \sum \dot{m}_{out,i} - \rho\bigg|_{\rho=\rho_i}\left(\frac{dV_i}{dt} - \frac{dV_{var,i}}{dt}\right)\right] \quad (1)$$

In eq. (1), the summation terms in [ ] are used to indicate the overall mass flow rates entering and leaving a particular the instantaneous volume of the considered CV. Where pi is the pressure inside a generic TSV, Vi its instantaneous volume, mdot is the mass flow rate entering or leaving the TSV through its connections (leakage or connection realized by the pump channels). In case of a TSV, the displacing action is obtained by means of the variability of this volume. Since the TSV changes over time the derivative of the volume term is in the equation.

Figure 14C:
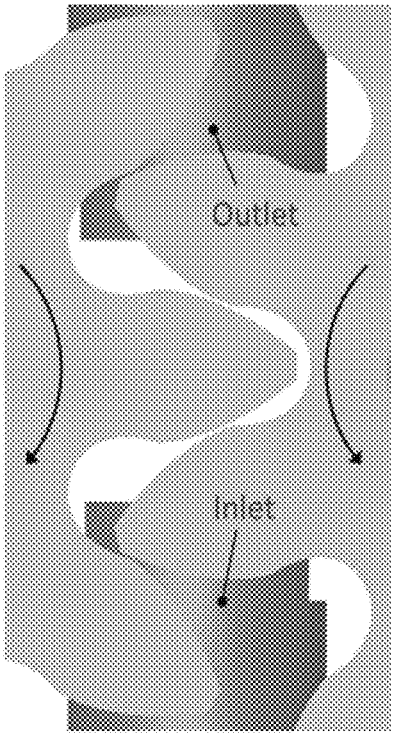
FIG. 14C illustrates the meshing of the driver and driven gears.

The flow areas connecting each TSV are given by the permeable surfaces of the control volume as show in FIGS. 14B and 14C. The actual values of both the flow areas and the volumes are considered depending on the shaft angular position. In this way the pressure inside each CV can be predicted accurately.

Using the flow areas Ω, the flow between control volumes is determined using the turbulent orifice equation shown in the following equation:

$$\dot{m}_{i,j} = \frac{p_i - p_j}{|(p_i - p_j)|}\rho(\overline{p}_{i,j})c_{eq}(\mathrm{Re}_{i,j})\Omega_{i,j}(\vartheta)\sqrt{\frac{2(p_i - p_j)}{\rho(\overline{p}_{i,j})}} \quad (2)$$

For some connections a different approach is used. For leakages in the gap between the tooth tips and the casing the laminar orifice equation is used according to following equation;

$$\frac{dp_i}{dt} = \frac{1}{V_i}\frac{dp}{d\rho}\bigg|_{p=p_i} \cdot \left[\sum \dot{m}_{in,i} - \sum \dot{m}_{out,i} - \rho\bigg|_{\rho=\rho_i}\left(\frac{dV_i}{dt} - \frac{dV_{var,i}}{dt}\right)\right] \quad (3)$$

$$\dot{m}_{i,j} = \rho\left[-\frac{h^3}{12\mu}\frac{p_i - p_j}{L} + \frac{u}{2}\right] \quad (4)$$

Figure 51:
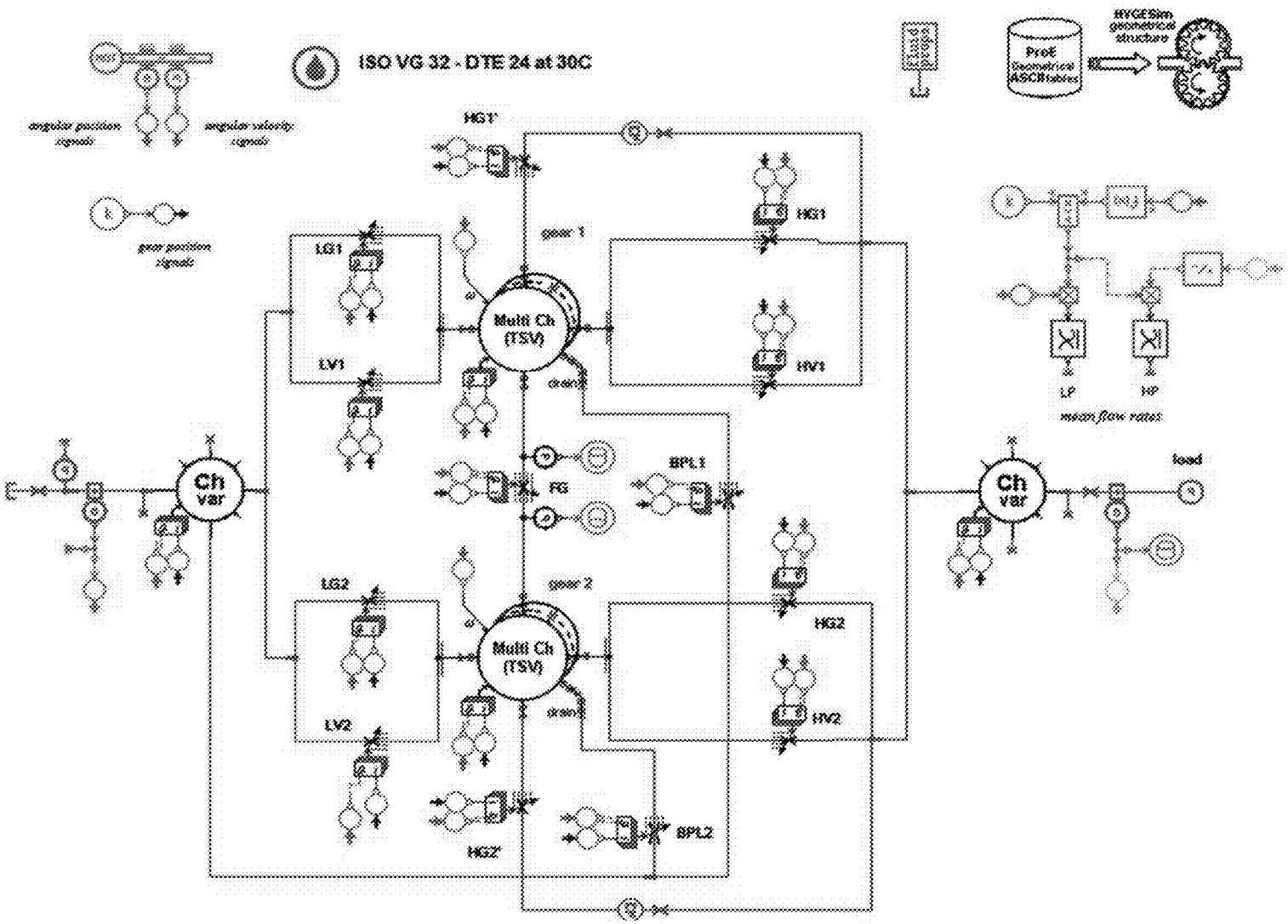
FIG. 51 shows a pump model with HYGESim used for pump design according to another embodiment of the present invention.
Figure 52:
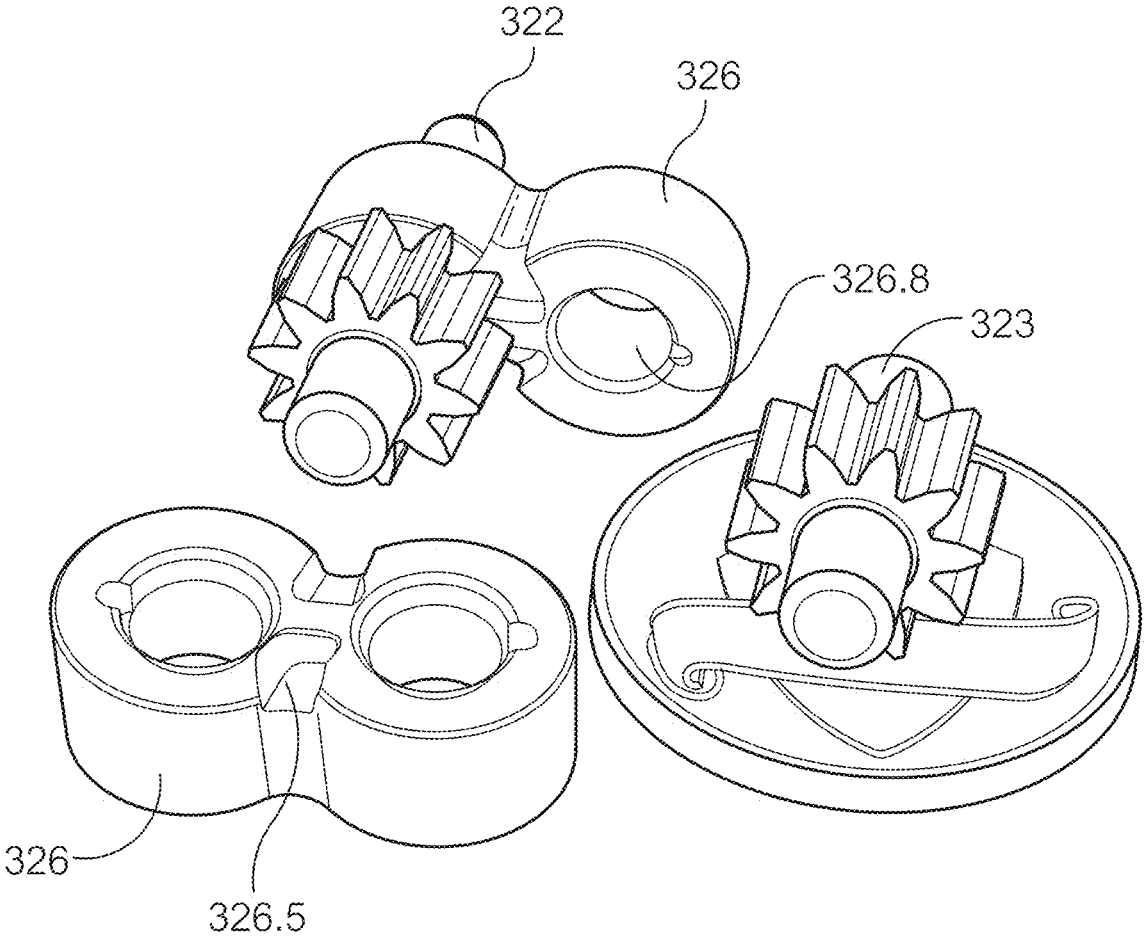
FIG. 52 is a line drawing of a photo of the gears and the bushes according to another embodiment of the present invention.
Figure 53:
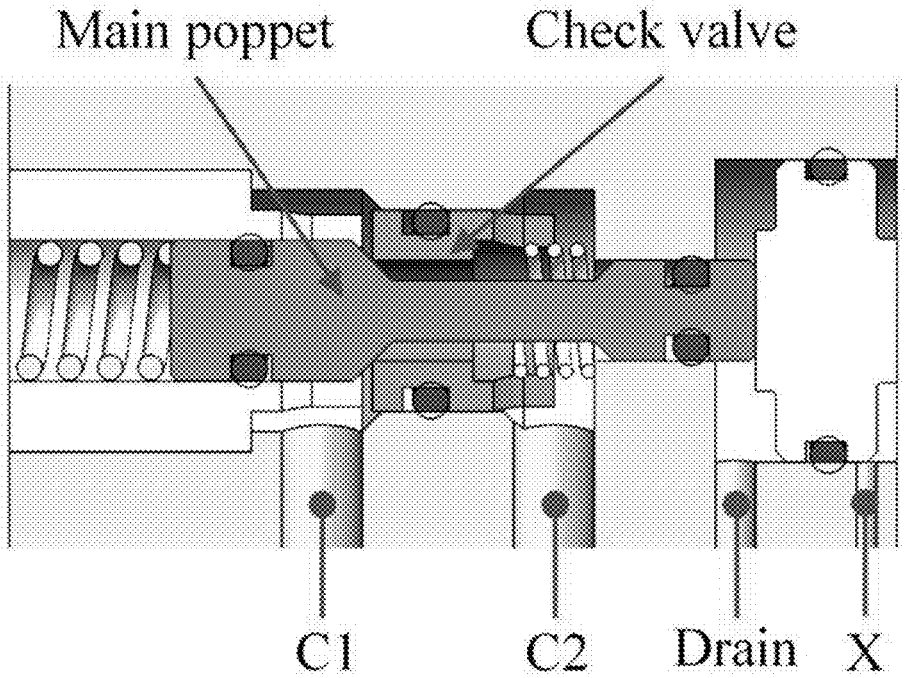
FIG. 53 shows a cross section view of a counterbalance valve according to another embodiment of the present invention.
Figure 54:
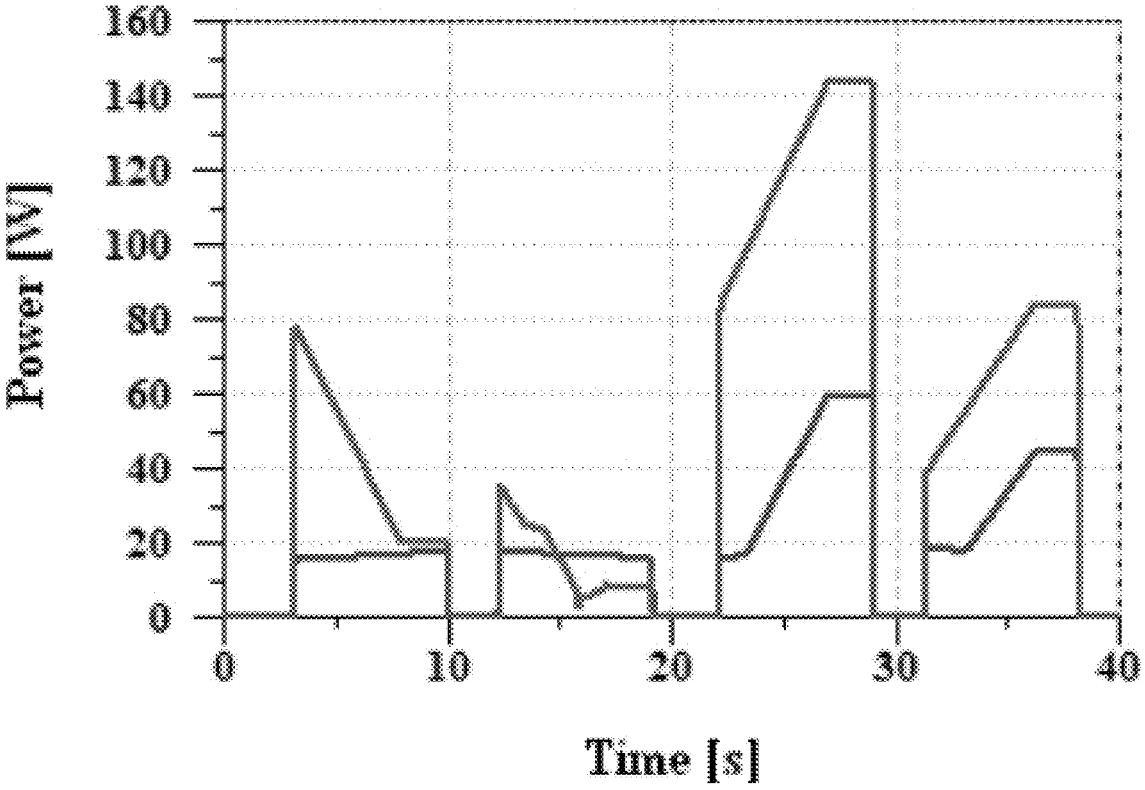
FIG. 54 shows a power consumption comparison with (red line) and without (green) counterbalance valve for systems according to various embodiments of the present invention.

For the leakages in the lateral gap between the gear lateral sides and the lateral plates, a finite volume CFD solver was used for modeling of the flow field in the lateral gaps. This model is based on the Reynolds equation for the solution of the lubricating gap, on a dynamic mesh of the fluid domain of the gap, bounded by the gears and the lateral bushings. The model is represented in FIG. 51. All the hydrodynamic lubrication terms due to physical wedge and squeeze are considered, as well as the micro-deformation of the lateral bushings and gears. The geometry of the lubricating gap is not assumed a priori, but calculated by the force balance model which determines the actual position of the bushings with respect to the gears, on the basis on the equilibrium of all the mechanical and fluid forces acting on the bushings. Past simulation approaches involved an assumption of certain gap height (and/or tilt), and a model that can predict the lubricant film thickness and performance of the lateral gap of a EGM considering elastohydrodynamic effects is novel and used to prepare some of the pump embodiments disclosed herein.

Figure 36:
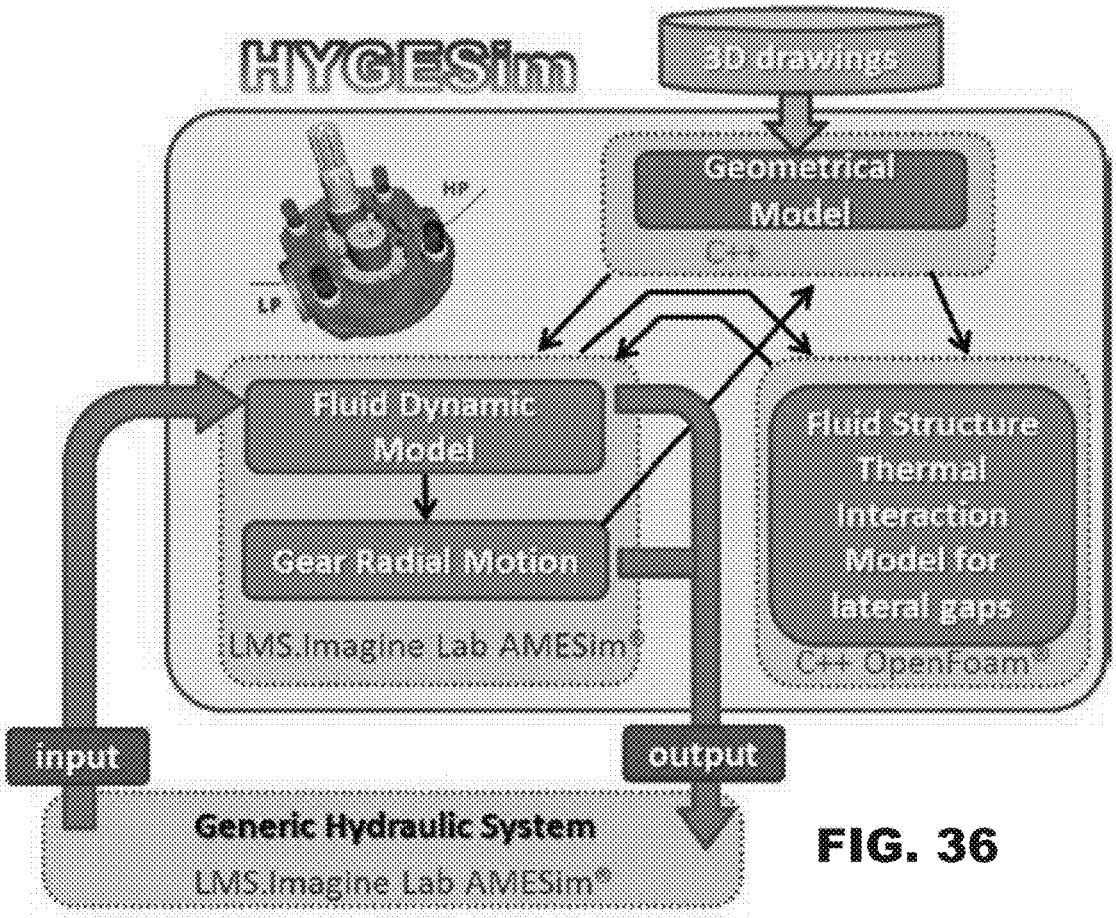
FIG. 36 is a block model of HYGESim.
Figure 37:
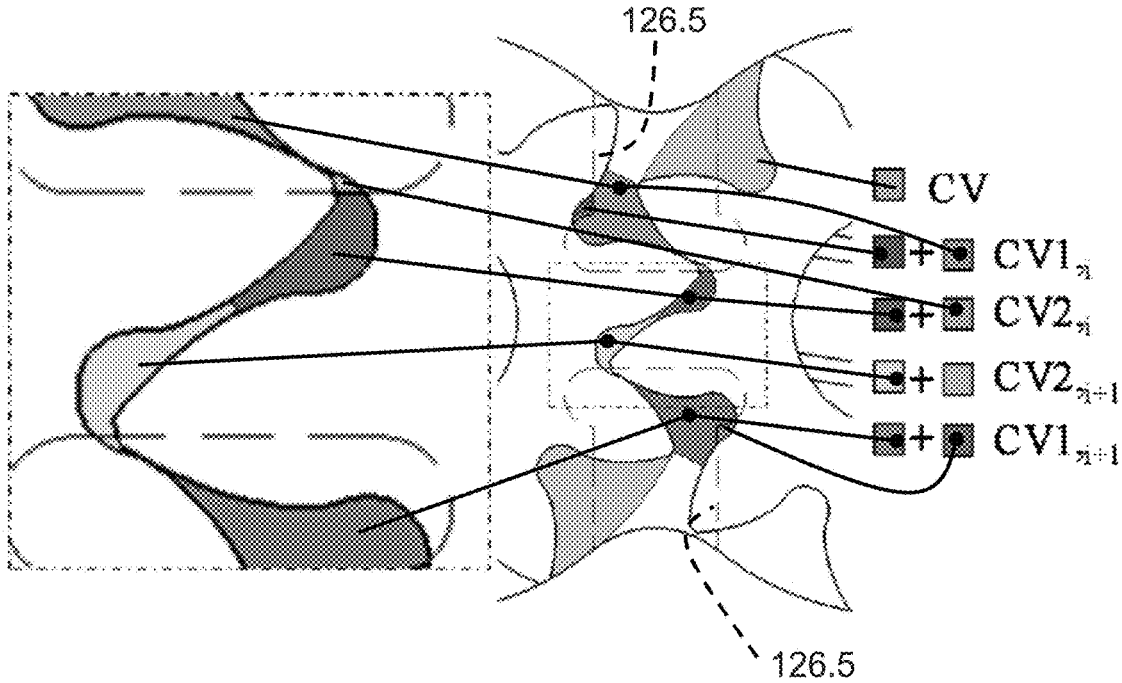
FIG. 37 is a representation of the control volumes defined in HYGESim (detail on the meshing process). The different colors are used to indicate the different areas calculated by the geometrical model necessary to determine the instantaneous volumes and the internal connections between adjacent volumes
Figure 38:
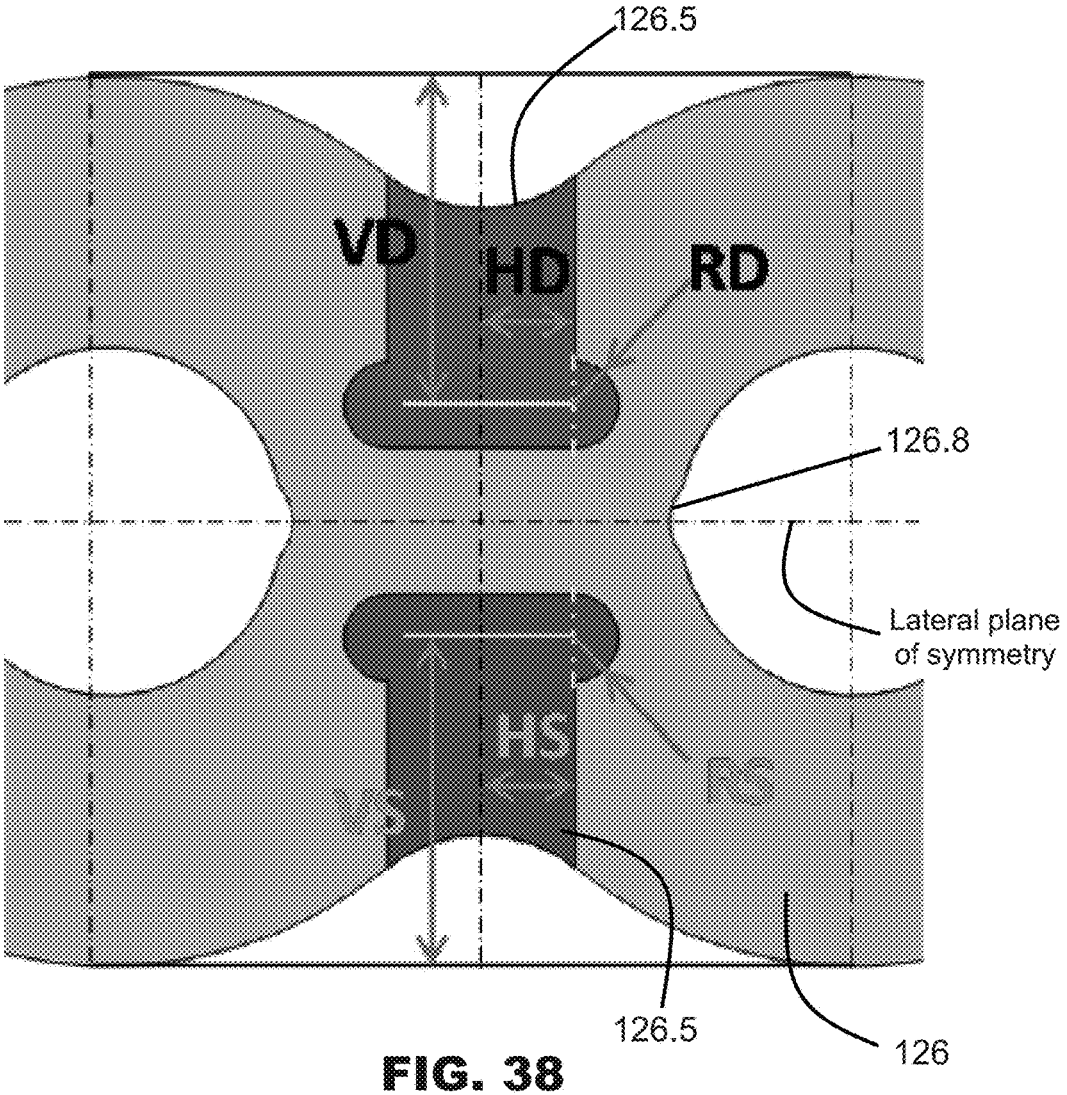
FIG. 38 shows two parameters describing the groove shape according to one embodiment of the present invention.

In FIG. 36, the different modules of pump model are depicted. The geometrical model provides an input file containing the different orifice areas and the TSV's at each angular step of rotation of the gears. It also has the various projected areas for the calculation of forces acting on the gear. The fluid dynamic model evaluates the flow through the machine, the pressure inside the TSV and also the different forces acting on the gear. The CFD model takes care of the evaluation of the various hydrodynamic effects taking place in the lateral gaps of the machine and also for the axial motion of the bushes.

Figure 15A:
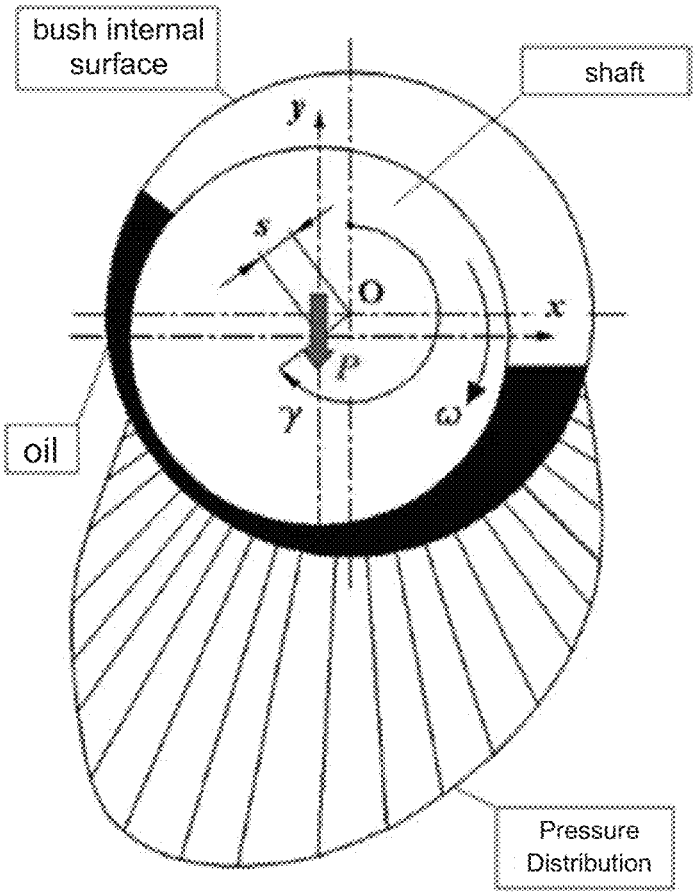
FIG. 15A shows a bearing model.
Figure 15B:
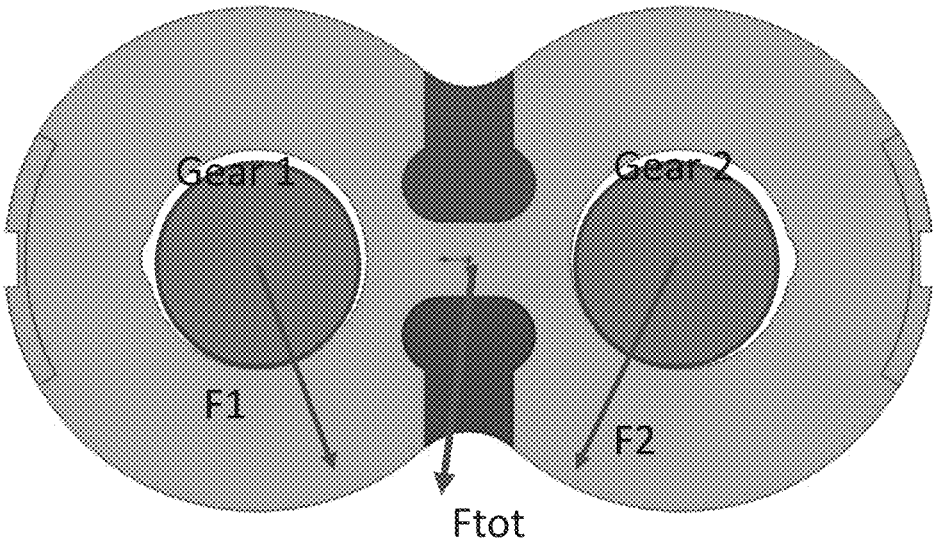
FIG. 15B shows the position of gear shafts inside the bearings.

The bearing model of FIG. 15A determines the position of the gear shaft inside the bearing of FIG. 15B which then determines the position of the gears relative to each other inside the casing. This position signal is used by the F part of the pump model to interpolate between several different geometry files. All features of the fluid dynamic model (fluid areas and volumes) are evaluated according to the actual position of the gears axes of rotation.

Figure 16:
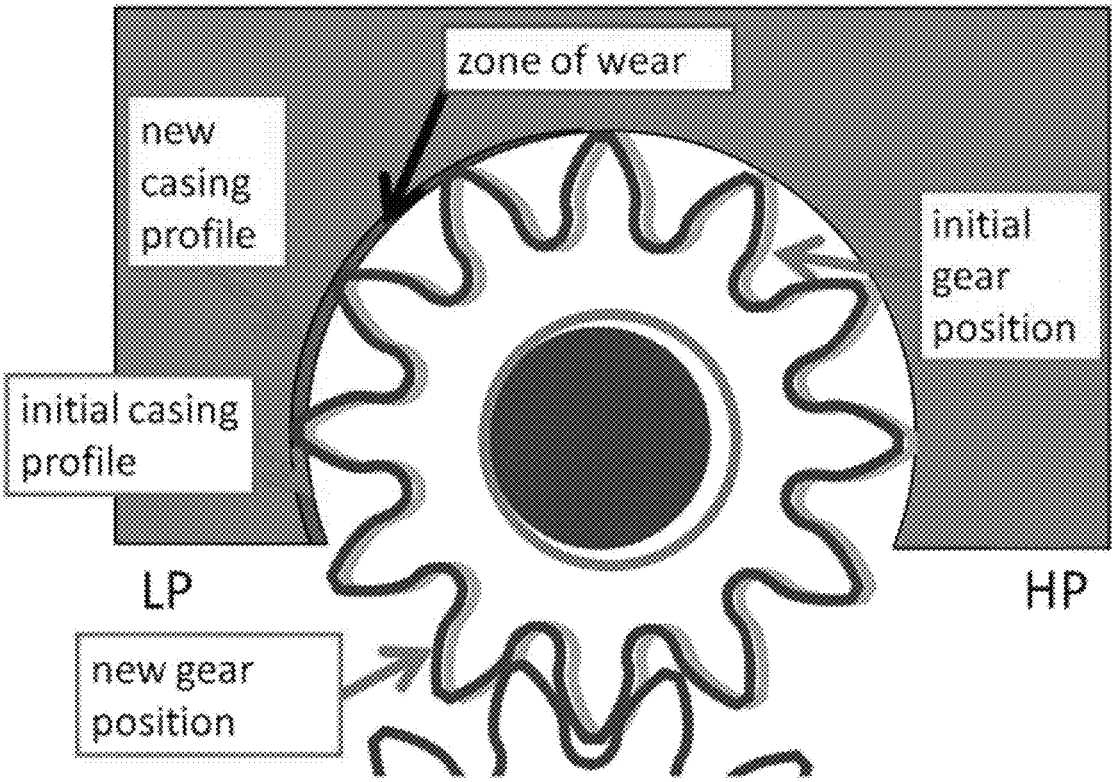
FIG. 16 illustrates casing wear prediction.

Since the position of the gear inside the casing is now known, casing wear can now be predicted. The predicted intersection of a gear tooth tip with the casing is used to generate a new casing file after several revolutions. The new casing file generation method is shown in FIG. 16.

The manufacturing process for the gears such as hobbing is taken into consideration for accurately defining the shape of the gears. The major design variables which define the shape of the particular spur gear profile in one embodiment are summarized in Table 1 below.

TABLE 1

Design variables pertaining to gear profile

| Symbol | Description | Unit | Range min | Range max |
|---|---|---|---|---|
| m | Normal module | mm | 0.5 | 2 |
| z | Number of teeth | — | 8 | 15 |
| $h_{ap}$ | Addendum coefficient | — | 0.50 | 1.47 |
| $h_{fp}$ | Dedendum coefficient | — | 0.50 | 1.47 |
| $\rho_{tp}$ | Fillet radius coefficient | — | 0.17 | 0.60 |
| $\alpha$ | Pressure Angle | ° | 14.0 | 29.0 |

Figure 17:
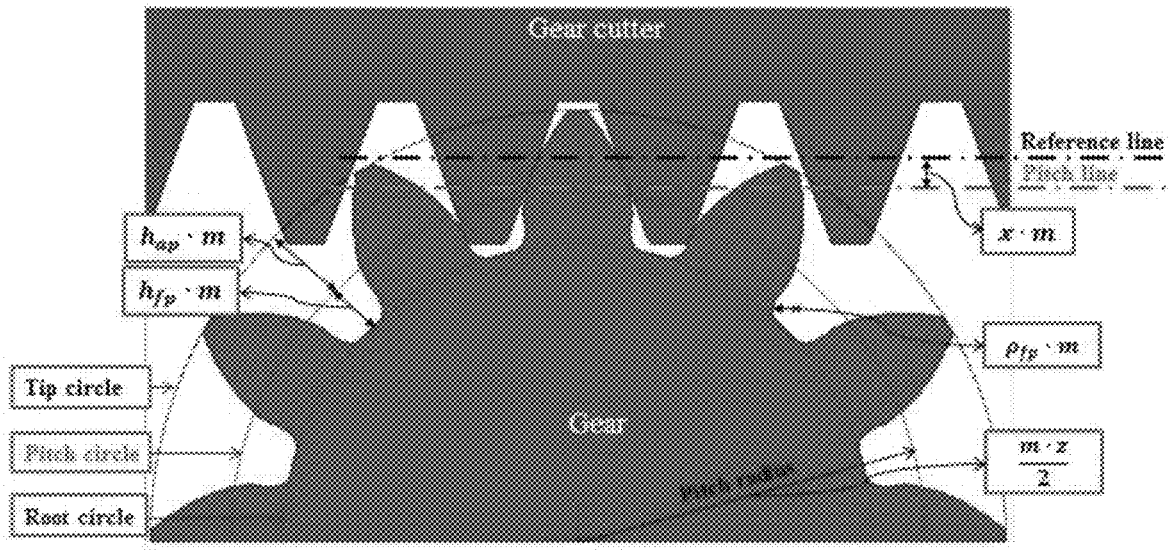
FIG. 17 shows design variables governing the gear profile.

The parameters described in Table 1 allow the description of the proper profile of the gear cutter which should be used for obtaining the desired gear profile. It is also assumed that a standard rack type cutter with a normal pressure angle of 20° is used for the manufacturing of the gears. The different parameters for gears which can be calculated based on the design variables are shown in FIG. 17.

Several constraints were identified to define one design space. In some embodiments gears with involute profiles are taken into consideration. The various constraints pertaining to the gear profile have been broadly classified into three different categories as: meshing constraints, manufacturing constraints and geometrical constraints.

Meshing constraints enable a pair of spur gears to be matched in such a way that there is smooth operation of the pump when the gears are meshing. Three different constraints which fall in this category are described below. Contact ratio constraint ensures that there is a smooth and continuous power transmission between the two gears. This constraint ensures that there is at least one pair of teeth which is always in contact with each other during the rotation of the gears.

Figure 18:
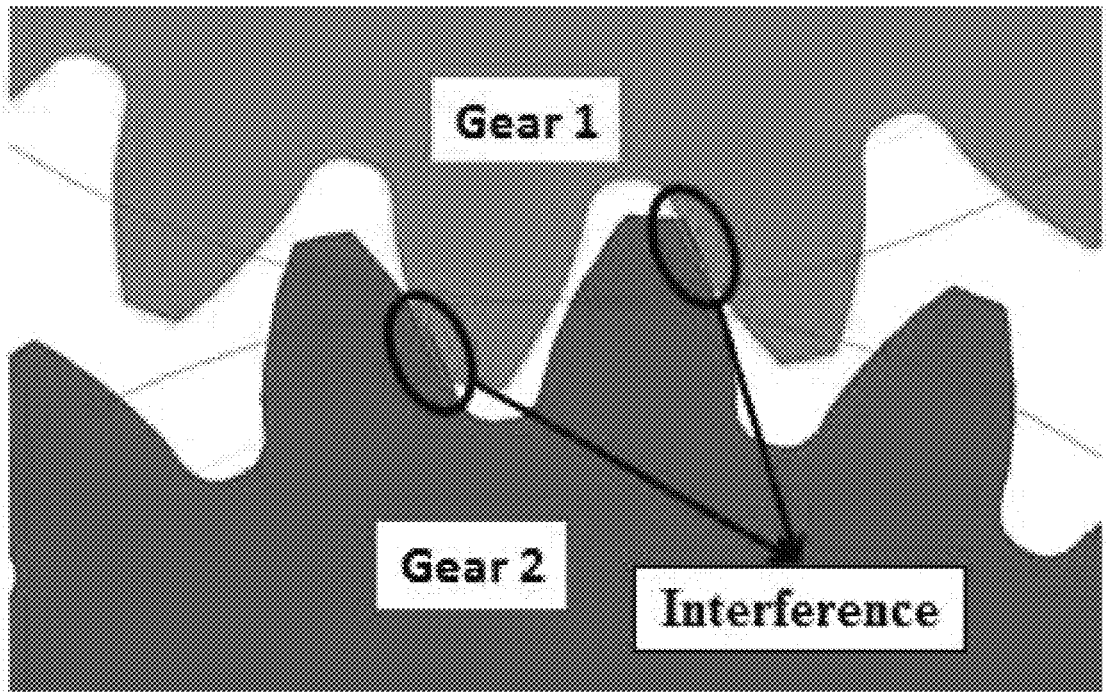
FIG. 18 shows interference in gears.

Interference is the phenomenon by which the involute portion of one gear digs into the flank of the other member of the pair. Thus resulting in the removal of involute portions of the gear near the base circle and hence weakening the teeth. FIG. 18 depicts interference between two gears clearing showing that considerable portion of one gear is below the base circle of the other.

The tip to root clearance constraint ensures that the inter-axis distance between the two gears is sufficiently large enough so that the tooth tip of one tooth does not intersect the bottom land of the other teeth.

The mathematical expressions which govern the meshing constraints are shown in Table 2 below.

TABLE 2

Expressions for meshing constraints

| Meshing constraints | | |
|---|---|---|
| Contact ratio | $\dfrac{\frac{2}{\cos a}\cdot\left(\sqrt{R_o^2}-R_b^2-R\cdot\sin a\right)}{\frac{2\cdot\pi\cdot R}{Z}}$ | 13 |

TABLE 2-continued

Expressions for meshing constraints

| Meshing constraints | | |
|---|---|---|
| Interference | $R_o^2 < R_b^2 + 4\cdot R^2\cdot\sin^2\alpha$ | 14 |
| Tip to root clearance | $R_0 + R_r < 2\cdot R$ | 15 |

Manufacturing constraints ensure the correct manufacturability of the gears based on the use of a rack type cutter. There are two different constraints which fall into this category as explained below.

Pointed Teeth constraint ensures that the thickness of the teeth at the tip of the gears is greater than zero hence preventing wear and tear of the gears during operation.

Figure 19:
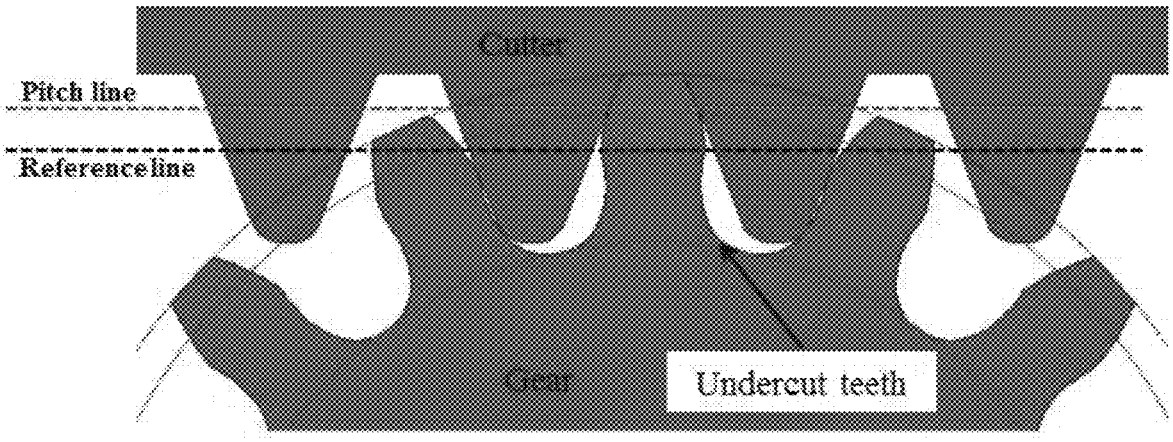
FIG. 19 shows an undercut gear.

Undercutting is the phenomenon due to which some material is removed at the root of the gear because of the interference between the cutter and the gear during the manufacturing process. One of the reasons for undercutting is large negative shift coefficients which lead to removal of more material by the cutter near the root of the gear. Since in gear pumps the teeth are not highly stressed as in other applications, a certain degree of undercutting is permitted until the thickness of the teeth is greater than a certain minimum value. FIG. 19, shown below, depicts the undercut tooth profile generated due to large negative profile shift coefficients.

The optimal shape of the gear, in the design space defined by Table 1 above, is determined by a numerical optimization process in which the pump model is used to evaluate the performance of each design. A generic algorithm was used to find the optimal combination of the input parameter both for the gear and the grooves of the bushing (FIG. 17). The optimal design is one compromise between four objective functions which are presented below.

OF1—Fluid Borne Noise.

Figure 20:
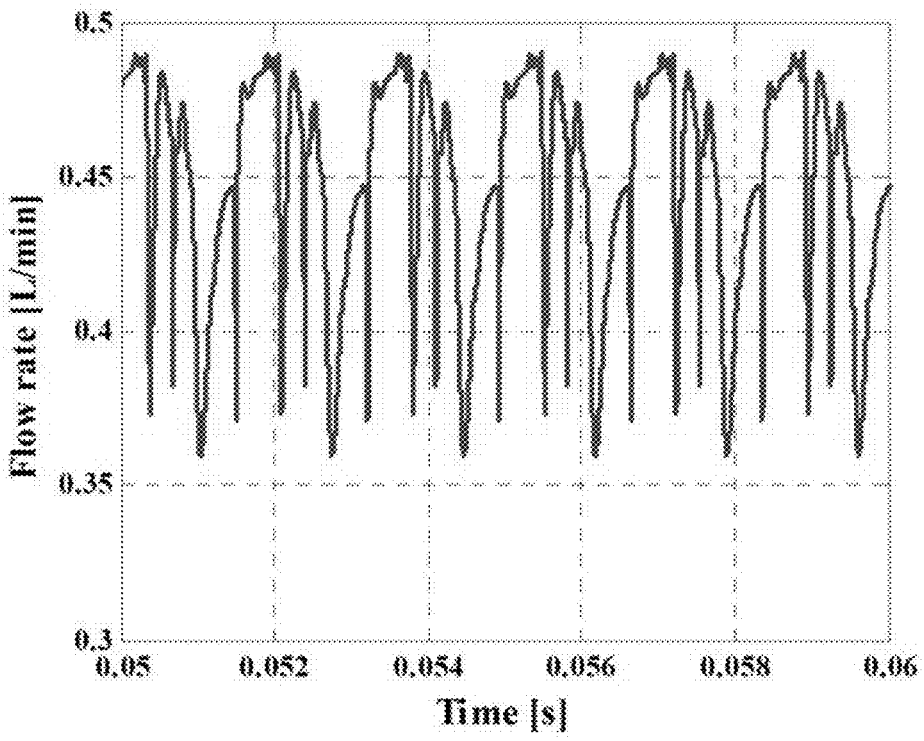
FIG. 20 is a graphical representation of flow ripple.
Figure 21:
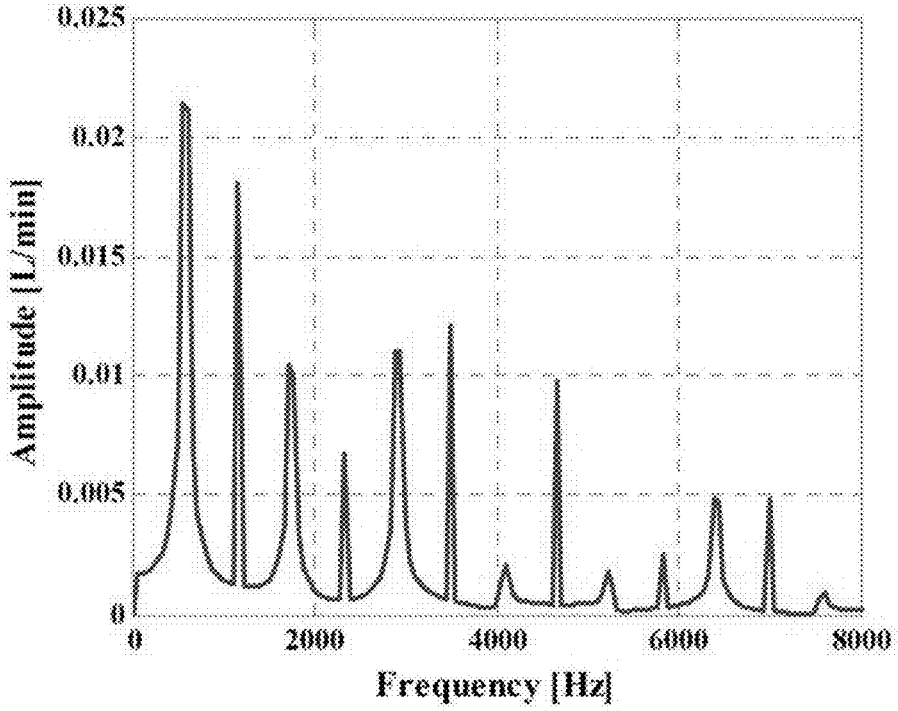
FIG. 21 is a graphical representation of flow ripple FFT.

The pulsation of the flow at the delivery is one of the primary sources of fluid borne noise. These flow oscillations can be quantified in terms of the total energy possessed by the simulated flow signal. The Fast Fourier Transform (FFT) of the delivery flow rate signal (FIG. 20) is depicted in FIG. 21. The calculated FFT proves to be useful in calculating the energy possessed by each fundamental harmonic of the flow ripple.

The FFT of the flow ripple is an indication of the energy possessed by the ripple that must be minimized. The estimate of the energy of each fundamental harmonic is given by:

$$\pi_k = \sum_{f_k+\Delta f}^{f_k+\Delta f} L(f)^2 \tag{5}$$

where L(f) refers to the flow amplitude in L/min for the corresponding frequency, f. fk represents the last frequency up to which the calculation of OF1 (energy of the signal) needs to be performed:

$$OF_1 = \sum_{k=1}^{N} \pi_k \tag{6}$$

OF2—Localized Cavitation.

During the meshing process, each TSV first reduces then increases its volume to accomplish the displacing action. Part of this volume decrease and increase occurs when the volume is trapped between points of contacts and the only communications of the TSV with the inlet and outlet environments are realized by the channels 26.5 realized in the lateral bushings 26. For this reason, these channels can be sized to guarantee smooth meshing process.

Figure 22:
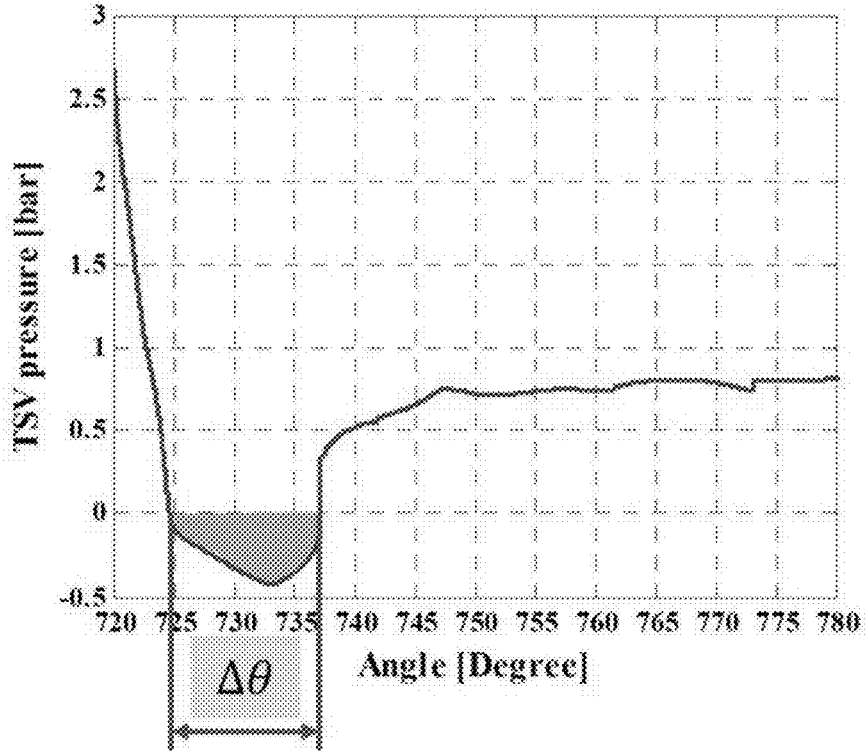
FIG. 22 is a graphical representation of cavitation localization.
Figure 23:
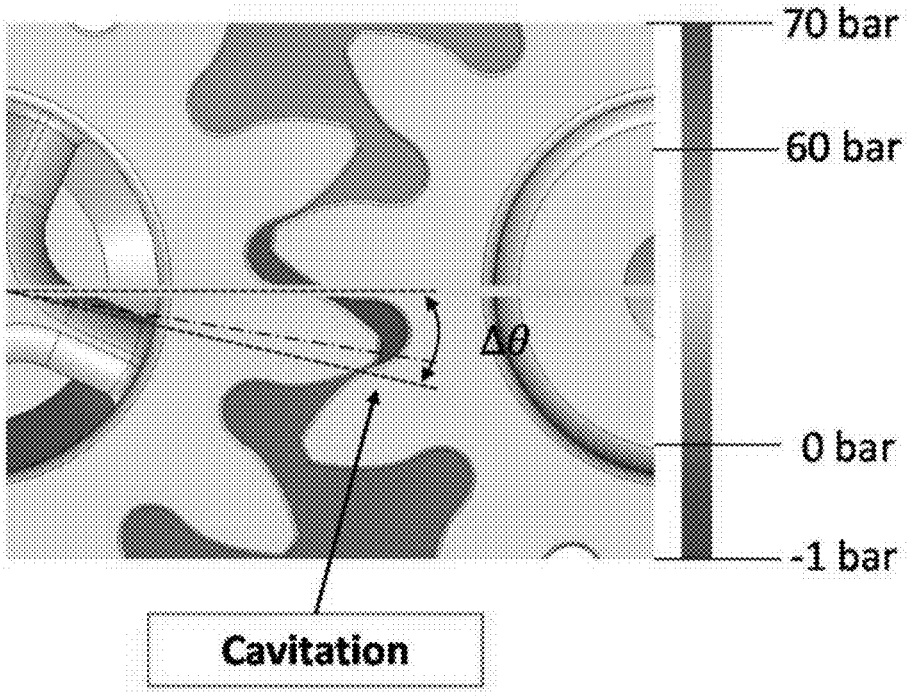
FIG. 23 shows cavitation in the meshing process.

The TSV increases leading the pressure in the TSVs falling below the saturation pressure (FIG. 22 and FIG. 23), hence localized cavitation occurs due to air release or—in extreme conditions—to vapor cavitation. This phenomena contributes to a further emission of noise and can compromise pump durability. A quantification of the tendency of promoting localized cavitation can be based on the area of the tooth space pressure curve (OF2) which lies under the saturation pressure. The equation for OF2 can be expressed as equation:

$$OF2=\int_{\theta_i}^{\theta_f}|p|d\theta \tag{7}$$

Figure 25:
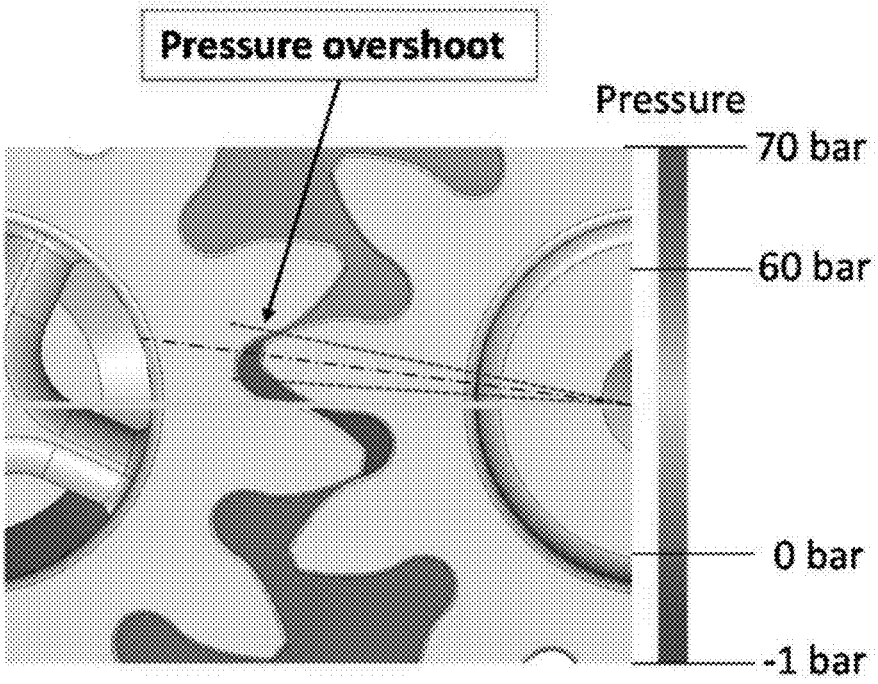
FIG. 25 shows pressure peak in the meshing process.

The meshing process of the two gears is characterized by conditions where the fluid is trapped between points of contact. As the gears rotate, the trapped fluid is squished and hence due to the high fluid compressibility its pressure can shoot to very high values. In FIG. 25, the detail of the meshing process is shown highlighting the regions where pressure overshoots occurs.

Figure 24:
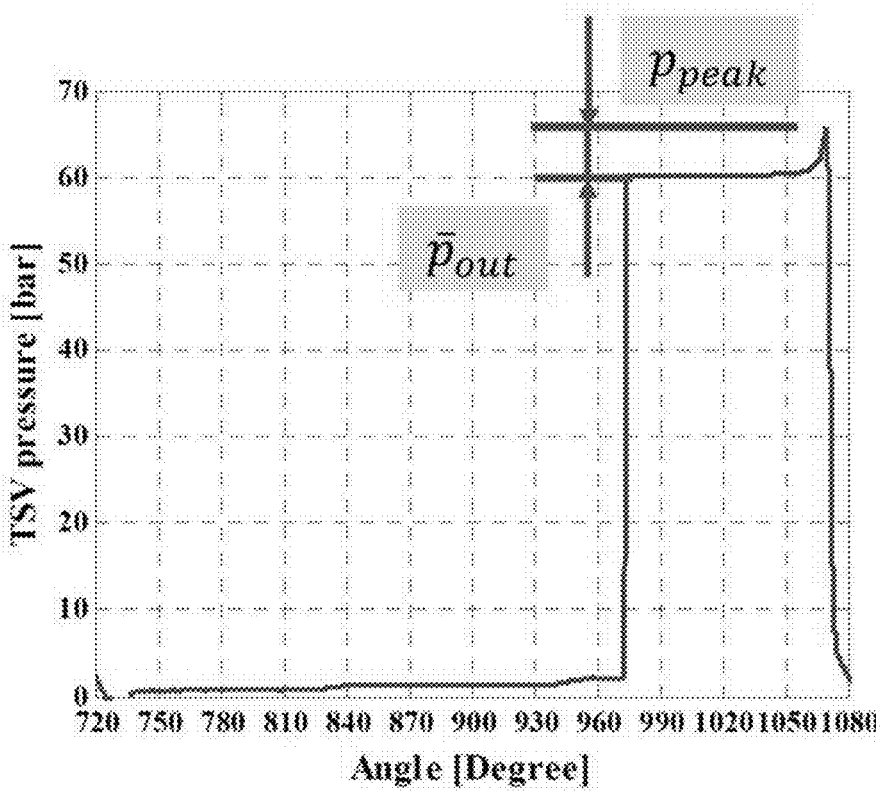
FIG. 24 is a graphical representation of pressure overshoot localization.

An evaluation of the pressure overshoots can be expressed as a non-dimensional number based on the average delivery pressure and the maximum pressure (FIG. 24) by the following equation:

$$OF3=\frac{p_{peak}-\overline{p}_{out}}{\overline{p}_{out}} \tag{8}$$

where $p_{peak}$ is the maximum tooth space pressure and pout is the average delivery pressure.

OF4—Volumetric Efficiency.

The shape of the gears 22, 23 and of the channels 26.5 to minimize the losses of flow due to internal leakages or bypass from the outlet to the inlet ports.

The following parameters describe the gear profile for a 0.13 rev/cc gear pump according to one embodiment of the present invention.

TABLE 3

Design parameters for 0.13 cc/rev pump

| Parameter | Value | Unit |
|---|---|---|
| Module | 0.7714 | mm |
| No. of Teeth | 10 | — |
| Pitch Radius | 3.85 | mm |
| Root Radius | 2.95 | mm |
| Outside circle Radius | 4.60 | mm |
| Addendum Coefficient | 0.586 | — |
| Dedendum Coefficient | 1.378 | — |
| Fillet radius Coefficient | 0.300 | — |
| Facewidth | 3.50 | mm |
| Pressure angle | 25.44 | — |
| H | 0.425 | mm |
| R | 0.380 | mm |
| V | 3.625 | mm |

As a second example, the following parameters describe the gear profile and the grooves of the bushing for a 0.36 cc/rev gear pump in one embodiment.

TABLE 4-1

Design parameters for 0.36 cc/rev pump

| Parameter | Value | Unit |
|---|---|---|
| Module | 1.386 | mm |
| No. of Teeth | 10 | — |
| Pitch Radius | 5.39 | mm |
| Root Radius | 4.13 | mm |
| Outside circle Radius | 6.44 | mm |
| Fillet radius Coefficient | 0.3 | — |
| Facewidth | 9 | mm |
| Pressure angle | 25.44 | — |
| H | 1.35 | mm |
| R | 0.625 | mm |
| V | 4.75 | mm |

The geometrical displacement can be verified by the following equation:

$$V=2\cdot\pi\cdot b\left(R_o^2-R^2\left(1+\frac{\pi^2\cdot\cos^2\alpha}{3\cdot z^2}\right)\right) \tag{9}$$

where $R_o$ is the outside radius, R the pitch radius, z the number of teeth, b the face width and α the pressure angle.

Figure 26A:
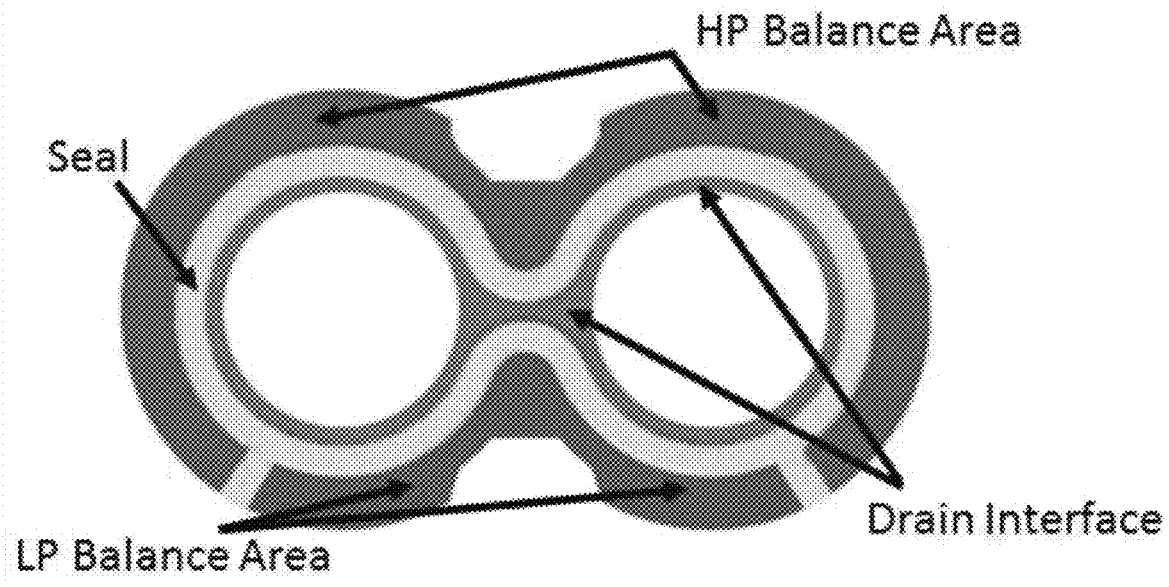
FIG. 26A shows a view of the balance areas in the lateral busing. HP and LP areas are separated by a seal. The same seal isolates also the drain interface.
Figure 26B:
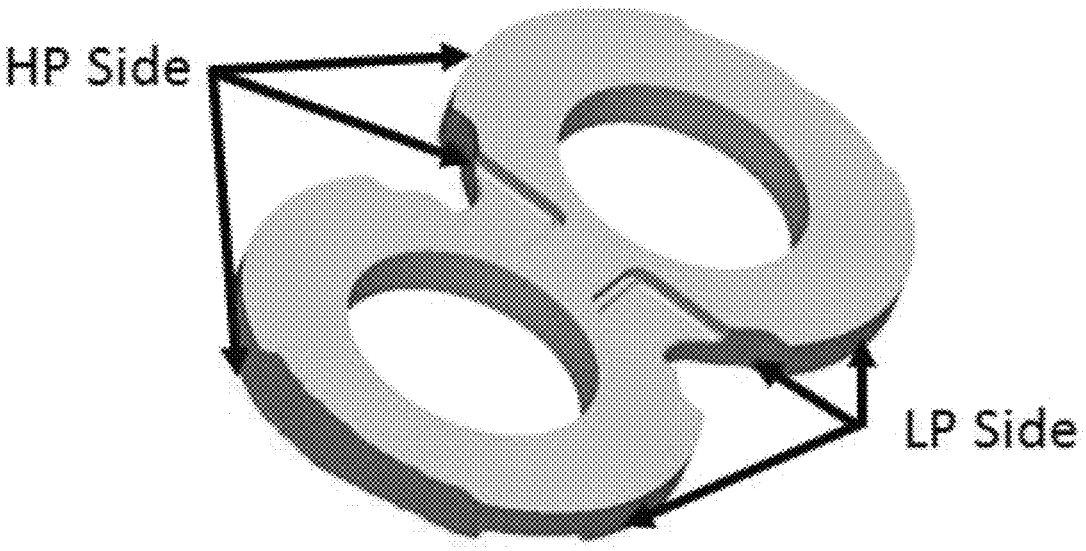
FIG. 26B shows a view of the sides of the bushing separated into HP and LP.

The design of lateral bushes with proper axial balance is a problem in external gear machine since it should achieve the goal of sealing the gap, while avoiding excessive shear stresses due to boundary lubrication and wear. In order to achieve axial balance in a wide range of operating conditions, the lateral bushings in one embodiment are designed to be hydrostatically balanced. Referring to FIGS. 26A and 26B, which shows bushings including seal seats, the side that faces away from the gears (from here on referred to as the balance side) is designed to generate a pressure force that balances the force acting on the pressure side (the side that face the gears). While on the balance side a seal simply separates a high pressure region, HP—connected to the high pressure port of the unit—from a low pressure region LP—connected to the low pressure port—on the pressure side the pressure distribution is given by the pressure value inside each tooth space volume (TSV) and the pressure inside the gap between the gear and the lateral bushes. This latter is dependent on the lubricant film thicknesses and bushing micro-motion—with hydrodynamic effects being as important as hydrostatic effects.

Lateral gaps in external gear machines (EGMs) are affected by parameters such as operating speed, pressure and angle of tilt of the lateral bushing. Other considerations include surface roughness and elastohydrodynamic (EHD) effects (using a simplified single tooth model). In the past, such studies involved an assumption of certain gap height (and/or tilt), and a model that can predict the lubricant film thickness and performance of the lateral gap of a EGM considering elastohydrodynamic effects is used to prepare some of the pump embodiments disclosed herein.

Apart from modeling the interaction between the lubricant film and the solid components, the lateral gaps in EGMs present geometrical complexity, as well as complexity pertaining to other effects such as radial motion of the gears, casing wear and the instantaneous pressures in the tooth space volumes (TSVs).

One design for the pressure balance is shown according to the parameter a that can vary between 0 and 70. As a preliminary design an angle a=60 degree has been chosen in one embodiment.

Figure 27:
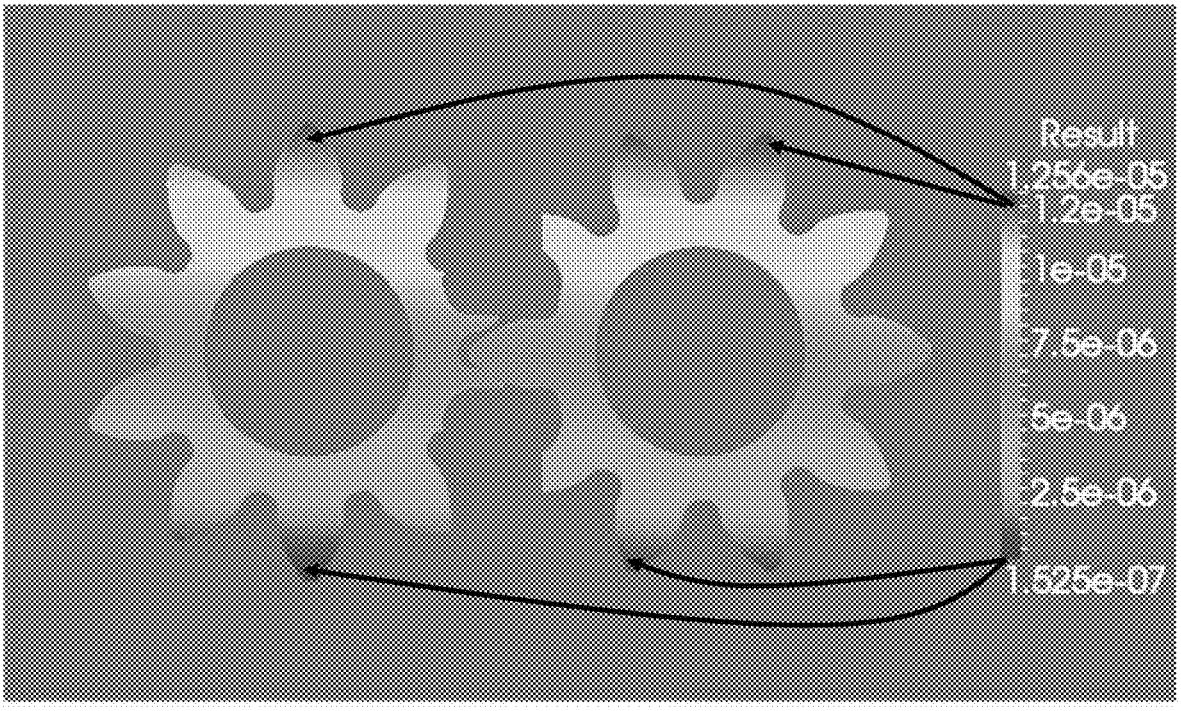
FIG. 27 shows a gap height according to one embodiment of the present invention.
Figure 28A:
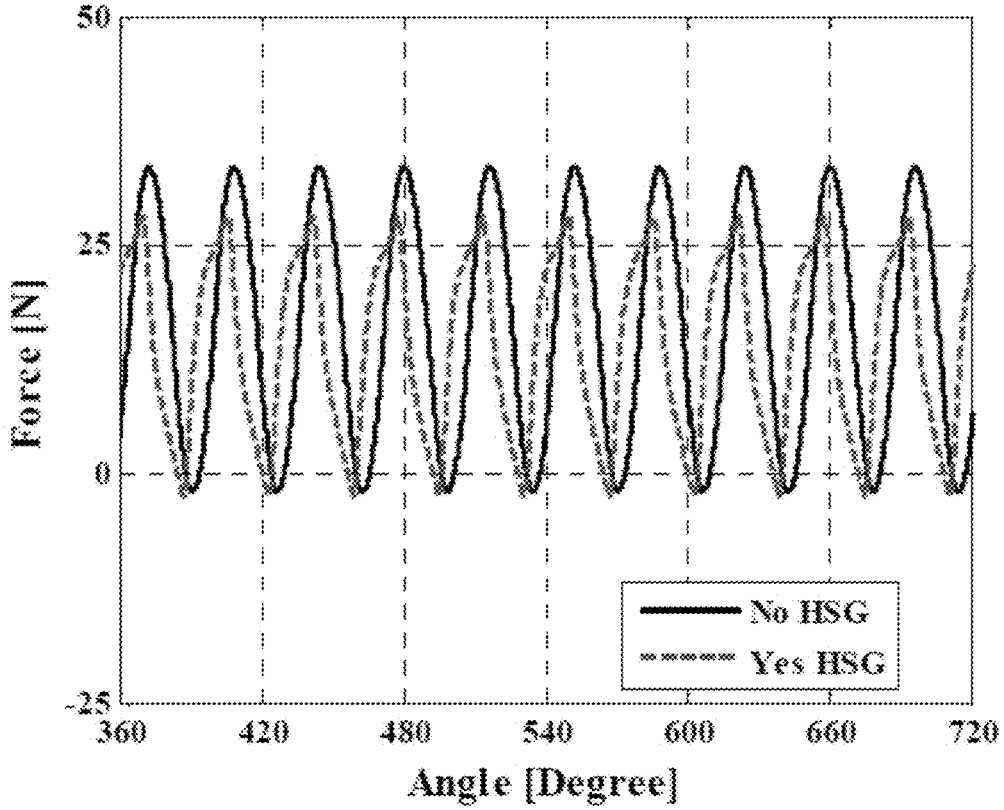
FIGS. 28A, 28B, 28C, and 28D show graphical representations of X and Y forces acting on the gears, interaxis and TSV pressure without HSG and with HSG.
Figure 28B:
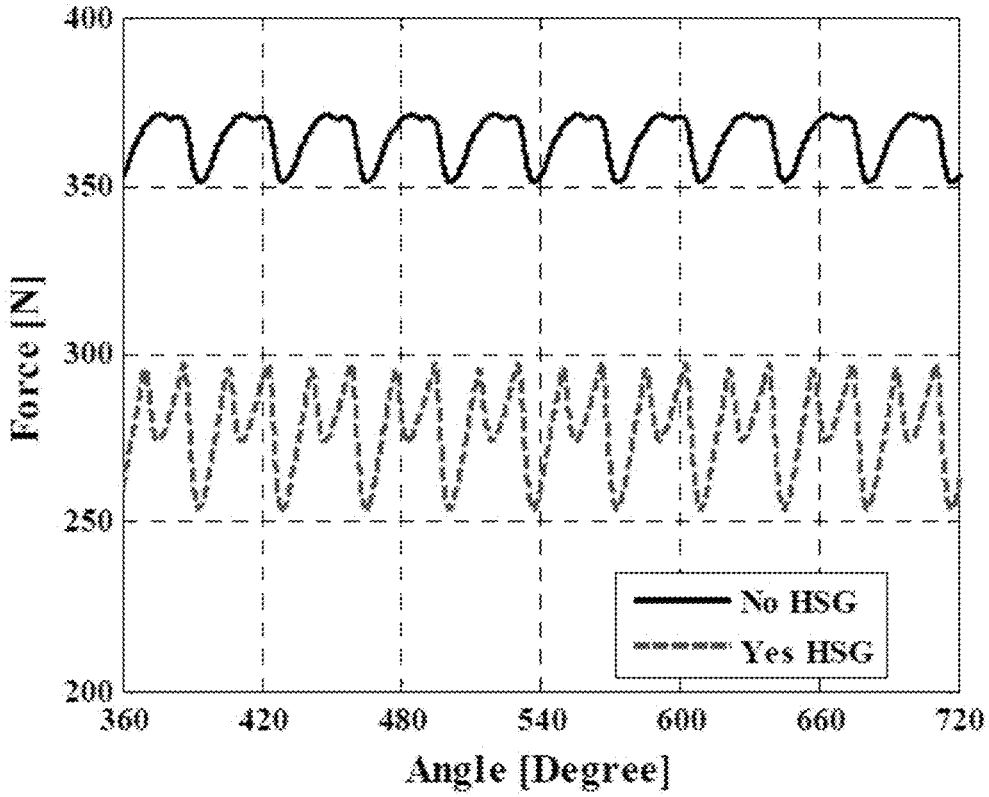
Figure 28C:
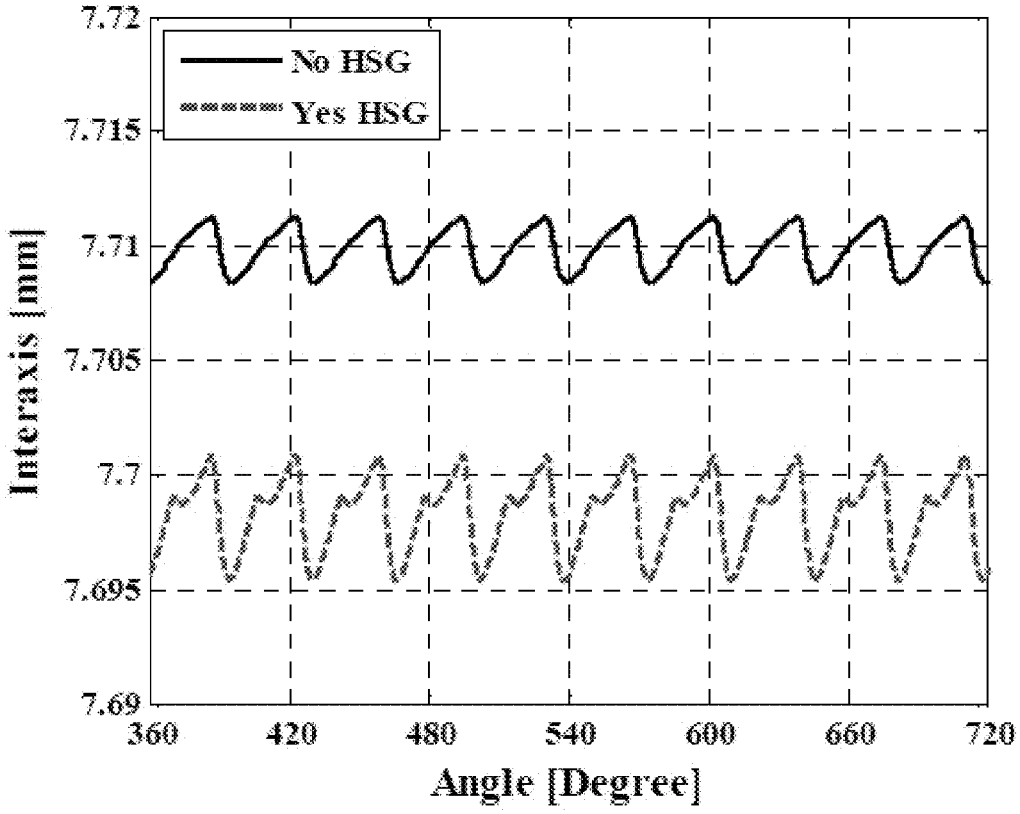
Figure 28D:
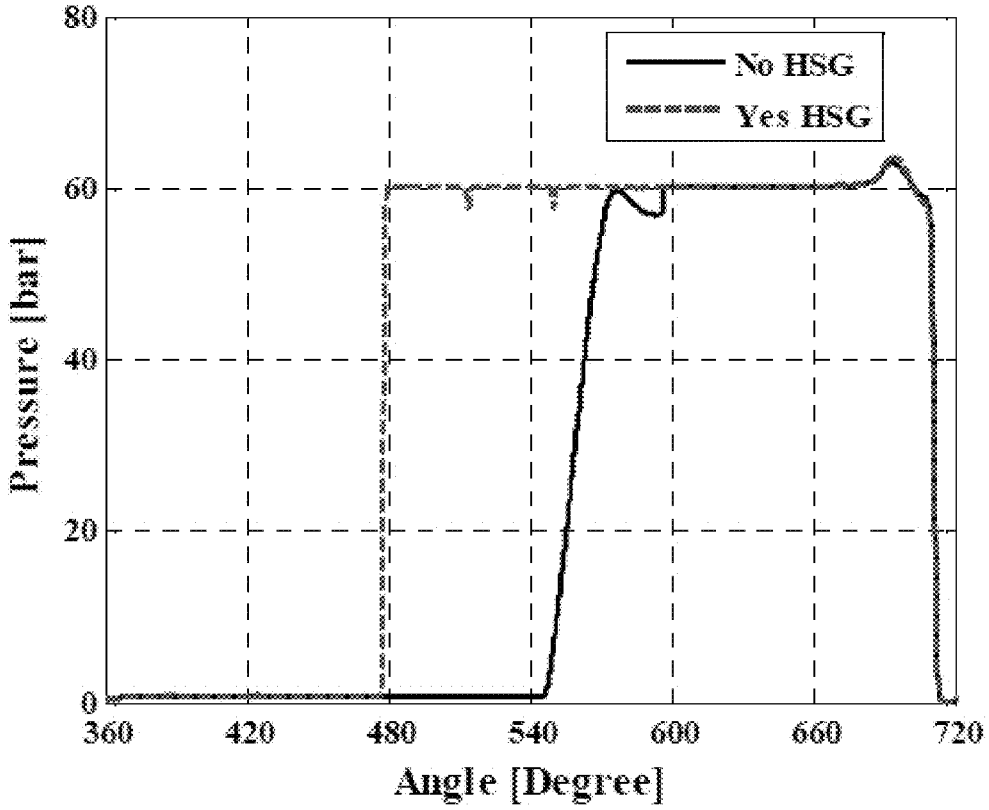

From FIG. 27, it can be seen that there is contact on the low pressure side as supported by the fact that there is a very low film thickness (around 0.15 μm) present in that region. This can increase the power losses due to fluid friction and result in reduced reliability of the pump.

The axial balance of the pump can be achieved by following a numerical procedure which uses a model for the lateral lubricating gaps and varies at least two parameters which affect the balance of the pump:

- the balance area of the lateral bush (highlighted in FIG. 4D)
- point of application of the uniformly distributed balance force (due to the constant high pressure) acting on the balance area A model for the lateral lubricating gaps in gear machines considers both the hydrostatic and hydrodynamic forces acting on the lateral bush to solve for the pressure distribution in the lubricating gap. Primarily, the forces acting on the lateral bush can be classified into two as discussed above. Applying the force balance condition shown in the algorithm applied for the lubricating gap model, the resultant force from the gap at the end of every time step acts at a single point on the block and has the same magnitude due to the equilibrium achieved. Neglecting the hydrodynamic effects of the lateral bush, which includes the tilt of the bush, there are varying magnitudes of force from the gap and its point of application for one revolution of the gears. Using these values, we now have the search space of varying geometrical parameters for the balance area design with which we can obtain a good balance of the pump.

The lubricating hole, placed in the front and back cover plate, connects the bearings and the journal bearings through the back lubricating channel (FIG. 11) to the tank in order to allow the lubrication. FIG. 4B shows the lubricating channels in the bushing that improve the lubrication between the bearing and the journal bearing.

High Speed Grooves (FIG. 4B) are helpful to connect the delivery pressure to the bushes back side in order to increase the pressure thrust on the bushes. The angle β that define the size of the grooves should be 10-30° more than α, and δ should be around 30°.

The beneficial effect of the HSGs can be evaluated from FIGS. 28A, 28B, 28C, and 28D where a parameters comparison with and without HSGs is depicted. From the top of the figure the forces both in x and y direction are plotted and the direct comparison shows that the high speed grooves diminish the forces resulting in a lower displacement of the gears as is confirmed by the interaxis plot at the bottom left of the figure. Moreover HSGs allow an earlier pressurization of the tooth space volume as stated at the bottom right of the figure.

In one embodiment, the higher displacement pump according to one embodiment can be characterized by the same number of teeth but different diameter and face width. The following parameters describe the gear profile for a 1.1 rev/cc gear pump in one embodiment:

TABLE 4-2

Design parameters for 1.1 cc/rev pump

| Parameter | Value | Unit |
|---|---|---|
| Module | 1.386 | mm |
| No. of Teeth | 10 | — |
| Pitch Radius | 6.925 | mm |
| Root Radius | 5.3185 | mm |
| Outside circle Radius | 8.276 | mm |

TABLE 4-2-continued

Design parameters for 1.1 cc/rev pump

| Parameter | Value | Unit |
|---|---|---|
| Fillet radius Coefficient | 0.3 | — |
| Facewidth | 9 | mm |
| Pressure angle | 25.44 | — |

Figure 13A:
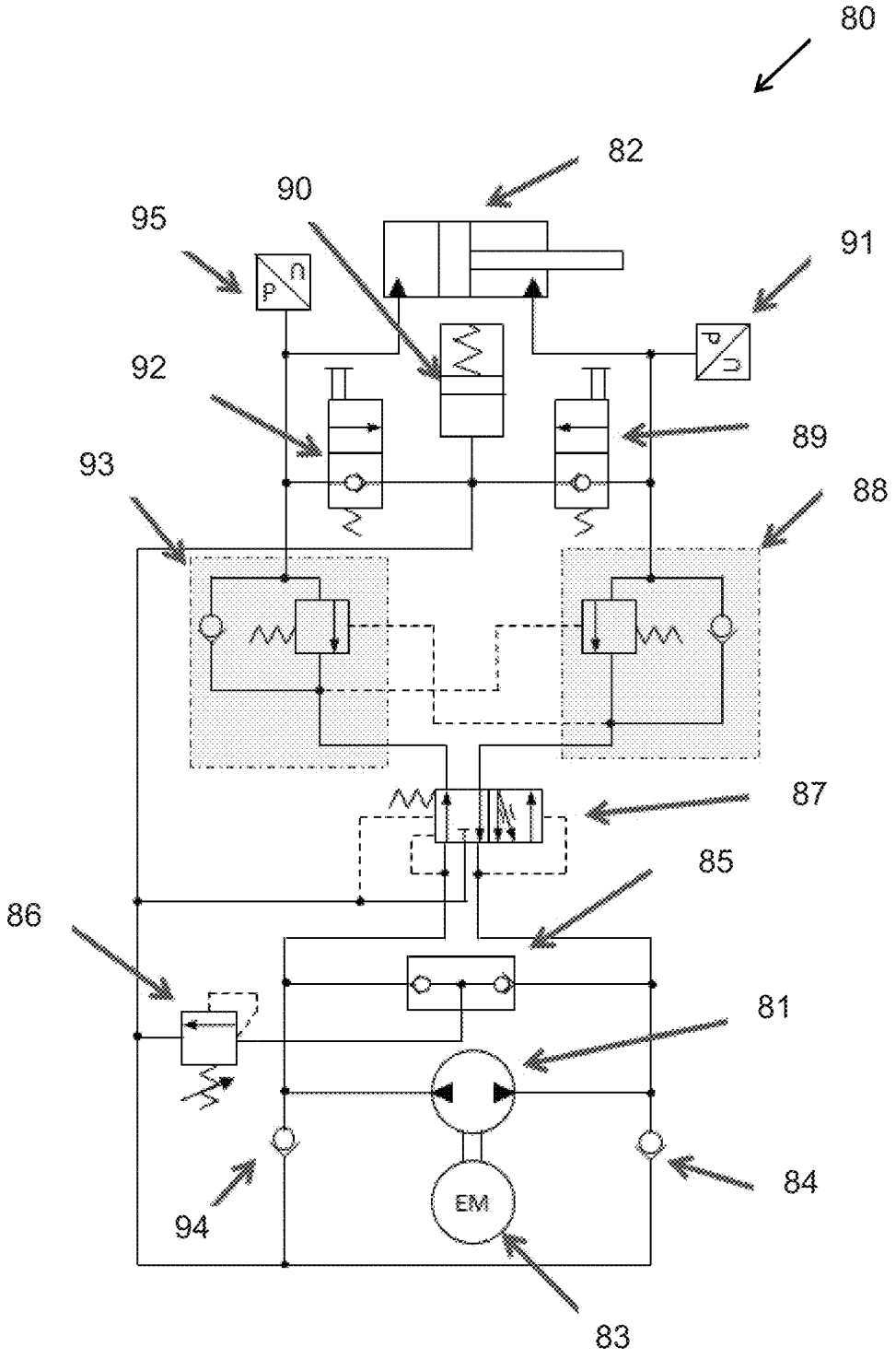
FIG. 13A is a symbolic schematic representation of a system incorporating an inventive pump.
Figure 13B:
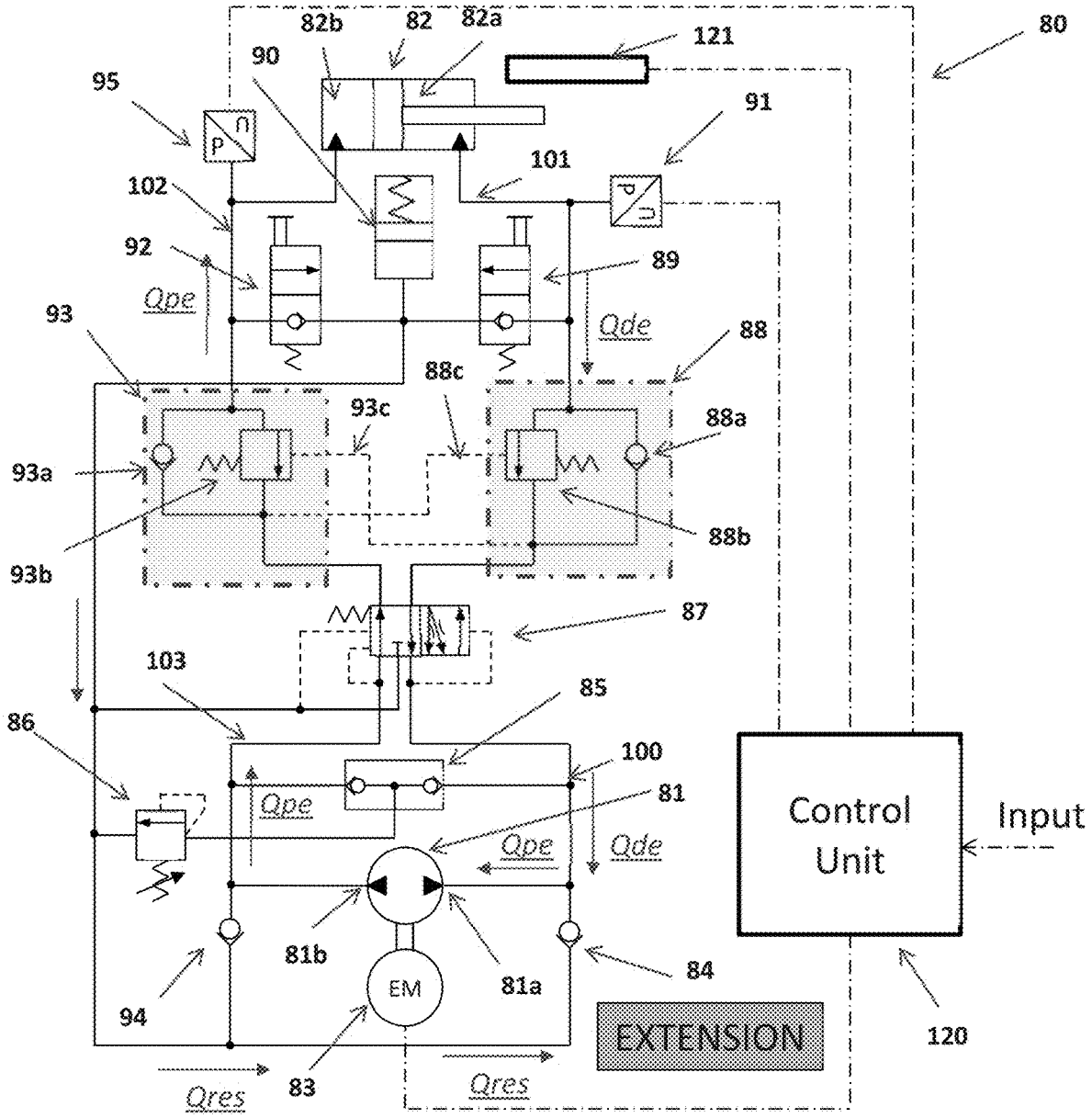
FIG. 13B is a symbolic schematic representation of a system incorporating an inventive pump.
Figure 13C:
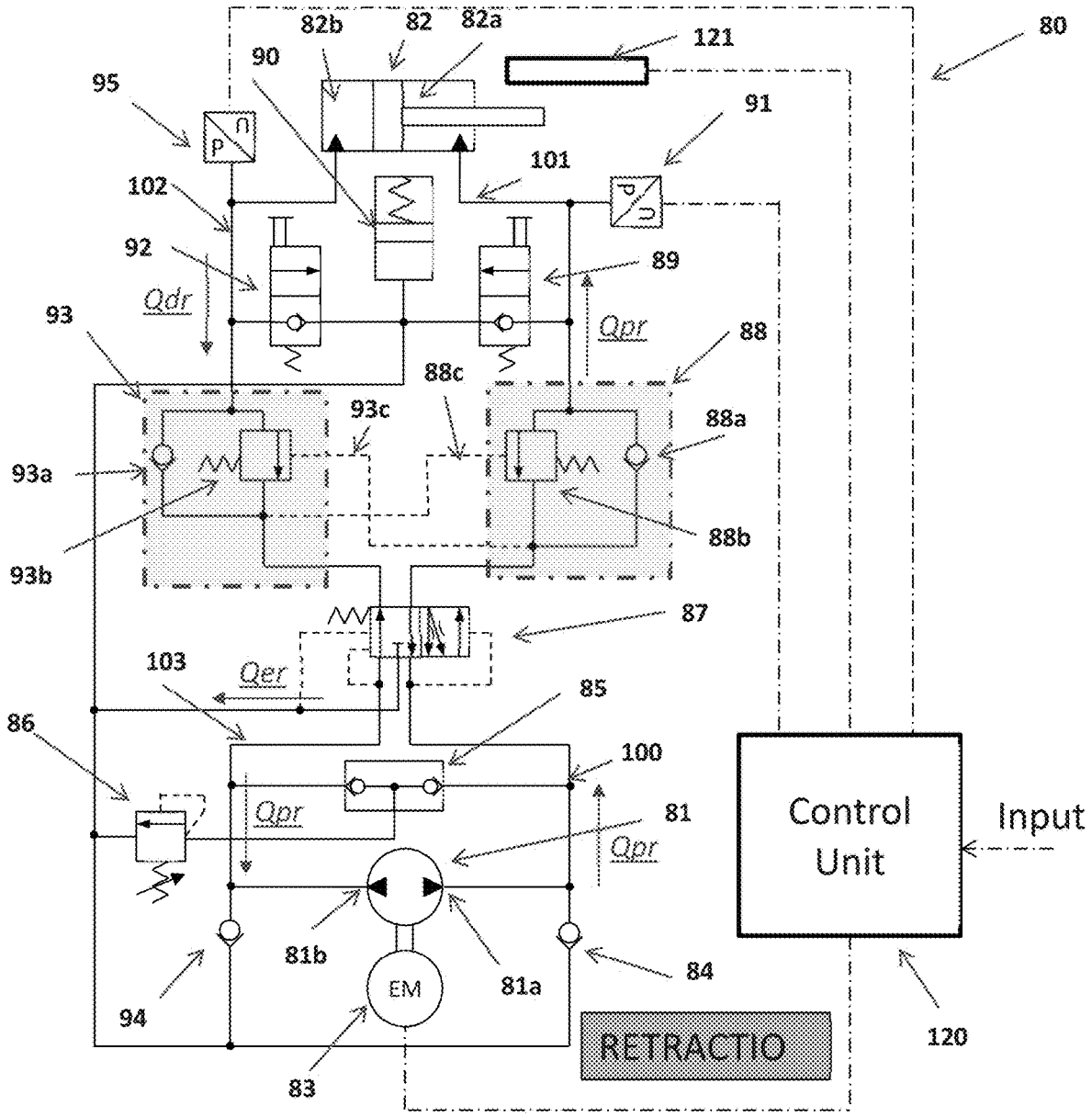
FIG. 13C is a symbolic schematic representation of a system incorporating an inventive pump.
Figure 13D:
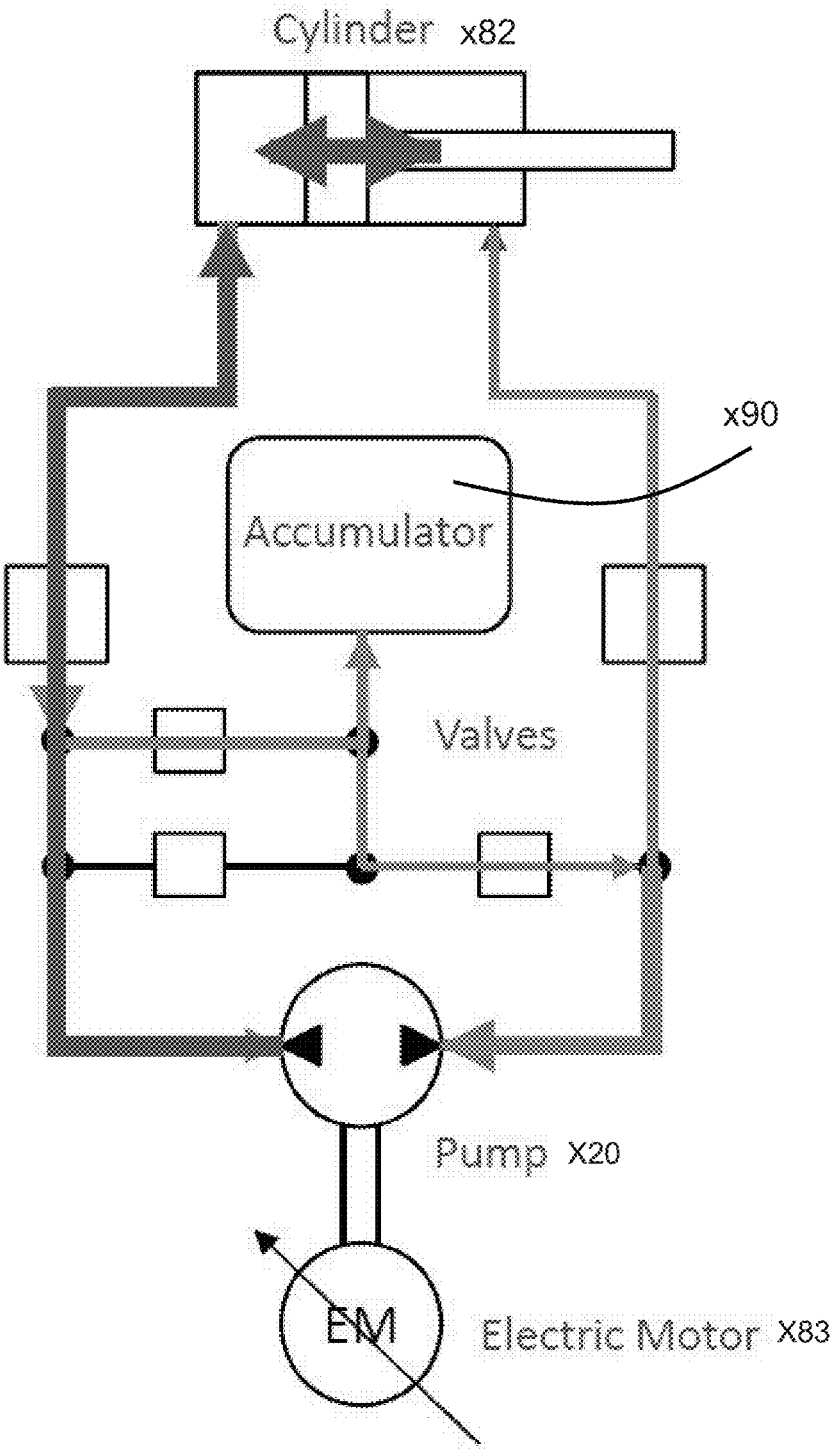
FIG. 13D is a symbolic schematic representation of a generic system incorporating an inventive pump according to one embodiment of the present invention.

FIGS. 13A, 13B and 13C depict an electrohydraulic actuator system 80 that utilizes a pump 81 generally similar to the inventive pumps described herein.

A pressurized reservoir 90 is provided having a minimum pressure at the pump inlet thus avoiding or limiting cavitation phenomena that could occur due to the presence of the check valves 94 and 84. Check valve 94 and 84 alternatively allow the fluid from the pressurized reservoir 90 to the inlet port of the reversible pump 81. In more detail: when the pump rotates in one direction (clockwise) the check valve 94 allows the passage of the fluid while check valve 84 is closed since the delivery port of the pump 81 is pressurized. When the pump 81 rotates in the opposite direction (counterclockwise) the check valve 84 allows the pump to take fluid from the inlet port, while the check valve 94 is closed by means of the pressure at the pump delivery port.

The combination of the shuttle valve 85 and the relief valve 86 provides redundant safety. In particular, in case of failure of pressure transducers 91 and 95 or of the electronic control unit 120, the maximum pressure at the delivery port of the pump 81 is limited. Depending on electric motor 83 rotation, each port of pump 81 can assume the function of inlet or outlet.

Manual safety valves 89 and 92 allow the movements of the actuator 82 even if both the pump and/or the electronic control may not work. In case the load exceeds the maximum allowed, pressure transducers 95 and 91 along with the electronic control unit 120 work in such a way to stop the electric motor 83 and consequently the pump 81 and the actuator 82 motion.

When the pump 81 rotates counterclockwise, fluid from the pump delivery port 81*b* reaches the discharge valve 87 by means of the duct 103. In this condition check valve 94 is closed. The amount of the fluid delivered from the pump is Qpe. Discharge valve 87, thanks to its internal pilot line and the spring, is kept in its rest position allowing the fluid from duct 103 to reach the counterbalance or overcenter valve 93. Then, fluid passes through the check valve 93*a* and arrives to the actuator bore chamber 82*b* performing the extension. The actuator rod-side chamber 82*a* discharges the fluid that reaches the counterbalance valve 88 through the duct 101. The amount of fluid discharged by the actuator is Qde.

Qde cannot pass through the check valve 88*a* which is closed but it can go through the valve 88*b* that is in a regulating position thanks to the pilot connection 88*c* that moves the internal sliding element rightwards. Therefore, the fluid reaches the suction port 81*a* of the pump. Since the amount of fluid Qde is less than the amount of fluid Qpe the difference Qres=Qpe−Qde is provided by means of the pressurized reservoir through the check valve 84.

Valve 88*b* prevents cavitation phenomena and uncontrolled motion of the actuator 82 during extension if the load acting on the actuator becomes aiding or overrunning (load acts in the same direction of the speed). If the load pulls the actuator 82, the flow rate required by the actuator 82 is more than the one the pump 81 can generate. Therefore, the pressure on the pilot line 88*c* decreases and the sliding element of the valve 88*b* moves leftwards generating a back pressure in the rod actuator chamber 82*a*. In this way, the force balance on the actuator is restored and load control is provided. Moreover actuator 82 locking function is provided by the overcenter or counterbalance valves 88.

When the pump 81 rotates clockwise, fluid from the pump delivery port 81*a* reaches the discharge valve 87 through the duct 100. In this condition the check valve 84 is closed. The amount of the fluid delivered from the pump is Qpr. The discharge valve 87 changes its position since the internal pilot connection acts in such a way to move the valve leftwards so that the fluid reaches counterbalance valve 88. Consequently the fluid passes through the check valve 88*a* and then reaches the duct 101. Fluid from the duct 101 reaches the rod side 82*a* of the actuator 82 performing a retraction movement. Oil from the bore side 82*b* of the actuator 82 is discharged by means of the duct 102 that is connected with the counterbalance valve 93. The amount of fluid discharged by the actuator is Qdr. Since the actuator 82 is a double acting, single rod actuator Qdr is greater that Qpr. The amount of fluid Qdr cannot go through the check valve 93*a* since it is closed but it can go through the valve 93*b* that is in a regulating position thanks to the pilot connection 93*c* which moves the internal sliding element leftwards. Fluid Qdr discharged from the valve 93*b* is then split in two parts by means of the discharge valve 87. In more detail, the excess amount of fluid Qer=Qdr−Qpr is discharged towards the reservoir 90 by the discharge valve 87 so that the right amount of the fluid Qpr can be sucked by the pump and then delivered.

Valve 93*b* prevents cavitation phenomena and uncontrolled movement of the actuator 82 during retraction if the load acting on the actuator becomes aiding or overrunning (load acts in the same direction of actuator speed). If the load tends to push the actuator 82, the flow required by actuator 82 is more than the one the pump 81 can generate. Therefore the pressure on the pilot line 93*c* decreases and the sliding element of the valve 93*b* moves rightwards generating a back pressure in the bore actuator chamber 82*b*. This permits to reach a force balance condition in the actuator and restore the control of the load. Moreover actuator 82 locking function is provided by the overcenter or counterbalance valves 93.

Still further embodiments of a miniature, high pressure pump 120, and further electrohydraulic actuation systems 180 and 280, will be shown and discussed with regards to FIGS. 29 to 50.

The control unit 120 implements start and stop functions depending on the operating condition. Suppose the user issues the command RETR. (retraction command) and at the same time the actuator has reached its lower endstroke the control unit, analyzing the signal issued by the position sensor 121 or x96, will generate a null signal to stop the electric motor 83. If instead the user issues the command EXT. (extension command) and at the same time the actuator has reached its upper endstroke the control unit analyzing the signal issued by the position sensor 121, will generate a null signal to stop the electric motor 83. In case the pressure in the actuator bore chamber 82*b*—sensed by the pressure sensor 95 or in the actuator rod chamber 82*a*—sensed by the pressure sensor 91 equalizes the maximum pressure allowed in by the control unit 120, the control unit 120 will issue a signal to stop the electric motor 83 to preserve the integrity of the system 80. The speed of the electric motor 83 during the normal functioning will depend on the user input allowing the user to set the desired speed.

Figure 29:
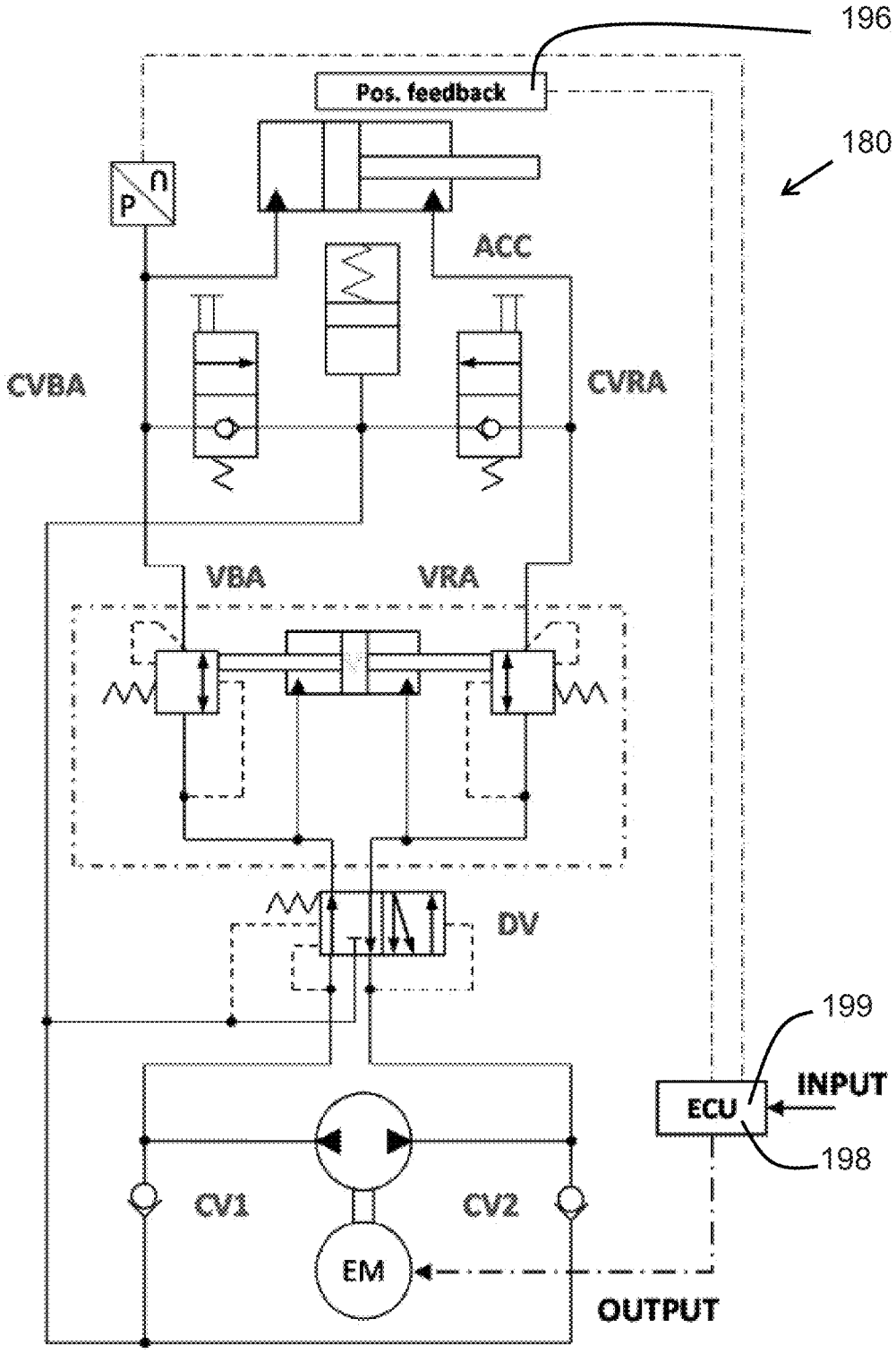
FIG. 29 shows an ISO hydraulic circuit of an EHA, and including a pump according to one embodiments of the present invention.

An EHA system according to another embodiment is represented by the ISO schematic of FIG. 29. The system can include a brushless electric motor which drives a birotational external gear pump. However, it is understood that motive power can be provided in any fashion, including other types of electric motors or pneumatic motors, as examples. The pump can send the hydraulic fluid to both the rod and the bore sides of the actuator without the need of a directional flow control valve. A spring loaded accumulator (ACC) serves as system reservoir and it is connected to the pump by means of two check valves. Manual valves are also present in order to allow the motion of the actuator in case of emergency.

The extension of the actuator is realized when the pump rotates in the first direction, the flow from the pump output port reaches the bore chamber of the actuator, while the fluid in the rod side is discharged and sucked from the other side. The discharge valve DV is in the left position. Since the actuator is single rod, the check valve CV1 provides the supplementary flow from the accumulator needed at the suction side of the pump. The retraction is realized with the opposite rotation of the pump shaft, the fluid reaches the rod side and the oil from the bore side of the actuator is discharged. In this condition, the output flow from the actuator is greater than the inlet one delivered by the pump, and the discharge valve DV, which is in the right position, allows the fluid to be discharged to the reservoir.

The EHA systems 180 and 280 incorporate some or all of the following aspects:

- One proposed system 180 with counterbalance valve with integrated non piloted check valve permits the load holding function but also assists in the control of the actuator velocity during assistive load conditions. In these conditions, the system permits to establish the minimum pressure at the pump necessary to balance any value of the aiding force at the actuator, thus permitting energy saving with respect to other existing EHA based on fixed resistances to control aiding load phases.
- The proposed design with position feedback of the actuator (LVTD or equivalent transducer) and pressure transducers avoids waste of energy when the actuator reaches the end-stroke.
- Manual or electric activated release valve can easily unlock the actuator in case of failure of the electric motor or the pump.
- Shuttle valve in combination with a relief valve provides safety redundancy in case of electronic failure (pressure and linear transducer)
- The discharge valve allows to discharge flow at a lower pressure compared to the systems where the relief valve is used.
- Pressurized reservoir reduces the possibility of cavitation at the pump inlet.

The two valves VBA and VRA allow to hold the actuator in position when the electric motor is not activated. The particular design of these valves permits a compact integration in the EHA, as represented in the 3D overall view of the system given in FIG. 29.

The actuator in one embodiment is contained in a parallelepiped of dimension 300 mm×90 mm×70 mm; it is featured by a cylinder up to 19 mm diameter and the linear speed is up to 16 mm/s according to the pump displacements used.

From a fail-safe point of view, the system is equipped with a pressure transducer in order to stop the electric motor when the maximum pressure is reached or if the increase in pressure over time is higher than a pre-defined value. This functionality is particular useful for example when the seat connected to the EHA hits another object and the passenger continues to activate the movement. A hydraulic pressure relief valve could be used as an alternative. Manual release valves (CVBA and CVRA) are easily replaceable with the electro-activated valve, and allow the connection between the tank and the actuator chambers in case of electric or pump failure so that the actuator movement can be performed.

Figure 30A:
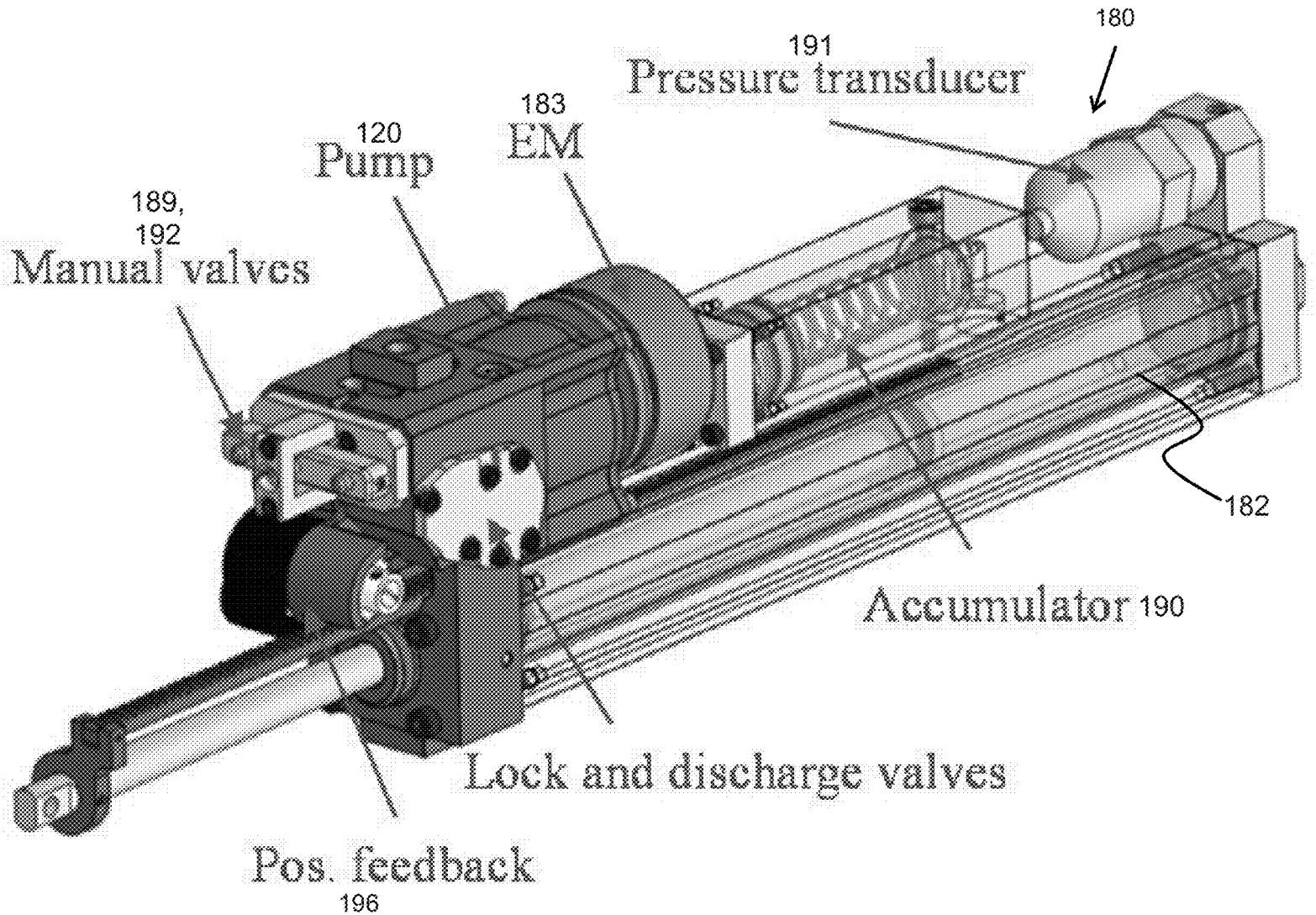
FIG. 30A shows a 3-D view of the EHA representative of the schematic of FIG. 29.
Figure 30B:
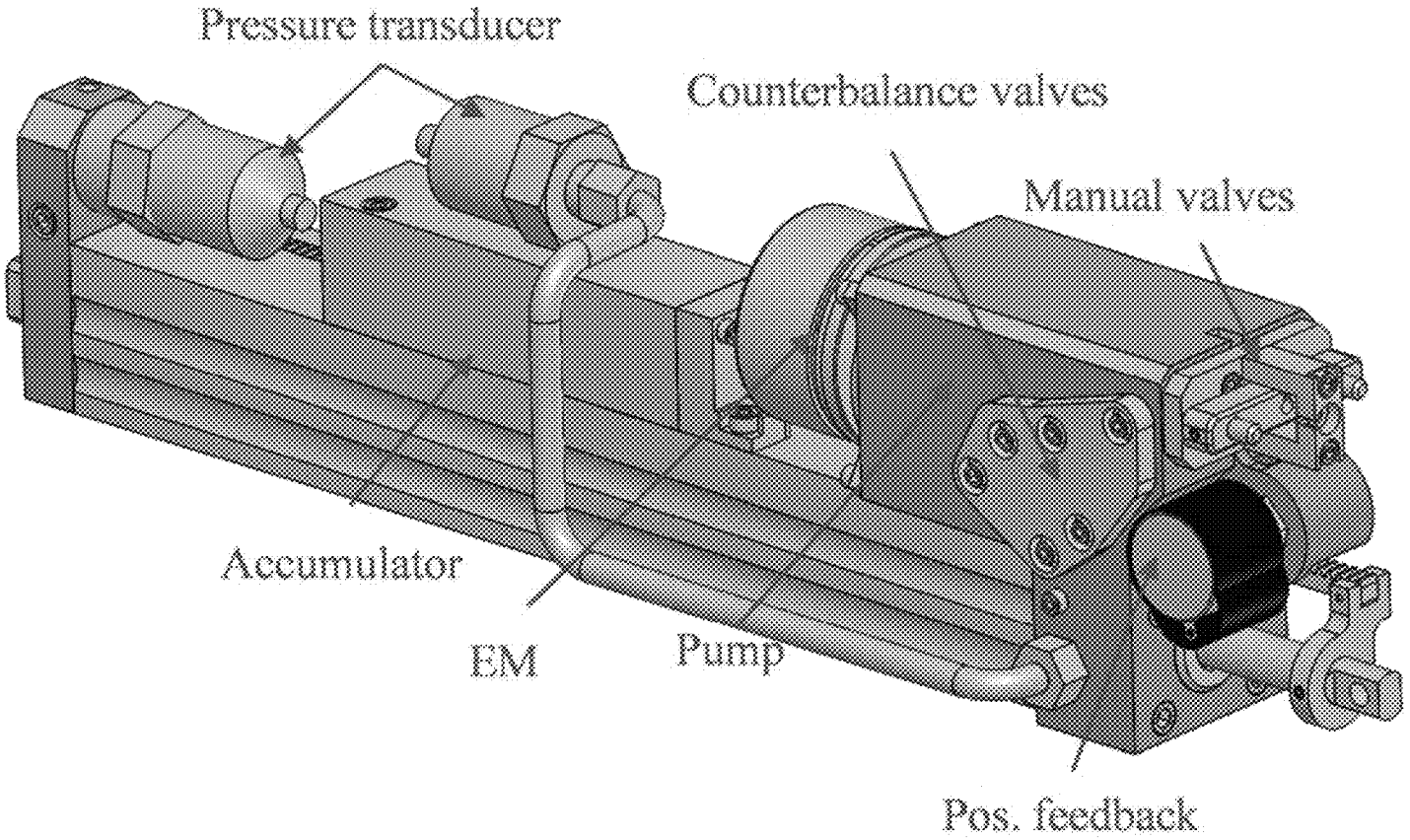
FIG. 30B shows a 3-D view of the EHA re representative of the schematic of FIG. 29 according to yet another embodiment of the present invention.
Figure 31:
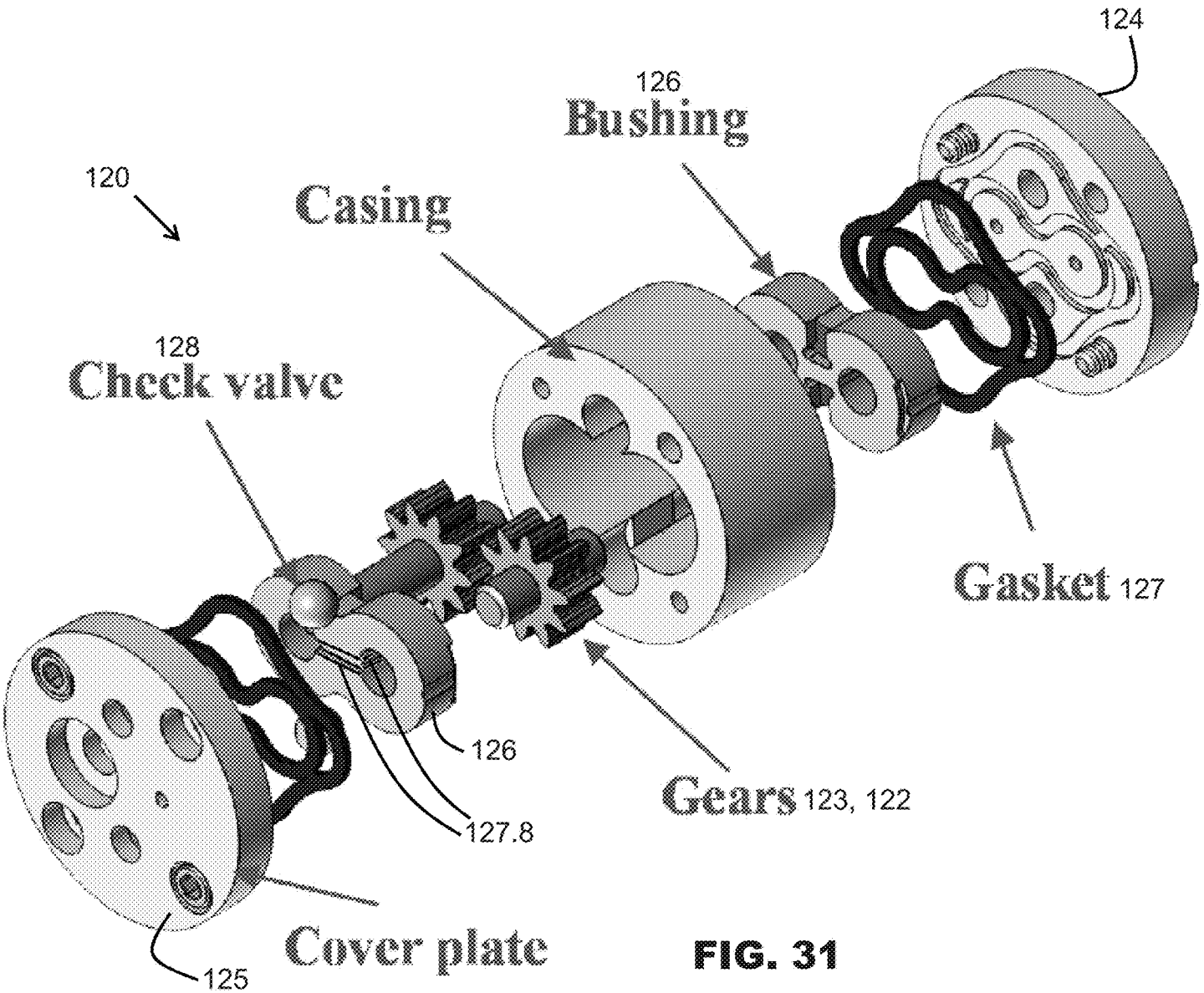
FIG. 31 shows an exploded view of the pump according to another embodiment of the present invention.

The EHA system of FIGS. 29, 30A and 30B include a gear pump, visible in FIG. 31. Lateral bushes serve as sealing elements to minimize leakages at gears lateral side. The bushes also include the journal bearings to provide support to the gear shafts. As it can be noticed from the figures, the check valves CV1 and CV2 of FIG. 29 are included in the casing.

In some embodiments, the lateral bushes include recesses at gears side. These grooves permit a useful timing of the connections between the displacement chambers (the tooth space volumes) and the inlet/outlet ports. The design allows a smooth meshing process with volumetric efficiency and low fluid borne noise.

In still further embodiments, the bushes are designed to improve the radial balance of gears. A proper design of the lateral bushes can affect the pressurization of the tooth space volumes during the rotation of the gears. Consequently, the lateral bushes can lead to reduced and radial forces acting on the gears, with limited dependency on shaft speed.

In still further embodiments, the pump design benefits with improved axial balance by the lateral bushes. The tendency of increased leakages at high operating pressures at gears lateral sides can be reduced by controlling the lubricating gap height between gears and bushes. In pressure compensated designs, this is achieved through the floating bushes, which permit optimal lubricating flow conditions with absence of metal-to-metal contacts.

Figure 32A:
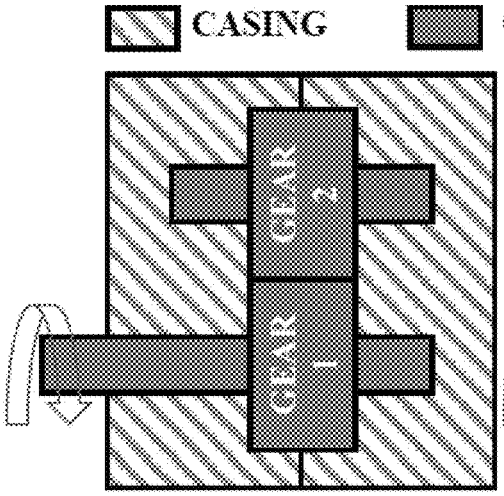
FIG. 32A shows a pump without pressure compensation architecture according to one embodiment of the present invention.
Figure 32B:
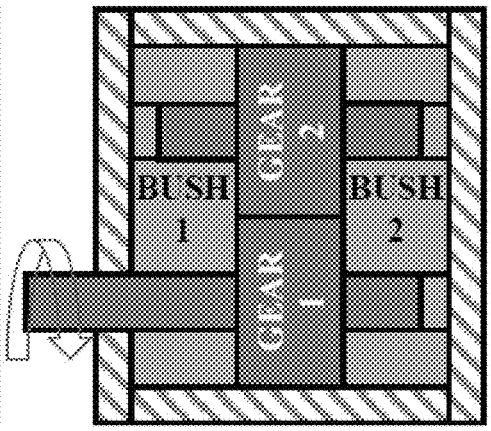
FIG. 32B shows a pump with pressure compensation according to one embodiment of the present invention.

The principle of gap compensation at the lubricating interface at gears lateral side is depicted in FIGS. 32A and 32B. Without axial compensation (FIG. 32A) the laminar lubricating gap flow increases with the operating pressure. The increment of the gap height due to material deformation enhances the dependency of the leakage flow with pressure. In the pressure compensated design (FIG. 32B), floating elements (lateral bushes) permit to achieve reduced gap height at all operating conditions. Essentially, the principle of pressure compensation (also referred to as axial balance, hereafter), includes in establishing a proper static pressure region at the face opposite to the gears that can balance the pressure forces resulting from the gear side (given by the pressure of the tooth space volume and in the lubricating gap flow region). During the operation of the pump, the lateral bush will work in a balance condition. Full film lubricating conditions with minimum gap height are established, permitting minimum power loss due to shear and to volumetric flow losses.

Figure 33A:
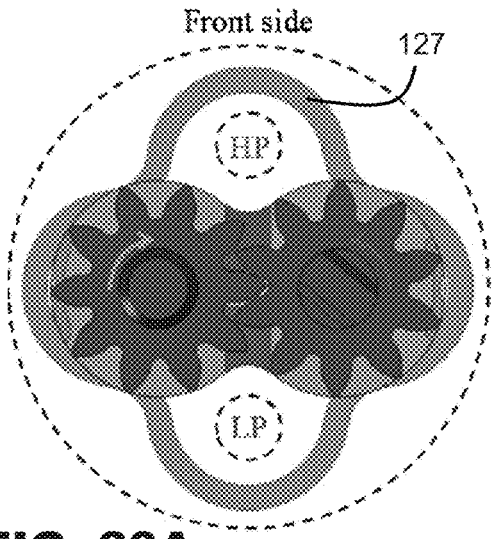
FIG. 33A shows a front side with gear and pressure distribution in the TSV.
Figure 33B:
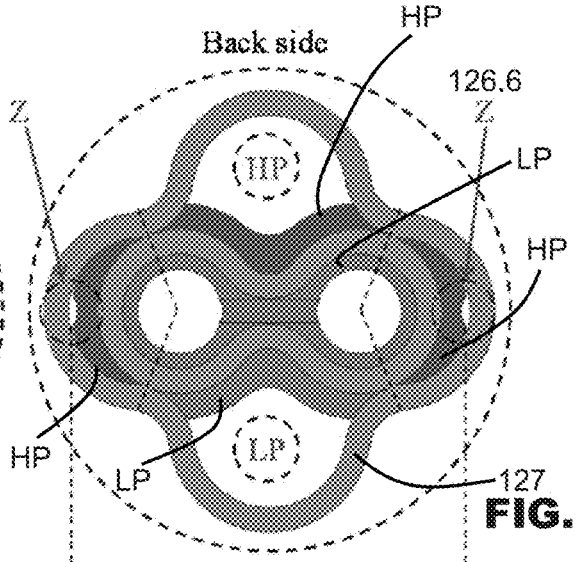
FIG. 33B shows a back side of balance side.
Figure 33C:
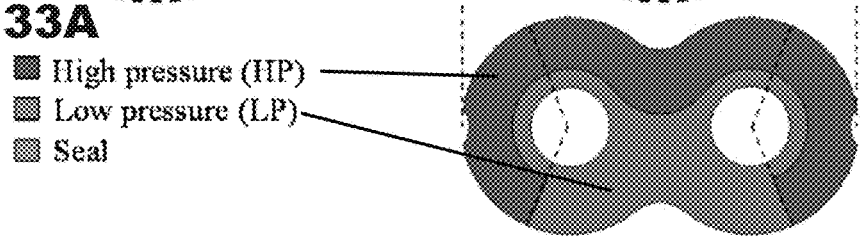
FIG. 33C shows the HP balance area and LP area.

In some embodiments, there are gaskets located at the cover plates (FIG. 31) to define the area of pressure compensation at the lateral bush. The design details are depicted in FIGS. 33A and 33B. FIG. 33A shows the side of the bush facing the gear, and it qualitatively shows the pressure field in the Tooth Space Volumes (TSVs) during the rotation, while FIG. 33B) shows the opposite side of the bush that faces away from the gears. The sealing system permits to establish a pressure field as shown in FIG. 33B. While the low pressure and high pressure values are directly defined by the inlet/outlet connections to the tank and to the actuator realized by proper holes in the pump covers (top and bottom region in FIG. 33B); the central regions (left and right in FIG. 33B) are set at high pressure by the connections realized by the lateral bushes at the two extreme left/right sides of the figure (connection or groove Z, in FIG. 33B). Due to the radial balance features of the unit, described afterwards, these connections are always at high pressure independently of the direction of the gear's rotation.

Figure 34A:
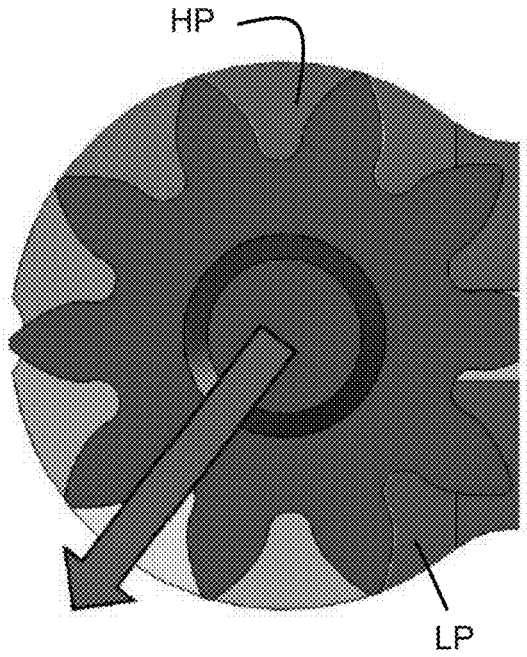
FIG. 34A shows TSV pressurization without HSG.

The pressurization of the TSVs during gear rotation determines the radial forces acting on the gears as shown in FIG. 34A. Supposing a constant clearance between tooth tip and casing during the rotation, a gradual pressurization can be assumed (FIG. 34A). However, due to the hydrodynamic features of the journal bearings used to support the shaft, the actual location of the gear axis of rotation will depend on the resultant force acting on the gears and on shaft speed. The actual location of the gear axis determines a non-constant condition for the height of the gap at tooth tip. The radial motion of the gears can determine an initial wearing of the internal case profile; moreover, the TSV pressure distribution shows sudden changes in pressure, highlighting how the radial sealing of the TSVs is realized in a localized area of the casing. In order to reduce the variation of the gears radial motion with working pressure and speed, a pump according to one embodiment of the present invention includes the connections shown in FIGS. 35A and 35B.

Figure 34B:
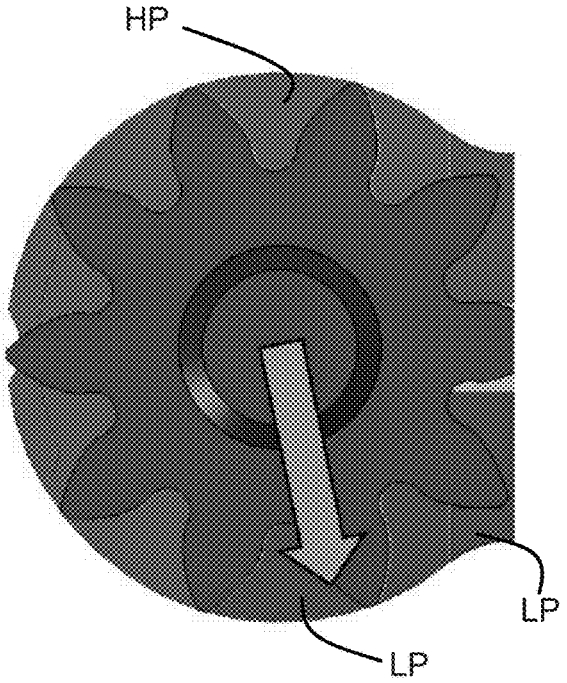
FIG. 34B shows pressurization with HSG.
Figure 35A:
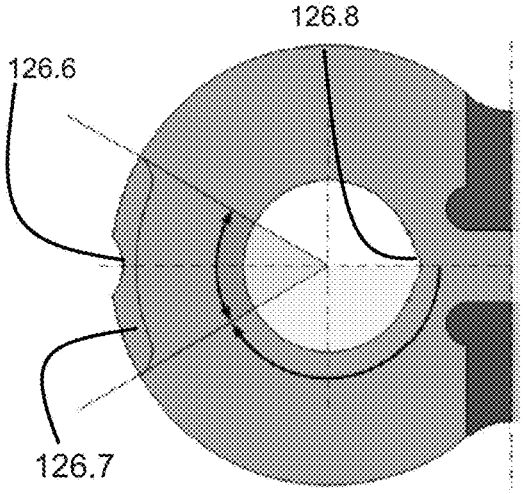
FIG. 35A shows HSG design angles.
Figure 35B:
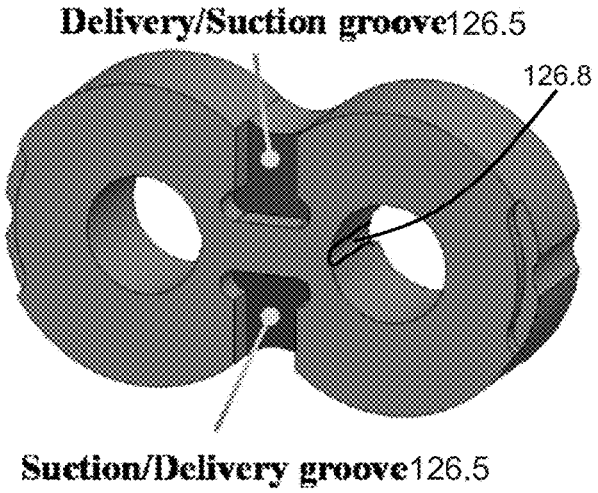
FIG. 35B shows bush with grooves.

With the additional connection of FIG. 35A, it is possible to establish a TSV pressure distribution as shown in FIG. 35B independently of the operating conditions of the unit. As it can be noticed from FIG. 34B, a proper design of this additional connection can be beneficial to reduce the intensity of the radial force and to avoid the gears to separate with pressure.

Grooves machined at the lateral bushes near the meshing zone of the gear can affect the displacing action of the positive displacement machine. One function of these grooves is to permit a communication between the TSVs and the outlet (when the volume is decreasing) and the inlet (when the volume increases) which is otherwise trapped between the points of contact between the two gears. These grooves can help provide the complete usage of the volumetric capacity of the unit. Various embodiments of the pumps shown herein address an absence of cross-port flow between inlet and outlet (this bypass flow would reduce the volumetric efficiency) but also limit localized pressure peaks or cavitation. The inlet/outlet groove profile influences the instantaneous delivery flow, and consequently the fluid borne noise generation. For these reasons, these grooves are useful to determine the efficiency and noise performance of the pump.

A pump according to one embodiment of the present invention was simulated by employing the tool HYGESim tool (HYdraulic GEar machines Simulator). HYGESim is a multi-domain simulation model for the detailed analysis of external GMs. The major sub-models of HYGESim are shown in FIG. 36: firstly, a geometrical model evaluates all the geometrical features required by the two fluid dynamic models starting directly from the CAD drawings of the unit. Secondly, a lumped parameter fluid dynamic model is implemented within the commercial AMESim simulation environment to simulate the main flow through the unit. Although use of the HYGESim tool is being shown and described, it is understood that various embodiments of the present invention are not constrained to use of this tool, and can be developed using any computer tools or design tools.

The main flow through the unit results from the detailed simulation of the displacing action realized by the pump.

This is performed according to a control volume lumped parameter approach which evaluates the flow through the displacement chambers (the TSVs) and the inlet/outlet port. This evaluation is carried out according to the build-up equation (2-1):

$$\frac{dp_i}{dt} = \frac{1}{V_i}\frac{dp}{d\rho}\bigg|_{p=p_i} \cdot \left[\sum \dot{m}_{in,i} - \sum \dot{m}_{out,i} - \rho\bigg|_{\rho=\rho_i}\left(\frac{dV_i}{dt} - \frac{dV_{var,i}}{dt}\right)\right] \quad (2\text{-}1)$$

The term within the rectangular brackets in eq.(2-1) represents the flow rate of fluid entering and exiting the considered TSV (CV). In particular, the terms Vi correspond to the instantaneous volume of the $i^{th}$ CV as the volume continuously changes to achieve the displacing action. The term $V_{var,i}$ takes into account the additional variable volume which occurs at the suction and the delivery due to the nature of definition of the $i^{th}$ CV during the rotation of the gears.

Particularly, the turbulent flow orifice equation as shown in eq.(2-2) is used for calculating the flow both between the interacting TSVs and between the TSVs and the suction and delivery ports.

$$\dot{m}_{i,j} = \frac{(p_i - p_j)}{|(p_i - p_j)|}\bigg|_{p=\overline{p_{i,j}}} \cdot \alpha \cdot \Omega_{i,j} \cdot \sqrt{\frac{2\cdot(p_i - p_j)}{\rho|_{p=\overline{p_{i,j}}}}} \quad (2\text{-}2)$$

The tooth tip leakages between adjacent TSVs have been accounted using the modified Poiseuille's equation as shown in eq.(2-3):

$$\dot{m}_{i,j} = \rho\left[-\frac{h^3}{12\mu}\frac{(p_i - p_j)}{L} + \frac{u}{2}\right]\cdot b \quad (2\text{-}3)$$

A detailed procedure for evaluating the radial gap height, h, is implemented in HYGESim taking into account the balance of the forces acting on the gears.

The geometrical model carefully evaluates all the geometrical terms of eqs. (2-1), (2-2) and (2-3) as a function of the instantaneous angular position of the gears and as a function of the radial micro-motions of the gears.

The fluid dynamic model includes an accurate evaluation of fluid properties: the density and the bulk modulus as a function of pressure and temperature. In particular, the model for the evaluation of fluid properties also considers the effects of air release with a static model based on the Henry's law, utilized to evaluate the instantaneous undissolved air content as a function of fluid pressure.

As shown in FIG. 36, a Fluid Structure Interaction (FSI) model is used to solve the lateral leakage flows, providing also the lateral leakages. In particular, a C++ model based on Open-Foam libraries solves the two dimensional gap flow into the lateral lubricating gap. The lateral gap leakage flow is evaluated based on the Reynolds equation—as shown in eq.(2-4)—in its complete formulation that also keeps into consideration the hydrodynamic lubrication terms:

$$\nabla\cdot\left(\frac{-\rho\cdot h^3}{12\mu}\cdot\nabla p\right) + \frac{\rho\cdot\nabla h}{2}\cdot(V_t + V_b) - \rho\cdot V_t\cdot\nabla h + \rho\cdot\frac{\partial h}{\partial t} = 0 \quad (2\text{-}4)$$

From eq.(2-4) it is possible to notice how hydrodynamic terms due to physical wedge (caused by deformation or tilt between lateral bushes and gears) or to squeeze (caused by relative motion between the surfaces that induces changes in gap heights) are represented in the model.

The elastic deformation of the casing and the gears were calculated by solving eq.(2-5), $$\frac{\partial^2(\rho w)}{\partial t^2} - \nabla\cdot[(2\vartheta + \lambda)\nabla w] - \nabla\cdot[\vartheta(\nabla w)^T + \lambda I tr(\nabla w)] - [(\vartheta + \lambda)\nabla w] = \rho f \quad (2\text{-}5)$$

Since the effects of structural deformations are significantly important in defining the features of the lateral gap, the CFD model is coupled with a Finite Volume Model (FVM) to solve the complete FSI problem that characterizes this lubricating gap.

The evaluation of pressure inside the gap considering the material deformation, according to eqs. (2-4) and (2-5) is then used to solve the axial balance of the lateral bushes, which determines their instantaneous position. This evaluation is performed on the basis of a balance of all the pressure forces acting on the two sides of each bush, which permits to define the instantaneous squeeze terms (thus the instantaneous motion) of the bushes.

Pumps according to various embodiments of the present invention may include any or all of the following aspects:

Maximize volumetric efficiency (OF1). The volumetric efficiency is defined by:

$$\eta_v = \frac{Qa}{Qth} = \frac{Qa}{V_{th}n} \quad (2\text{-}6)$$

The theoretical displacement is a function of the geometrical input parameters, and it can be evaluated by using the following formula:

$$V_d = 2\cdot\pi\cdot d\left(R_o^2 - R_b^2\left(1 + \frac{\pi^2\cdot\cos^2\alpha}{3\cdot z^2}\right)\right) \quad (2\text{-}7)$$

Minimize the internal pressure peak (OF2). During the meshing process, internal pressure peaks can arise due to the sharp decrease in the volume in combination with a too limited restriction of the flow through the output groove machined on the lateral bush (FIG. 35B). An example of pressure peak is shown at the top left of FIG. 40. In particular, that figure shows the pressure of a reference TSV of the driver gear for a design solution involving an excessive pressure overshoot. The objective function for the pressure peak is reported as follows:

$$OF2 = \frac{p_{peak} - \overline{p}_{out}}{\overline{p}_{out}} \quad (2\text{-}8)$$

Minimize localized cavitation (OF3). With a mechanism similar to the above described generation of internal pressure peaks, an excessive depressurization of the TSV can occur as a consequence of a rapid increase in volume combined with an excessive restriction of the communication between the volume and the inlet port. This localized cavitation is a specific feature of the meshing process, and it should not be confused with an overall cavitating condition for the pump. The TSV, as a matter of fact, can complete its filling process after the meshing process, when a connection with the inlet port still exists. The localized cavitation, however, can induce erosion and noise emission, and therefore it should be limited as much as possible.

Figure 40:
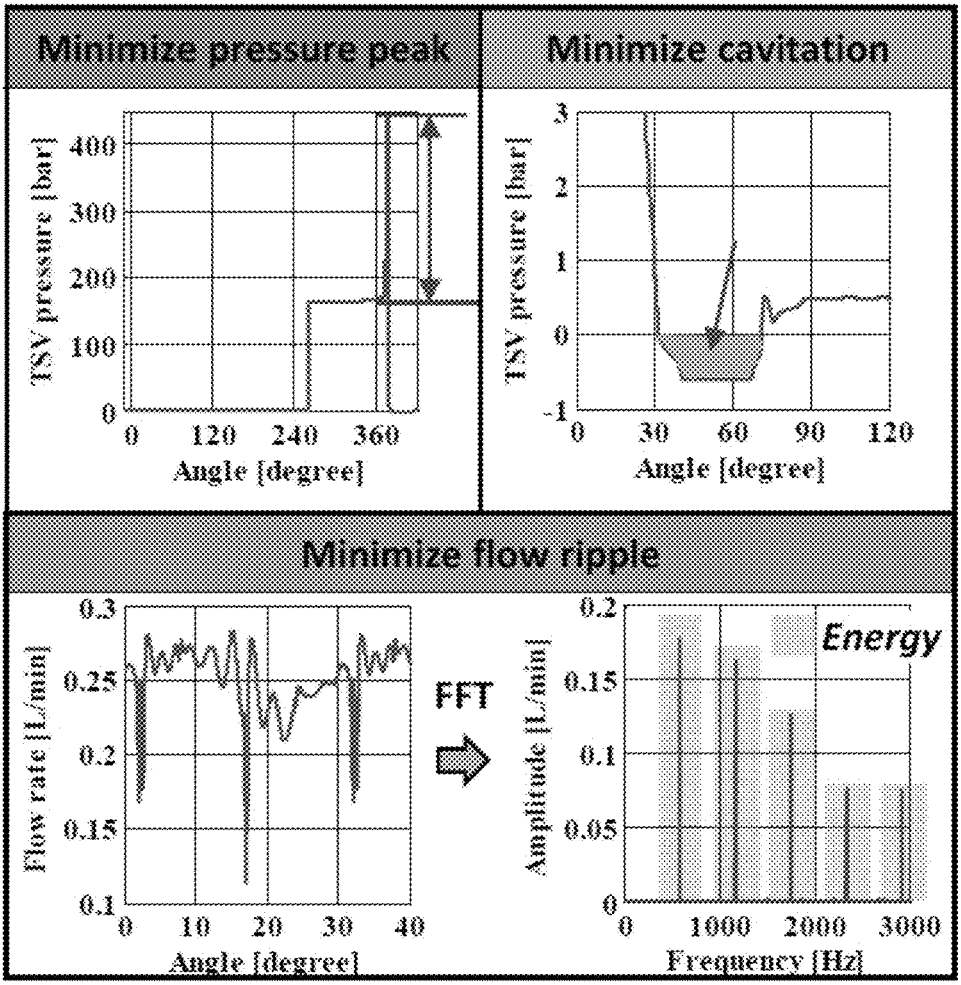
FIG. 40 is a graphical representation of objective functions.

In this study, the localized cavitation is defined as the area of negative TSV pressure, as shown at the top left of FIG. 40 (which reports a detail of the top left of FIG. 40).

Minimize outlet flow ripples (OF4). For positive displacement machines, outlet flow oscillations are considered as main source of noise (fluid borne noise). For this reason, the instantaneous flow oscillations have to be reduced, if the aim is to achieve a low noise emission unit. In this research, the quantification of the flow oscillations follows a method similar to the one proposed by Vacca et al. The method is graphically represented at the bottom of FIG. 40: from the FFT of the instantaneous flow rate, the total energy associated with the intensity of each harmonic term is minimized.

Figure 39:
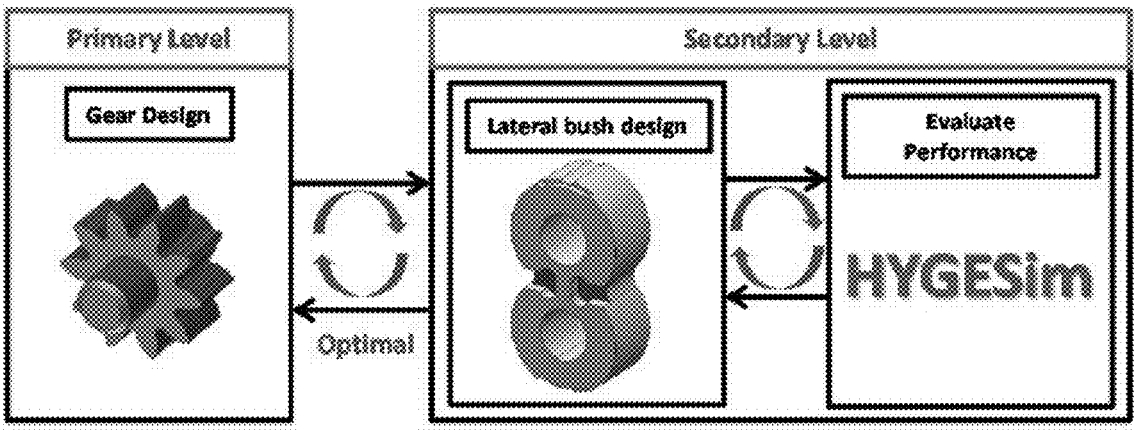
FIG. 39 shows two level optimization.

The optimization workflow can be schematically represented by FIG. 39. In particular, there are two levels of design generation: the primary level pertains to the gear geometry, while the second level serves to evaluate the best geometry of the lateral bushes grooves. In this way, for each gear considered by the optimizer, multiple lateral bush designs are analyzed to identify the best groove configuration associated with that particular gear geometry.

In the generation of each geometry, the optimization involves specific check routines to verify the feasibility of each considered design, and reject unfeasible designs. Unfeasible designs include design which do not pass meshing constraints such as interference or insufficient contact ratio, or manufacturing constraint such as excessive pointed teeth.

A multi-objective optimization algorithm was used to execute the optimization procedure of FIG. 39. The optimization workflow was implemented in ModeFrontier, involving HYGESim, and other post processing software (Excel, Matlab) for the evaluation of each OFs. A total number of 68 gears where simulated, for a significantly larger amount of HYGESim simulations involved to execute also the secondary level of the optimization procedure.

TABLE 1-2

Design Variable for the Gear

| Symbol | Description | Unit |
|---|---|---|
| m | Normal module | mm |
| z | Number of teeth | — |
| $h_{ap}$ | Addendum coefficient | — |
| $h_{fp}$ | Dedendum coefficient | — |
| $P_{fp}$ | Fillet radius | — |
| α | Pressure Angle | ° |

The results of the optimization procedure can be summarized by the parameters of Table 2-2 and by the images of FIGS. 31, 33A, 33B, 35A, and 35B of the previous sections, which depicts images of the final proposed design.

TABLE 2-2

Optimized parameters

| Gear parameters | Value | Groove parameters | Value |
|---|---|---|---|
| m [mm] | 1.078 | VD = VA [mm] | 4.75 |
| z | 10 | RD = RS [mm] | 0.625 |
| $h_{ap}$ | 0.586 | HS = HD [mm] | 1.35 |
| $h_{fp}$ | 1.378 | | |
| $P_{fp}$ | 0.3 | | |
| α | 25.44 | | |

Once the design of the gears and of the grooves on the lateral bushes is defined by the optimization procedure, the design aspects related to the balancing of the pump can be determined.

Figure 41A:
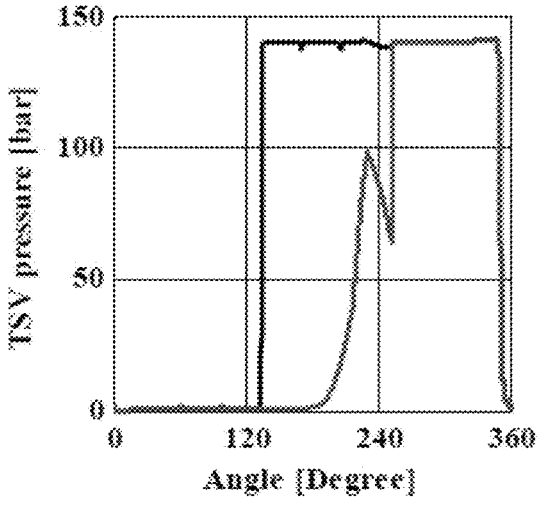
FIG. 41A is a graphical representation of TSV.
Figure 41B:
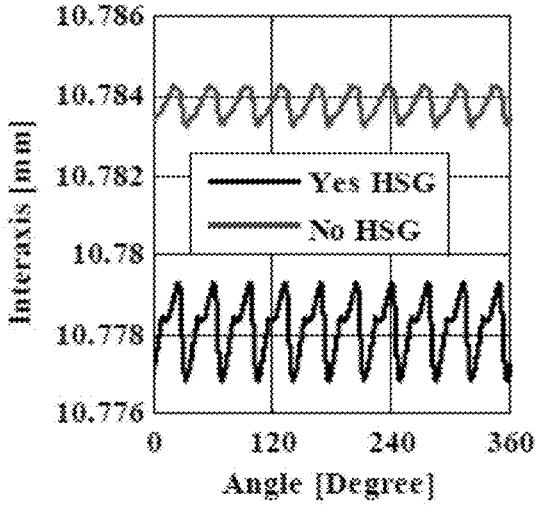
FIG. 41B is a graphical representation of interaxis comparisons with and without grooves @140 bar and @3500 rpm.

As pertains to the radial balancing obtained with the grooves of FIG. 34B, the positive effects introduced by these grooves can be described with FIGS. 41A and 41B. FIG. 41A shows the simulated TSV pressure for the optimized pump with and without the introduction of the additional grooves of FIG. 35A. An early pressurization is realized at a predetermined angular position of the gear, independently of the operating condition. A reduction in radial force intensity is obtained as well as a more convenient direction of such force, which positively tends to decrease the gear interaxis distance (FIG. 41B).

Figure 42:
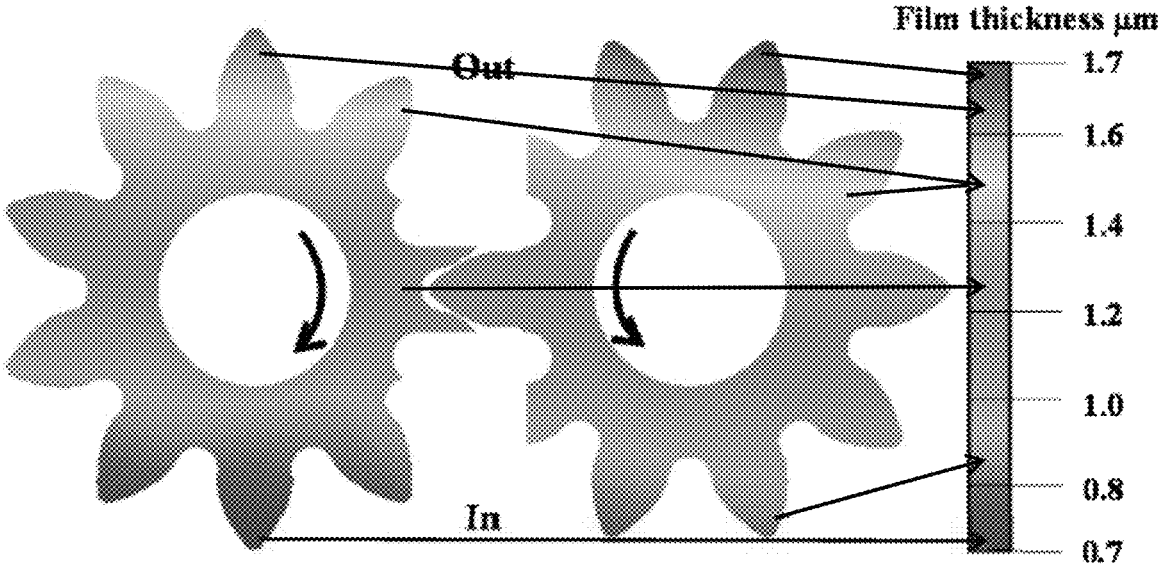
FIG. 42 shows lateral gap evaluation @60 bar delivery pressure and 500 rpm.
Figure 43:
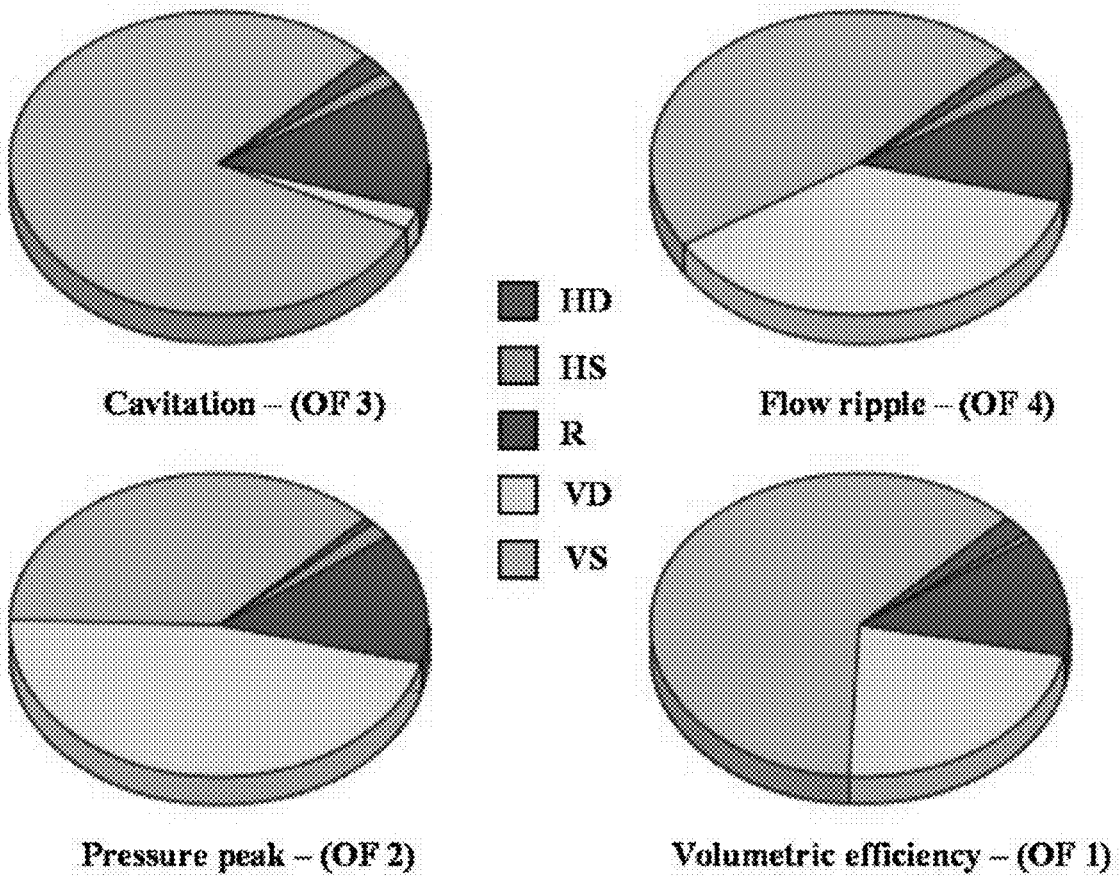
FIG. 43 shows pie charts showing the influence of the parameters.
Figure 44:
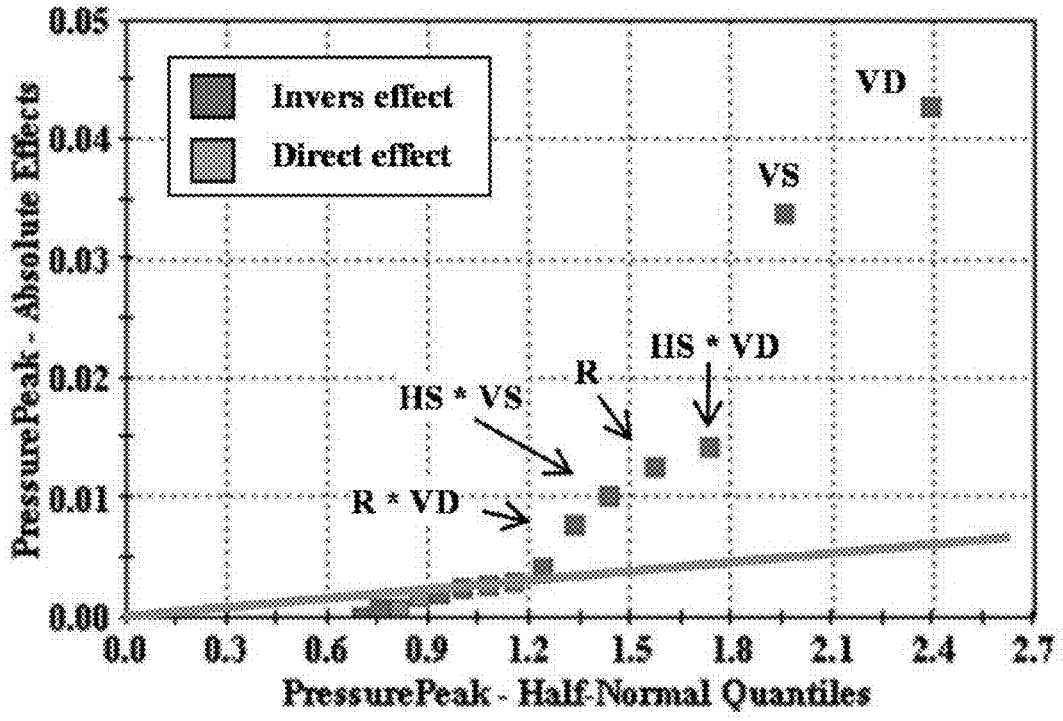
FIG. 44 is a graphical representation of half normal plot for the pressure peak.
Figure 45:
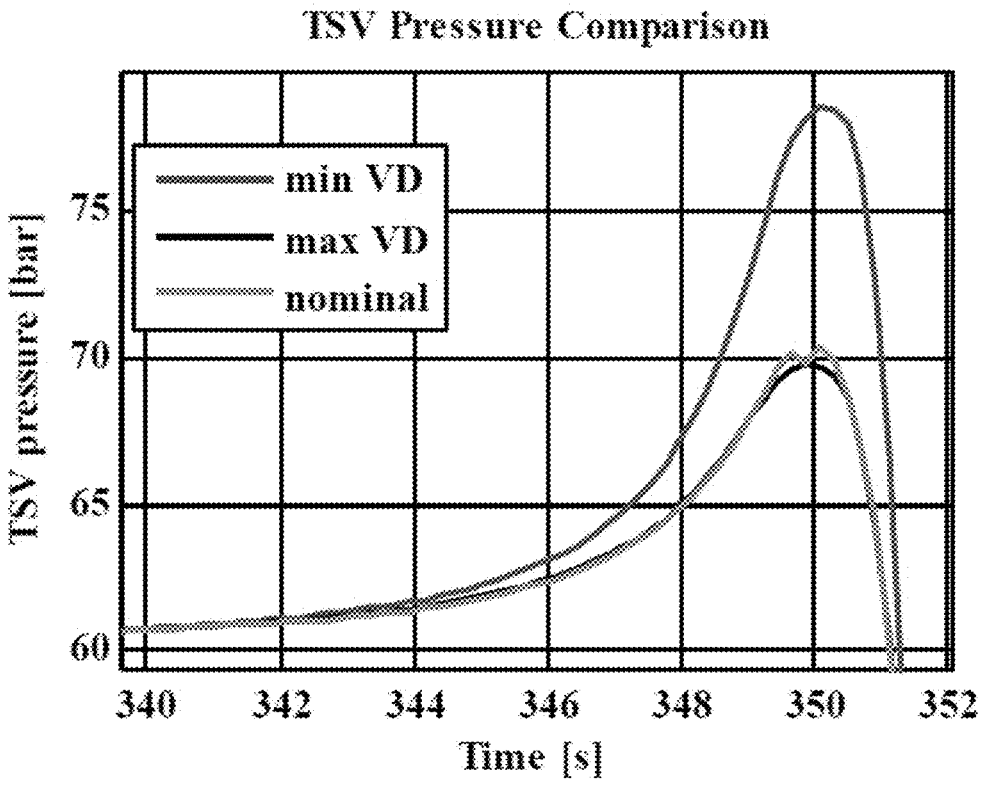
FIG. 45 is a graphical representation of pressure peak as a function of the tolerance range.

The balance areas of FIGS. 33A and 33B were established in one embodiment to provide a lubricating gap flow between the gears and the lateral bushes. The proposed design provides a film for pressures up to 140 bar within the speed interval of 2000-3500 rpm. FIG. 42 shows an example of gap thickness evaluation. The lateral bushes operate with a certain tilt with respect to the gears, with minimal gap heights, but still sufficient to satisfy full film lubrication regime without contacts between the components. Similar results were obtained for other operating conditions within the typical region of operation of the unit.

The optimization workflow of FIG. 39 can be utilized to perform tolerance analyses, evaluating the trend of each objective function (OF) with respect to the tolerance level assigned to each input parameter. For this study, a Monte Carlo sampling was used to generate designs within the tolerances summarized in Table 2-3 according to a stochastic distribution representative of a realistic machining production process. As one can note from Table 2-3, the parameters of the grooves (FIG. 38) were considered in this study. Table 2-3 shows the tolerance range for each parameter and the standard deviation assuming a tolerance interval equal to 3 σ (99.74%) of a normal distribution.

TABLE 2-3

Tolerance range and standard deviation for the parameter describing the shape of the grooves

| Parameters | Tol. Range: ±Δ [mm] | Std. Deviation |
|---|---|---|
| HD | 0.01 | 0.0033 |
| VD | 0.04 | 0.0133 |
| HS | 0.01 | 0.0033 |
| VS | 0.04 | 0.0133 |
| R | 0.005 | 0.0017 |

For each of the previous parameters a normal distribution generated with the standard deviation of Table 2-3 has been generated according to the Monte Carlo method of study. The simulation of each sample permits a proper post processing aimed to show the relative effect of each single tolerance on the performance of the pump. A specific operating condition (n=3500 r/min, p=60 bar) was considered for this analysis. The relative influence of each parameter of Table 2-3 on every OF is reported in FIG. 43.

Mutual interactions between the tolerances appear when the tolerance analysis is performed weighting the effects of each parameter on the bases of its tolerance interval. This approach can be useful to understand which factors (including main effects and interactions) are important and which are unimportant. The half-normal probability plot of FIG. 44 reports, for the case of OF2 (pressure peak), the results of this additional analysis.

The plot confirms the effect of parameters VD and VS (points which lie far from the green line), but mutual interaction between HS and VD, and HS and VS is also present as well as the single parameter R.

Figure 46B:
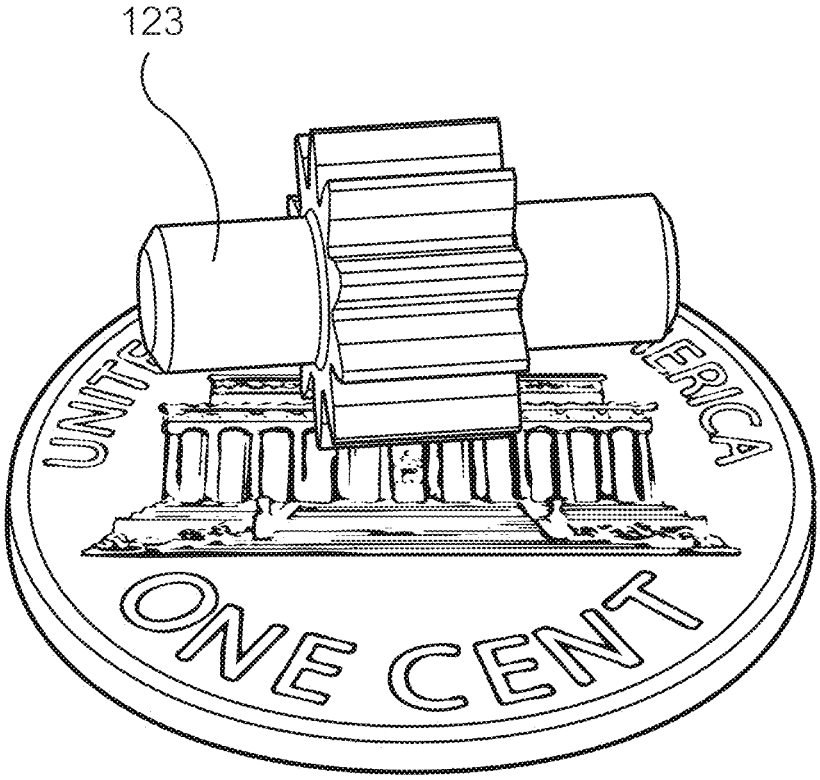
FIG. 46B is a line drawing of a photograph showing the gear of a pump.
Figure 47:
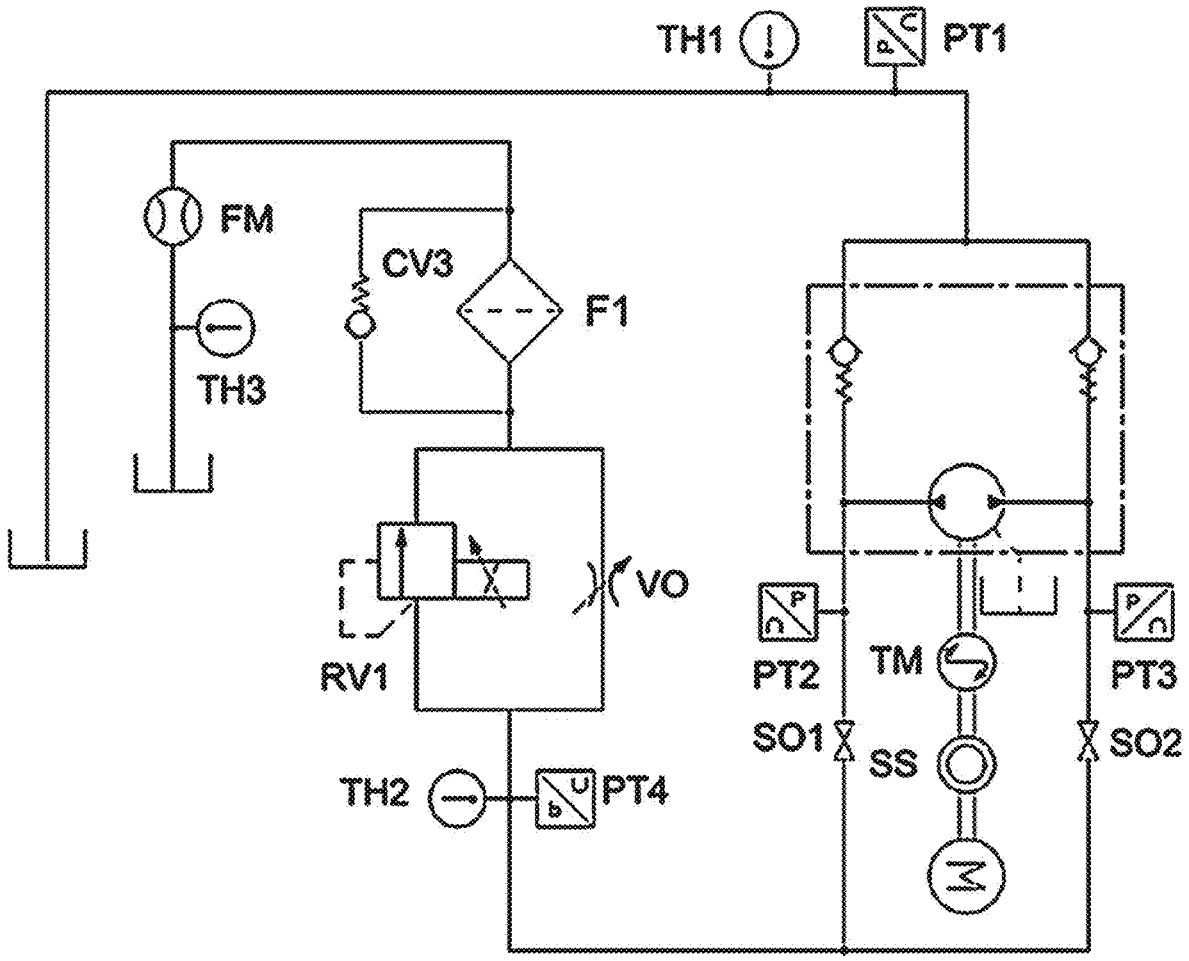
FIG. 47 shows an ISO schematic of a test rig.
Figure 48:
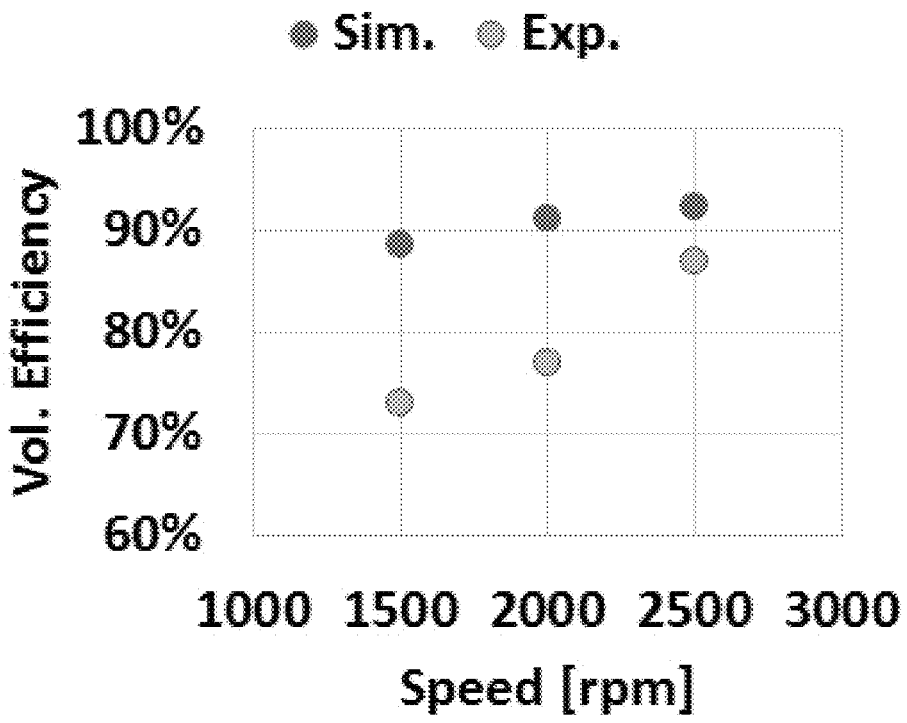
FIG. 48 shows a comparison of simulation and experimental results as a function of speed.
Figure 49:
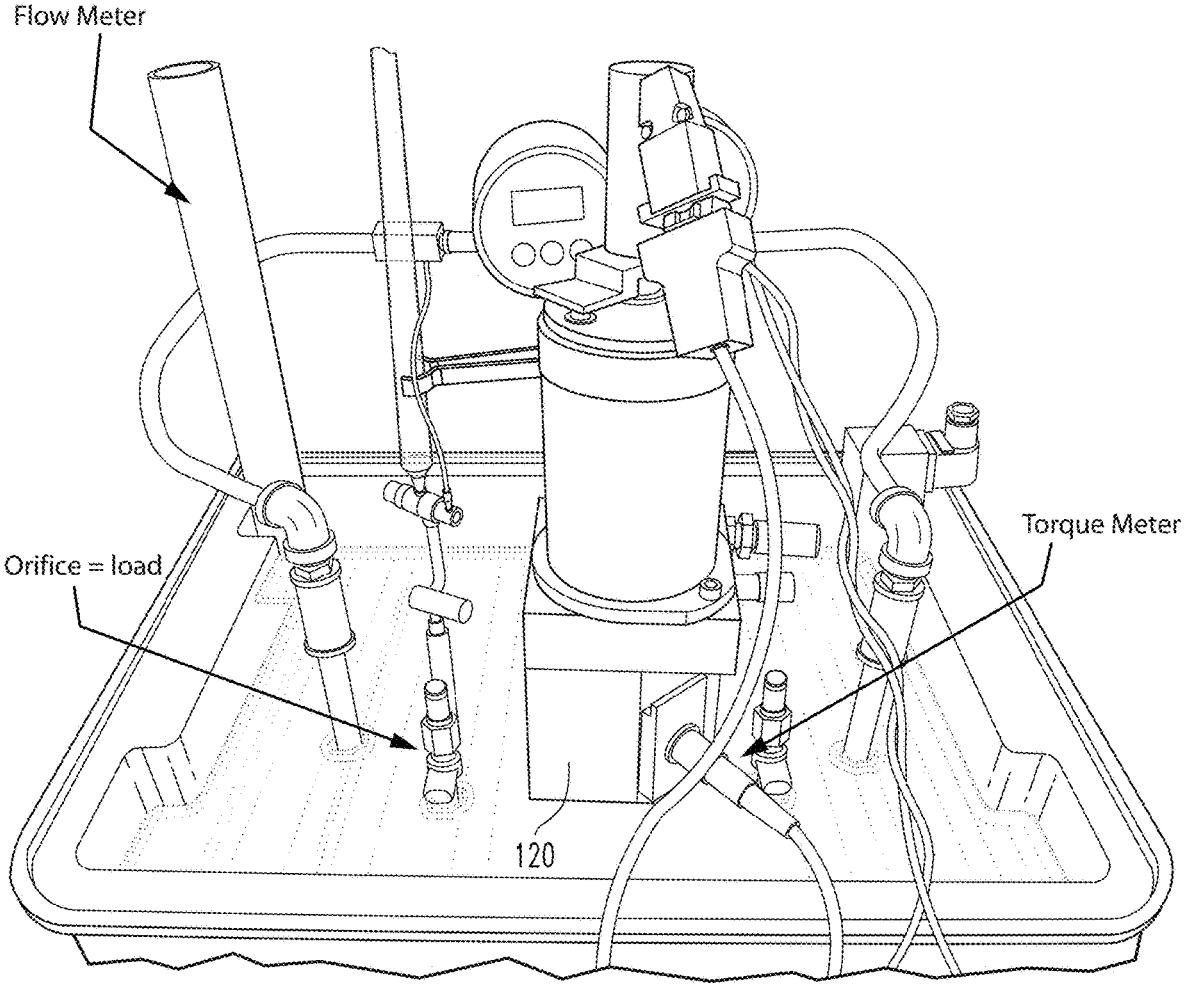
FIG. 49 is a line drawing of a photograph of the test rig.
Figure 50:
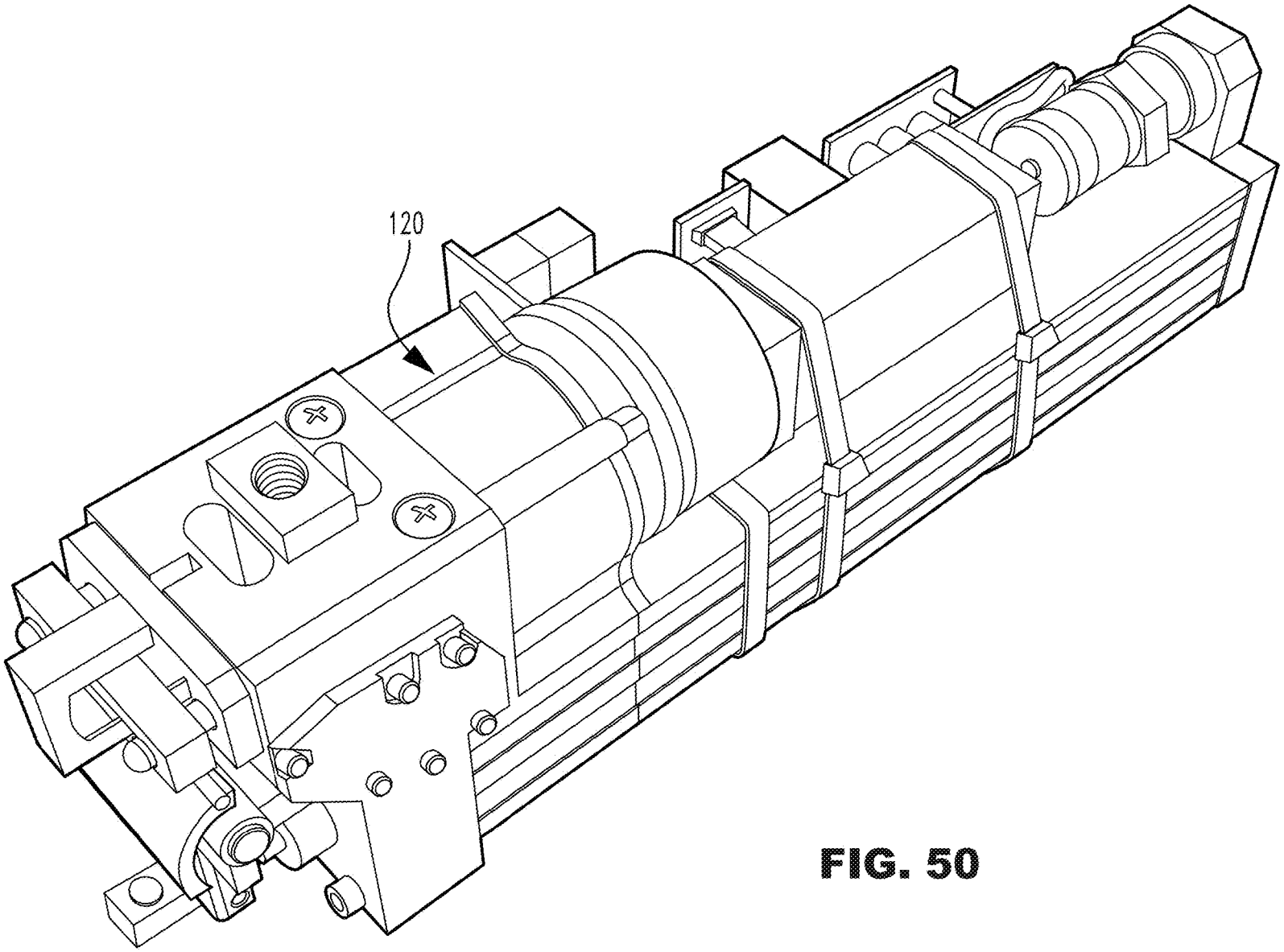
FIG. 50 is a line drawing of a photograph showing an electrohydraulic actuation system according to another embodiment of the present invention.

A miniaturized pump according to one embodiment was realized and tested. FIGS. 46A and 46B show the pump ensemble and the detail of the slave gear. The test rig used to perform the pump characterization is represented with the ISO schematic of FIG. 47. Pictures taken during the tests are in FIG. 49. The test rig setup is made of an electric motor that drives the pump. On the same shaft a tachometer SS to measure the speed as well as a torque meter TM are installed. Both at the delivery/suction ports pressure transducers (PT1, PT2, PT3 and PT4) are used, while at the delivery port a flow meter is installed. Temperature sensors TH1, TH2 and TH3 are also present to measure the temperature increase for the flow through the pump. Shut-off valves SO1 and SO2 are necessary in order to test the pump in both rotation directions. A variable orifice (VO) is used to load the pump at the desired pressure level; while the relief valve RV1 prevents excessive system pressurization. FIG. 49 shows a comparison between the measured and predicted as a function of speed. From the figure it is possible to notice the good agreement between the measured data and the predictions, highlighting the potential of the design procedure described in this paper. The pump was successfully installed in the system of FIGS. 29, 30A and 30B, and FIG. 50 depicts a picture of the complete compact EHA assembly.

Various aspects of different embodiments of the present invention are expressed in paragraphs X1, X2, X3, and X4 as follows:

X1. One aspect of the present invention pertains to an apparatus for pumping fluid. The apparatus preferably includes a pair of rotatable intermeshed gears. The apparatus preferably includes a pair of substantially identical bearing blocks, the bearing blocks supporting the gear pair being located between said bearing blocks, each bearing block having a face opposite of said gear pair that includes first and second channels, each said channel being in fluid communication with portions of said gear pair that are intermeshed. The apparatus preferably includes a pair of cover plates, each said cover plate including a face seal for providing a flow-discouraging seal against a corresponding face of a bearing block, said cover plates including a first fluid port in fluid communication with the first channel and a second fluid port in fluid communication with said second channel; wherein said gear pair and said bearing blocks are adapted and configured to provide higher pressure fluid from said first port for rotation of said gear pair in a first direction, and to provide higher pressure fluid from said second port for rotation of said gear pair in a second direction opposite of the first direction X2. Another aspect of the present invention pertains to an apparatus for pumping fluid. The apparatus preferably includes a pair of rotatable intermeshed gears. The apparatus preferably includes a pair of bearing blocks, each bearing block including a pair of journal bearings, each journal of a bearing block supporting a corresponding shaft of said gear pair, said gear pair being located between said bearing blocks, each said bearing block includes opposing faces separated by a width, one said face of each said block being opposite of said gears. The apparatus preferably includes a pair of cover plates, each said cover plate being opposite of the other said face of a corresponding bearing block, each said cover plate including a face seal for providing a flow-discouraging seal against a corresponding face of a bearing block, wherein the one face of each said block is separated from the other said face of the same said block by a width, each said block including a fluid flow duct across the width providing fluid communication between the one face and the other face of each said block, and each said one face opposite of said gears includes a peripheral channel providing fluid communication from said one face opposite of said gears to the fluid flow duct.

X3. Yet another aspect of the present invention pertains to a hydraulic fluid actuation system. The system preferably includes a reversible hydraulic fluid gear pump having first and second ports, wherein rotation of said gear pump in a first direction provides pressure to the first port and suction to the second port, and rotation of said gear pump in a second, opposite direction provides pressure to the second port and suction to the first port. The system preferably includes an actuator including a cylinder having an internal volume, an internal piston, and a rod attached to said piston and having an end extending out of the cylinder, said piston dividing the internal volume into first and second chambers. The system preferably includes a first counterbalance valve having a third port in fluid communication with the first port and a fourth port in fluid communication with the first chamber. The system preferably includes a second counterbalance valve having a fifth port in fluid communication with the second port and a sixth port in fluid communication with the second chamber.

X4. Still another aspect of the present invention pertains to an apparatus for pumping fluid. The apparatus preferably includes a pair of rotatable intermeshed gears, each gear including a shaft, each gear being located along the corresponding shaft, said gear pair being adapted and configured to simultaneously provide fluid at a higher pressure and fluid at a lower pressure. The apparatus preferably includes a pair of substantially identical bearing blocks, each bearing block including a pair of journal bearings, each journal of a bearing block supporting a corresponding shaft of said gear pair, said gear pair being located between said bearing blocks. The apparatus preferably includes a casing defining an interior cavity that contains said gears and said bearing blocks, said casing having a pair of opposing end faces. The apparatus preferably includes a pair of cover plates, each said cover plate having a face (R1, R6) being opposite of a face (R2, R5) of a corresponding bearing block. The apparatus preferably includes a pair of face seals, each said face seal having an outer periphery located between one said cover plate and a corresponding end face and an inner periphery located between said same cover plate and a corresponding bearing block, the area between the inner periphery and the outer periphery being divided into first and second lateral regions (A, C) each being laterally adjacent and outboard of the gear pair and two end regions (B, D) each being outboard of a single corresponding gear of said pair; wherein rotation of said gear pair in a first direction provides higher pressure fluid to the first lateral region and lower pressure fluid to the second lateral region, and rotation of said gear pair in a second direction opposite of said first direction provides higher pressure fluid to the second lateral region and lower pressure fluid to the first lateral region, each end region being provided with higher pressure fluid for rotation in either the first or second directions.

Yet other embodiments pertain to any of the previous statements X1, X2, X3, and X4 which are combined with one or more of the following other aspects. It is also understood that any of the aforementioned X paragraphs include listings of individual features that can be combined with individual features of other X paragraphs.

Which further comprises a pair of check valves, one said check valve being adapted and configured to limit flow from said first port, said other check valve being adapted and configured to limit flow from said second port.

Wherein said first channel is a mirror image of said second channel.

Wherein each said first channel and said second channel each have a greater width proximate to the intermeshed portion of said gear pair and a lesser width toward the periphery of said bearing block.

Wherein one of said cover plates includes both said first port and said second port or one of said cover plates includes said first port and the other of said cover plates includes said second port.

Wherein one said bearing block includes opposing faces, one said face being opposite of said gears and the other said face being opposite of one said cover plate, each said journal bearing of said one block includes a bore with a central axis, said one block including a lateral plane that intersects each central axis, said one block has a width between the opposing faces, said one block including a fluid flow duct located in the plane across the width providing fluid communication between the opposing faces.

Wherein said fluid flow duct has a first angular width, said one face opposite of said gears includes a peripheral channel centered in the plane having a second angular width greater than the first angular width, the peripheral channel providing fluid communication from said one face opposite of said gears to the fluid flow duct.

Wherein one said bearing block includes opposing faces, one said face being opposite of said gears and the other said face being opposite of one said cover plate, said one block having a lateral plane of symmetry that extends through the journal bearings of said one block, said one block including a fluid flow duct located in the plane across the width providing fluid communication between the opposing faces.

Wherein said fluid flow duct has a first angular width, said one face opposite of said gears includes a peripheral channel having a second angular width greater than the first angular width, the peripheral channel providing fluid communication from said one face opposite of said gears to the fluid flow duct.

Wherein one said bearing block includes opposing faces separated by a width, one said face being opposite of said gears and the other said face being opposite of one said cover plate, said one block including a fluid flow duct across the width providing fluid communication between the opposing faces.

Wherein said one face opposite of said gears includes a peripheral channel providing fluid communication from said one face opposite of said gears to the fluid flow duct.

Wherein said gears are pinion gears.

Wherein the fluid flow duct is a first duct and said peripheral channel is a first peripheral channel, each said block including a second fluid flow duct across the width providing fluid communication between the one face and the other face of each said block, and each said one face opposite of said gears includes a second peripheral channel providing fluid communication from said one face opposite of said gears to the second fluid flow duct, said first duct and said second duct being located on opposite ends of the corresponding said block.

Wherein said face seals, said flow ducts, and said peripheral channels cooperate during operation of the pump to provide a net force that compresses the gear pair together.

Wherein said face seals are adapted and configured to divide the periphery of each said bearing block into two opposite lateral pressurized regions and two opposite end pressurized regions, and during operation each of the end regions and one of the lateral regions is provided with high pressure fluid from rotation of said gear pair.

Wherein each said gear has a plurality of teeth, and the peripheral channel has an angular span of more than two teeth.

Which further comprises a casing, each said bearing block and said gear pair being located in said casing, each said cover plate being affixed to opposing sides of said casing.

Wherein at least one of said casing or said cover plates including a first fluid port providing fluid from the pump at a higher pressure and a second fluid port providing fluid from the pump at a lower pressure.

Wherein said face seal is one of a separable elastomeric seal, a molded-in-place seal, or a seal produced by additive manufacturing.

Wherein each gear of said gear pair has a tip diameter of less than about twenty millimeters.

While the inventions have been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

The invention claimed is:

1. An apparatus for pumping fluid, comprising:

a pair of rotatable intermeshed gears, each of said gears including a shaft, each of said gears being located along the corresponding shaft, said gear pair being adapted and configured to simultaneously provide fluid at a higher pressure and fluid at a lower pressure;

a pair of substantially identical bearing blocks, each of the bearing blocks including a pair of journal bearings, each of the journal bearings of the bearing blocks supporting the corresponding shaft of said gear pair, said gear pair being located between said bearing blocks;

a casing defining an interior cavity that contains said gears and said bearing blocks, said casing having a pair of opposing end faces;

a pair of cover plates, each said cover plate having a face (R1, R6) being opposite of a face (R2, R5) of a corresponding bearing block; and a pair of face seals, each said face seal having an outer periphery located between one said cover plate and the corresponding end face of the casing and an inner periphery located between said same cover plate and the corresponding bearing block, the area between the inner periphery and the outer periphery being divided into first and second lateral regions (A, C) each being laterally adjacent and outboard of the gear pair and two end regions (B, D) each being outboard of a single corresponding gear of said pair;

wherein rotation of said gear pair in a first direction provides higher pressure fluid to the first lateral region and lower pressure fluid to the second lateral region, and rotation of said gear pair in a second direction opposite of said first direction provides higher pressure fluid to the second lateral region and lower pressure fluid to the first lateral region, each end region being provided with higher pressure fluid for rotation in either the first or second directions; and wherein one of said casing or said cover plates includes a first port receiving fluid at the higher pressure and a second port receiving fluid at a lower pressure, which further comprises a pair of check valves, one said check valve being adapted and configured to limit flow from said first port, said other check valve being adapted and configured to limit flow from said second port.

2. An apparatus for pumping fluid, comprising:

a pair of rotatable intermeshed gears, each of said gears including a shaft, each of said gears being located along the corresponding shaft, said gear pair being adapted and configured to simultaneously provide fluid at a higher pressure and fluid at a lower pressure;

a pair of substantially identical bearing blocks, each of the bearing blocks including a pair of journal bearings, each of the journal bearings of the bearing blocks supporting the corresponding shaft of said gear pair, said gear pair being located between said bearing blocks;

a casing defining an interior cavity that contains said gears and said bearing blocks, said casing having a pair of opposing end faces;

a pair of cover plates, each said cover plate having a face (R1, R6) being opposite of a face (R2, R5) of a corresponding bearing block; and a pair of face seals, each said face seal having an outer periphery located between one said cover plate and the corresponding end face of the casing and an inner periphery located between said same cover plate and the corresponding bearing block, the area between the inner periphery and the outer periphery being divided into first and second lateral regions (A, C) each being laterally adjacent and outboard of the gear pair and two end regions (B, D) each being outboard of a single corresponding gear of said pair;

wherein rotation of said gear pair in a first direction provides higher pressure fluid to the first lateral region and lower pressure fluid to the second lateral region, and rotation of said gear pair in a second direction opposite of said first direction provides higher pressure fluid to the second lateral region and lower pressure fluid to the first lateral region, each end region being provided with higher pressure fluid for rotation in either the first or second directions; wherein each said bearing block includes a face having first and second channels for providing fluid from said gear pair and to said gear pair, said first channel being substantially identical to said second channel, and wherein one of said cover plates includes both said first port and said second port.

3. An apparatus for pumping fluid, comprising:

a pair of rotatable intermeshed gears, each of said gears including a shaft, each of said gears being located along the corresponding shaft, said gear pair being adapted and configured to simultaneously provide fluid at a higher pressure and fluid at a lower pressure;

a pair of substantially identical bearing blocks, each of the bearing blocks including a pair of journal bearings, each of the journal bearings of the bearing blocks supporting a corresponding shaft of said gear pair, said gear pair being located between said bearing blocks;

a casing defining an interior cavity that contains said gears and said bearing blocks, said casing having a pair of opposing end faces;

a pair of cover plates, each said cover plate having a face (R1, R6) being opposite of a face (R2, R5) of a corresponding bearing block; and a pair of face seals, each said face seal having an outer periphery located between one said cover plate and the corresponding end face of the casing and an inner periphery located between said same cover plate and the corresponding bearing block, the area between the inner periphery and the outer periphery being divided into first and second lateral regions (A, C) each being laterally adjacent and outboard of the gear pair and two end regions (B, D) each being outboard of a single corresponding gear of said pair;

wherein rotation of said gear pair in a first direction provides higher pressure fluid to the first lateral region and lower pressure fluid to the second lateral region, and rotation of said gear pair in a second direction opposite of said first direction provides higher pressure fluid to the second lateral region and lower pressure fluid to the first lateral region, each end region being provided with higher pressure fluid for rotation in either the first or second directions;

wherein each said bearing block includes a face having first and second channels for providing fluid from said gear pair and to said gear pair, said first channel being substantially identical to said second channel, and wherein one of said cover plates includes said first port and the other of said cover plates includes said second port.

* * * * *